US010269366B2

(12) United States Patent
Liu et al.

(10) Patent No.: US 10,269,366 B2
(45) **Date of Patent: *Apr. 23, 2019**

(54) AUDIO CODING METHOD AND RELATED APPARATUS

(71) Applicant: HUAWEI TECHNOLOGIES CO.,LTD., Shenzhen, Guangdong (CN)

(72) Inventors: Zexin Liu, Beijing (CN); Lei Miao, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/986,839

(22) Filed: May 23, 2018

(65) Prior Publication Data

US 2018/0268832 A1 Sep. 20, 2018

Related U.S. Application Data

(63) Continuation of application No. 15/408,442, filed on Jan. 18, 2017, which is a continuation of application No. PCT/CN2015/075645, filed on Apr. 1, 2015.

(30) Foreign Application Priority Data

Jul. 28, 2014 (CN) ..... 2014 1 0363905

(51) Int. Cl.
*G10L 19/22* (2013.01)
*G10L 19/02* (2013.01)
(Continued)

(52) U.S. Cl.
CPC ..... *G10L 19/22* (2013.01); *G10L 19/0208* (2013.01); *G10L 19/12* (2013.01);
(Continued)

(58) Field of Classification Search
USPC ..... 704/500–504
See application file for complete search history.

(56) References Cited

U.S. PATENT DOCUMENTS 6,052,661 A 4/2000 Yamaura et al.
6,721,280 B1 4/2004 Mauro et al.
(Continued)

FOREIGN PATENT DOCUMENTS

CA 2951321 A1 2/2016
CN 1170189 A 1/1998
(Continued)

OTHER PUBLICATIONS

"5 Functional description of the encoder" 3GPP Draft;3GPP TS 26.445 V12.0.0 ,3 RD Generation Partnership Roject (3GPP) ,Mobile Competence Centre; 650 ,Route Des Lucioles;F—06921 Sophia—Antipolis Cedex ;France, Sep. 16, 2014, XP050872548. total 108 pages.

(Continued)

*Primary Examiner* — Leonard Saint Cyr
(74) *Attorney, Agent, or Firm* — Huawei Technologies Co., Ltd.

(57) ABSTRACT

An audio encoding method and a related apparatus are disclosed. The audio coding method includes: obtaining an audio signal; obtaining spectral coefficients of a current frame of the audio signal; obtaining a set of reference coding parameters of the current frame; determining whether the set of reference coding parameters satisfy a preset parameter condition; when it is determined that the reference coding parameters satisfy the preset parameter condition, encoding the spectral coefficients of the current frame using a transform coded excitation (TCX) algorithm. The audio encoding method and the related apparatus help improve encoding quality or encoding efficiency in audio signal encoding.

18 Claims, 8 Drawing Sheets

(51) Int. Cl.

| | |
|---|---|
| ***G10L 19/12*** | (2013.01) |
| *G10L 25/18* | (2013.01) |
| *G10L 25/21* | (2013.01) |

(52) U.S. Cl.
CPC ..... *G10L 19/0204* (2013.01); *G10L 19/0212* (2013.01); *G10L 25/18* (2013.01); *G10L 25/21* (2013.01)

(56) References Cited

U.S. PATENT DOCUMENTS

| | | | |
|---|---|---|---|
| 7,054,807 | B2 | 5/2006 | Ashley et al. |
| 8,244,525 | B2 | 8/2012 | Makinen |
| 8,731,948 | B2 | 5/2014 | Nagel et al. |
| 9,037,456 | B2 | 5/2015 | Mittal et al. |
| 2003/0004711 | A1 | 1/2003 | Koishida et al. |
| 2003/0195742 | A1 | 10/2003 | Tsushima et al. |
| 2004/0181393 | A1 | 9/2004 | Baumgarte |
| 2005/0240399 | A1 | 10/2005 | Makinen |
| 2007/0147518 | A1 | 6/2007 | Bessette |
| 2008/0312912 | A1 | 12/2008 | Choo et al. |
| 2011/0066440 | A1 | 3/2011 | Kishore |
| 2011/0173010 | A1 | 7/2011 | Lecomte et al. |
| 2011/0173011 | A1 | 7/2011 | Geiger et al. |
| 2011/0202353 | A1 | 8/2011 | Neuendorf et al. |
| 2011/0238425 | A1 | 9/2011 | Neuendorf et al. |
| 2011/0238426 | A1 | 9/2011 | Fuchs et al. |
| 2011/0257984 | A1 | 10/2011 | Virette et al. |
| 2012/0065965 | A1 | 3/2012 | Choo et al. |
| 2012/0146831 | A1 | 6/2012 | Eksler |
| 2012/0245947 | A1 | 9/2012 | Neuendorf et al. |
| 2012/0253797 | A1 | 10/2012 | Geiger et al. |
| 2012/0271644 | A1 | 10/2012 | Bessette et al. |
| 2013/0018660 | A1 | 1/2013 | Qi et al. |
| 2013/0030796 | A1 | 1/2013 | Liu |
| 2013/0090929 | A1 | 4/2013 | Ishikawa et al. |
| 2013/0096930 | A1 | 4/2013 | Neuendorf et al. |
| 2013/0185063 | A1 | 7/2013 | Atti et al. |
| 2014/0058737 | A1 | 2/2014 | Ishikawa et al. |
| 2014/0156286 | A1 | 6/2014 | Sung et al. |
| 2014/0343953 | A1 | 11/2014 | Geiger et al. |
| 2015/0088529 | A1 | 3/2015 | Moriya et al. |

FOREIGN PATENT DOCUMENTS

| | | | |
|---|---|---|---|
| CN | 1439155 | A | 8/2003 |
| CN | 1969319 | A | 5/2007 |
| CN | 101025918 | A | 8/2007 |
| CN | 101145343 | A | 3/2008 |
| CN | 101145345 | A | 3/2008 |
| CN | 101180677 | A | 5/2008 |
| CN | 101496099 | A | 7/2009 |
| CN | 102074242 | A | 5/2011 |
| CN | 102089814 | A | 6/2011 |
| CN | 103703512 | A | 4/2014 |
| CN | 104143335 | A | 11/2014 |
| EP | 0932141 | A2 | 7/1999 |
| RU | 2520402 | C2 | 6/2014 |
| WO | 2010040522 | A2 | 4/2010 |
| WO | 2013106192 | A1 | 7/2013 |

OTHER PUBLICATIONS

Schuyler Quackenbush:"MPEG Unified Speech and Audio Coding" ,IEEE Multimedia,IEEE Service Center, vol. 20, No. 2, Apr. 1, 2013, XP011515217, 8 pages.

Dietz Martin et al.: "Overview of the EUS codec architecture" ,2015 IEEE International Conference on Acoustics ,Speech and Signal Processing (I CASSP),IEEE,Apr. 19, 2015, XP033064791, 6 pages.

ISO/IEC FDIS 23003-3:2011(E), Information technology—MPEG audio technologies—Part 3: Unified speech and audio coding. ISO/IEC JTC 1/SC 29/WG 11. Sep. 20, 2011, 291 pages.

AUDIO CODING METHOD AND RELATED APPARATUS

CROSS-REFERENCE TO RELATED APPLICATIONS

This application is a continuation of U.S. patent application Ser. No. 15/408,442, filed on Jan. 18, 2017, which is a continuation of International Application No. PCT/CN2015/075645, filed on Apr. 1, 2015. The International Application claims priority to Chinese Patent Application No. 201410363905.5, filed on Jul. 28, 2014. All of the aforementioned patent applications are hereby incorporated by reference in their entireties.

TECHNICAL FIELD

The present disclosure relates to audio coding technologies, and specifically, to an audio coding method and a related apparatus.

BACKGROUND

Among existing audio (for example, music) coding algorithms, at a same bit rate, some audio coding algorithms are limited to a particular coding bandwidth, and they are mainly used to code an audio frame having a relatively low bandwidth. Some audio coding algorithms are not limited to a coding bandwidth, and they are mainly used to code an audio frame having a relatively high bandwidth. Certainly, both of the two categories of audio coding algorithms have advantages and disadvantages.

However, in the prior art, during audio frame coding, a fixed coding algorithm is directly used to code an audio frame. In this way, the used audio coding algorithm can hardly ensure fine coding quality or coding efficiency.

SUMMARY

Embodiments of the present disclosure provide an audio coding method and a related apparatus, to improve coding quality or coding efficiency of audio frame coding.

A first aspect of the embodiments of the present disclosure provides an audio coding method, including:

performing time-frequency transformation processing on a time-domain signal of a current audio frame, to obtain spectral coefficients of the current audio frame;

acquiring a reference coding parameter of the current audio frame; and if the acquired reference coding parameter of the current audio frame satisfies a first parameter condition, coding the spectral coefficients of the current audio frame based on a transform coded excitation algorithm, or if the acquired reference coding parameter of the current audio frame satisfies a second parameter condition, coding the spectral coefficients of the current audio frame based on a high quality transform coding algorithm.

With reference to the first aspect, in a first possible implementation manner of the first aspect, the reference coding parameter includes at least one of the following parameters: a coding rate of the current audio frame; a peak-to-average ratio of spectral coefficients that is located within a subband z and that is of the current audio frame; an envelope deviation of spectral coefficients that is located within a subband w and that is of the current audio frame; an energy average of spectral coefficients that is located within a subband i and that is of the current audio frame and an energy average of spectral coefficients that is located within a subband j and that is of the current audio frame; an amplitude average of spectral coefficients that is located within a subband m and that is of the current audio frame and an amplitude average of spectral coefficients that is located within a subband n and that is of the current audio frame; a peak-to-average ratio of spectral coefficients that is located within a subband x and that is of the current audio frame and a peak-to-average ratio of spectral coefficients that is located within a subband y and that is of the current audio frame; an envelope deviation of spectral coefficients that is located within a subband r and that is of the current audio frame and an envelope deviation of spectral coefficients that is located within a subband s and that is of the current audio frame; an envelope of spectral coefficients that is located within a subband e and that is of the current audio frame and an envelope of spectral coefficients that is located within a subband f and that is of the current audio frame; or a parameter value of spectral correlation between spectral coefficients that is located within a subband p and that is of the current audio frame and spectral coefficients that is located within a subband q and that is of the current audio frame, where a highest frequency bin of the subband z is greater than a critical frequency bin F1; a highest frequency bin of the subband w is greater than the critical frequency bin F1; a highest frequency bin of the subband j is greater than a critical frequency bin F2; and a highest frequency bin of the subband n is greater than the critical frequency bin F2;

a value range of the critical frequency bin F1 is 6.4 kHz to 12 kHz;

a value range of the critical frequency bin F2 is 4.8 kHz to 8 kHz; and a highest frequency bin of the subband i is less than the highest frequency bin of the subband j; a highest frequency bin of the subband m is less than the highest frequency bin of the subband n; a highest frequency bin of the subband x is less than or equal to a lowest frequency bin of the subband y; a highest frequency bin of the subband p is less than or equal to a lowest frequency bin of the subband q; a highest frequency bin of the subband r is less than or equal to a lowest frequency bin of the subband s; and a highest frequency bin of the subband e is less than or equal to a lowest frequency bin of the subband f.

With reference to the first possible implementation manner of the first aspect, in a second possible implementation manner of the first aspect, at least one of the following conditions is satisfied: a lowest frequency bin of the subband w is greater than or equal to the critical frequency bin F1, a lowest frequency bin of the subband z is greater than or equal to the critical frequency bin F1, the highest frequency bin of the subband i is less than or equal to a lowest frequency bin of the subband j, the highest frequency bin of the subband m is less than or equal to a lowest frequency bin of the subband n, a lowest frequency bin of the subband j is greater than the critical frequency bin F2, or a lowest frequency bin of the subband n is greater than the critical frequency bin F2.

With reference to the first possible implementation manner of the first aspect or the second possible implementation manner of the first aspect, in a third possible implementation manner of the first aspect, the first parameter condition includes at least one of the following conditions:

the coding rate of the current audio frame is less than a threshold T1;

the peak-to-average ratio of the spectral coefficients that are located within the subband z and that is of the current audio frame is less than or equal to a threshold T2;

the envelope deviation of the spectral coefficients that are located within the subband w and that is of the current audio frame is less than or equal to a threshold T3;

a quotient of dividing the energy average of the spectral coefficients that are located within the subband i and that is of the current audio frame by the energy average of the spectral coefficients that are located within the subband j and that is of the current audio frame is greater than or equal to a threshold T4;

a difference of subtracting the energy average of the spectral coefficients that are located within the subband j and that is of the current audio frame from the energy average of the spectral coefficients that are located within the subband i and that is of the current audio frame is greater than or equal to a threshold T5;

a quotient of dividing the amplitude average of the spectral coefficients that are located within the subband m and that is of the current audio frame by the amplitude average of the spectral coefficients that are located within the subband n and that is of the current audio frame is greater than or equal to a threshold T6;

a difference of subtracting the amplitude average of the spectral coefficients that are located within the subband n and that is of the current audio frame from the amplitude average of the spectral coefficients that are located within the subband m and that is of the current audio frame is greater than or equal to a threshold T7;

a ratio of the peak-to-average ratio of the spectral coefficients that are located within the subband x and that is of the current audio frame to the peak-to-average ratio of the spectral coefficients that are located within the subband y and that is of the current audio frame falls within an interval R1;

an absolute value of a difference between the peak-to-average ratio of the spectral coefficients that are located within the subband x and that is of the current audio frame and the peak-to-average ratio of the spectral coefficients that are located within the subband y and that is of the current audio frame is less than or equal to a threshold T8;

a ratio of the envelope deviation of the spectral coefficients that are located within the subband r and that is of the current audio frame to the envelope deviation of the spectral coefficients that are located within the subband s and that is of the current audio frame falls within an interval R2;

an absolute value of a difference between the envelope deviation of the spectral coefficients that are located within the subband r and that is of the current audio frame and the envelope deviation of the spectral coefficients that are located within the subband s and that is of the current audio frame is less than or equal to a threshold T9;

a ratio of the envelope of the spectral coefficients that are located within the subband e and that is of the current audio frame to the envelope of the spectral coefficients that are located within the subband f and that is of the current audio frame falls within an interval R3;

an absolute value of a difference between the envelope of the spectral coefficients that are located within the subband e and that is of the current audio frame and the envelope of the spectral coefficients that are located within the subband f and that is of the current audio frame is less than or equal to a threshold T10; or the parameter value of spectral correlation between the spectral coefficients that are located within the subband p and that is of the current audio frame and the spectral coefficients that are located within the subband q and that is of the current audio frame is greater than or equal to a threshold T11.

With reference to the first possible implementation manner of the first aspect, the second possible implementation manner of the first aspect, or the third possible implementation manner of the first aspect, in a fourth possible implementation manner of the first aspect, the first parameter condition includes one of the following conditions:

a quotient of dividing the peak-to-average ratio of the spectral coefficients that are located within the subband x and that is of the current audio frame by the peak-to-average ratio of the spectral coefficients that are located within the subband y and that is of the current audio frame is less than a threshold T44, and the peak-to-average ratio of the spectral coefficients that are located within the subband y and that is of the current audio frame is less than a threshold T45;

a quotient of dividing the peak-to-average ratio of the spectral coefficients that are located within the subband x and that is of the current audio frame by the peak-to-average ratio of the spectral coefficients that are located within the subband y and that is of the current audio frame is greater than a threshold T46, and the peak-to-average ratio of the spectral coefficients that are located within the subband y and that is of the current audio frame is greater than a threshold T47;

a difference of subtracting the peak-to-average ratio of the spectral coefficients that are located within the subband y and that is of the current audio frame from the peak-to-average ratio of the spectral coefficients that are located within the subband x and that is of the current audio frame is less than a threshold T48, and the peak-to-average ratio of the spectral coefficients that are located within the subband y and that is of the current audio frame is less than a threshold T49;

a difference of subtracting the peak-to-average ratio of the spectral coefficients that are located within the subband y and that is of the current audio frame from the peak-to-average ratio of the spectral coefficients that are located within the subband x and that is of the current audio frame is greater than a threshold T50, and the peak-to-average ratio of the spectral coefficients that are located within the subband y and that is of the current audio frame is greater than a threshold T51;

a quotient of dividing the envelope deviation of the spectral coefficients that are located within the subband r and that is of the current audio frame by the envelope deviation of the spectral coefficients that are located within the subband s and that is of the current audio frame is less than a threshold T52, and the envelope deviation of the spectral coefficients that are located within the subband s and that is of the current audio frame is less than a threshold T53;

a quotient of dividing the envelope deviation of the spectral coefficients that are located within the subband r and that is of the current audio frame by the envelope deviation of the spectral coefficients that are located within the subband s and that is of the current audio frame is greater than a threshold T54, and the envelope deviation of the spectral coefficients that are located within the subband s and that is of the current audio frame is greater than a threshold T55;

a difference of subtracting the envelope deviation of the spectral coefficients that are located within the subband s and that is of the current audio frame from the envelope deviation of the spectral coefficients that are located within the subband r and that is of the current audio frame is less than a threshold T56, and the envelope deviation of the spectral coefficients that are located within the subband s and that is of the current audio frame is less than a threshold T57;

a difference of subtracting the envelope deviation of the spectral coefficients that are located within the subband s and that is of the current audio frame from the envelope deviation of the spectral coefficients that are located within the subband r and that is of the current audio frame is greater than a threshold T58, and the envelope deviation of the spectral coefficients that are located within the subband s and that is of the current audio frame is greater than a threshold T59;

a quotient of dividing the envelope of the spectral coefficients that are located within the subband e and that is of the current audio frame by the envelope of the spectral coefficients that are located within the subband f and that is of the current audio frame is less than a threshold T60, and the envelope of the spectral coefficients that are located within the subband f and that is of the current audio frame is less than a threshold T61;

a quotient of dividing the envelope of the spectral coefficients that are located within the subband e and that is of the current audio frame by the envelope of the spectral coefficients that are located within the subband f and that is of the current audio frame is greater than a threshold T62, and the envelope of the spectral coefficients that are located within the subband f and that is of the current audio frame is greater than a threshold T63;

a difference of subtracting the envelope of the spectral coefficients that are located within the subband f and that is of the current audio frame from the envelope of the spectral coefficients that are located within the subband e and that is of the current audio frame is less than a threshold T64, and the envelope of the spectral coefficients that are located within the subband f and that is of the current audio frame is less than a threshold T65;

a difference of subtracting the envelope of the spectral coefficients that are located within the subband f and that is of the current audio frame from the envelope of the spectral coefficients that are located within the subband e and that is of the current audio frame is greater than a threshold T66, and the envelope of the spectral coefficients that are located within the subband f and that is of the current audio frame is greater than a threshold T67;

the quotient of dividing the energy average of the spectral coefficients that are located within the subband i and that is of the current audio frame by the energy average of the spectral coefficients that are located within the subband j and that is of the current audio frame is less than or equal to a threshold T68, and the peak-to-average ratio of the spectral coefficients that are located within the subband z and that is of the current audio frame is less than or equal to a threshold T69;

the difference of subtracting the energy average of the spectral coefficients that are located within the subband j and that is of the current audio frame from the energy average of the spectral coefficients that are located within the subband i and that is of the current audio frame is less than or equal to a threshold T70, and the peak-to-average ratio of the spectral coefficients that are located within the subband z and that is of the current audio frame is less than or equal to a threshold T71;

the quotient of dividing the amplitude average of the spectral coefficients that are located within the subband m and that is of the current audio frame by the amplitude average of the spectral coefficients that are located within the subband n and that is of the current audio frame is less than or equal to a threshold T72, and the peak-to-average ratio of the spectral coefficients that are located within the subband z and that is of the current audio frame is less than or equal to a threshold T73;

the difference of subtracting the amplitude average of the spectral coefficients that are located within the subband n and that is of the current audio frame from the amplitude average of the spectral coefficients that are located within the subband m and that is of the current audio frame is less than or equal to a threshold T74, and the peak-to-average ratio of the spectral coefficients that are located within the subband z and that is of the current audio frame is less than or equal to a threshold T75;

the quotient of dividing the energy average of the spectral coefficients that are located within the subband i and that is of the current audio frame by the energy average of the spectral coefficients that are located within the subband j and that is of the current audio frame is less than or equal to a threshold T76, and the envelope deviation of the spectral coefficients that are located within the subband w and that is of the current audio frame is less than or equal to a threshold T77;

the difference of subtracting the energy average of the spectral coefficients that are located within the subband j and that is of the current audio frame from the energy average of the spectral coefficients that are located within the subband i and that is of the current audio frame is less than or equal to a threshold T78, and the envelope deviation of the spectral coefficients that are located within the subband w and that is of the current audio frame is less than or equal to a threshold T79;

the quotient of dividing the amplitude average of the spectral coefficients that are located within the subband m and that is of the current audio frame by the amplitude average of the spectral coefficients that are located within the subband n and that is of the current audio frame is less than or equal to a threshold T80, and the envelope deviation of the spectral coefficients that are located within the subband w and that is of the current audio frame is less than or equal to a threshold T81; or the difference of subtracting the amplitude average of the spectral coefficients that are located within the subband n and that is of the current audio frame from the amplitude average of the spectral coefficients that are located within the subband m and that is of the current audio frame is less than or equal to a threshold T82, and the envelope deviation of the spectral coefficients that are located within the subband w and that is of the current audio frame is less than or equal to a threshold T83.

With reference to the first possible implementation manner of the first aspect, the second possible implementation manner of the first aspect, the third possible implementation manner of the first aspect, or the fourth possible implementation manner of the first aspect, in a fifth possible implementation manner of the first aspect, the second parameter condition includes at least one of the following conditions:

the coding rate of the current audio frame is greater than or equal to the threshold T1;

the peak-to-average ratio of the spectral coefficients that are located within the subband z and that is of the current audio frame is greater than the threshold T2;

the envelope deviation of the spectral coefficients that are located within the subband w and that is of the current audio frame is greater than the threshold T3;

the quotient of dividing the energy average of the spectral coefficients that are located within the subband i and that is of the current audio frame by the energy average of the spectral coefficients that are located within the subband j and that is of the current audio frame is less than the threshold T4;

the difference of subtracting the energy average of the spectral coefficients that are located within the subband j and that is of the current audio frame from the energy average of the spectral coefficients that are located within the subband i and that is of the current audio frame is less than the threshold T5;

the quotient of dividing the amplitude average of the spectral coefficients that are located within the subband m and that is of the current audio frame by the amplitude average of the spectral coefficients that are located within the subband n and that is of the current audio frame is less than the threshold T6;

the difference of subtracting the amplitude average of the spectral coefficients that are located within the subband n and that is of the current audio frame from the amplitude average of the spectral coefficients that are located within the subband m and that is of the current audio frame is less than the threshold T7;

the ratio of the peak-to-average ratio of the spectral coefficients that are located within the subband x and that is of the current audio frame to the peak-to-average ratio of the spectral coefficients that are located within the subband y and that is of the current audio frame does not fall within the interval R1;

the absolute value of the difference between the peak-to-average ratio of the spectral coefficients that are located within the subband x and that is of the current audio frame and the peak-to-average ratio of the spectral coefficients that are located within the subband y and that is of the current audio frame is greater than the threshold T8;

the ratio of the envelope deviation of the spectral coefficients that are located within the subband r and that is of the current audio frame to the envelope deviation of the spectral coefficients that are located within the subband s and that is of the current audio frame does not fall within the interval R2;

the absolute value of the difference between the envelope deviation of the spectral coefficients that are located within the subband r and that is of the current audio frame and the envelope deviation of the spectral coefficients that are located within the subband s and that is of the current audio frame is greater than the threshold T9;

the ratio of the envelope of the spectral coefficients that are located within the subband e and that is of the current audio frame to the envelope of the spectral coefficients that are located within the subband f and that is of the current audio frame does not fall within the interval R3;

the absolute value of the difference between the envelope of the spectral coefficients that are located within the subband e and that is of the current audio frame and the envelope of the spectral coefficients that are located within the subband f and that is of the current audio frame is greater than the threshold T10; or the parameter value of spectral correlation between the spectral coefficients that are located within the subband p and that is of the current audio frame and the spectral coefficients that are located within the subband q and that is of the current audio frame is less than the threshold T11.

With reference to the first possible implementation manner of the first aspect, the second possible implementation manner of the first aspect, the third possible implementation manner of the first aspect, the fourth possible implementation manner of the first aspect, or the fifth possible implementation manner of the first aspect, in a sixth possible implementation manner of the first aspect, the second parameter condition includes one of the following conditions:

the quotient of dividing the peak-to-average ratio of the spectral coefficients that are located within the subband x and that is of the current audio frame by the peak-to-average ratio of the spectral coefficients that are located within the subband y and that is of the current audio frame is less than the threshold T44, and the peak-to-average ratio of the spectral coefficients that are located within the subband y and that is of the current audio frame is greater than the threshold T45;

the quotient of dividing the peak-to-average ratio of the spectral coefficients that are located within the subband x and that is of the current audio frame by the peak-to-average ratio of the spectral coefficients that are located within the subband y and that is of the current audio frame is greater than the threshold T46, and the peak-to-average ratio of the spectral coefficients that are located within the subband y and that is of the current audio frame is less than the threshold T47;

the difference of subtracting the peak-to-average ratio of the spectral coefficients that are located within the subband y and that is of the current audio frame from the peak-to-average ratio of the spectral coefficients that are located within the subband x and that is of the current audio frame is less than the threshold T48, and the peak-to-average ratio of the spectral coefficients that are located within the subband y and that is of the current audio frame is greater than the threshold T49;

the difference of subtracting the peak-to-average ratio of the spectral coefficients that are located within the subband y and that is of the current audio frame from the peak-to-average ratio of the spectral coefficients that are located within the subband x and that is of the current audio frame is greater than the threshold T50, and the peak-to-average ratio of the spectral coefficients that are located within the subband y and that is of the current audio frame is less than the threshold T51;

the quotient of dividing the envelope deviation of the spectral coefficients that are located within the subband r and that is of the current audio frame by the envelope deviation of the spectral coefficients that are located within the subband s and that is of the current audio frame is less than the threshold T52, and the envelope deviation of the spectral coefficients that are located within the subband s and that is of the current audio frame is greater than the threshold T53;

the quotient of dividing the envelope deviation of the spectral coefficients that are located within the subband r and that is of the current audio frame by the envelope deviation of the spectral coefficients that are located within the subband s and that is of the current audio frame is greater than the threshold T54, and the envelope deviation of the spectral coefficients that are located within the subband s and that is of the current audio frame is less than the threshold T55;

the difference of subtracting the envelope deviation of the spectral coefficients that are located within the subband s and that is of the current audio frame from the envelope deviation of the spectral coefficients that are located within the subband r and that is of the current audio frame is less than the threshold T56, and the envelope deviation of the spectral coefficients that are located within the subband s and that is of the current audio frame is greater than the threshold T57;

the difference of subtracting the envelope deviation of the spectral coefficients that are located within the subband s and that is of the current audio frame from the envelope deviation of the spectral coefficients that are located within the subband r and that is of the current audio frame is greater than the threshold T58, and the envelope deviation of the spectral coefficients that are located within the subband s and that is of the current audio frame is less than the threshold T59;

the quotient of dividing the envelope of the spectral coefficients that are located within the subband e and that is of the current audio frame by the envelope of the spectral coefficients that are located within the subband f and that is of the current audio frame is less than the threshold T60, and the envelope of the spectral coefficients that are located within the subband f and that is of the current audio frame is greater than the threshold T61;

the quotient of dividing the envelope of the spectral coefficients that are located within the subband e and that is of the current audio frame by the envelope of the spectral coefficients that are located within the subband f and that is of the current audio frame is greater than the threshold T62, and the envelope of the spectral coefficients that are located within the subband f and that is of the current audio frame is less than the threshold T63;

the difference of subtracting the envelope of the spectral coefficients that are located within the subband f and that is of the current audio frame from the envelope of the spectral coefficients that are located within the subband e and that is of the current audio frame is less than the threshold T64, and the envelope of the spectral coefficients that are located within the subband f and that is of the current audio frame is greater than the threshold T65;

the difference of subtracting the envelope of the spectral coefficients that are located within the subband f and that is of the current audio frame from the envelope of the spectral coefficients that are located within the subband e and that is of the current audio frame is greater than the threshold T66, and the envelope of the spectral coefficients that are located within the subband f and that is of the current audio frame is less than the threshold T67;

the quotient of dividing the energy average of the spectral coefficients that are located within the subband i and that is of the current audio frame by the energy average of the spectral coefficients that are located within the subband j and that is of the current audio frame is less than or equal to the threshold T68, and the peak-to-average ratio of the spectral coefficients that are located within the subband z and that is of the current audio frame is greater than the threshold T69;

the difference of subtracting the energy average of the spectral coefficients that are located within the subband j and that is of the current audio frame from the energy average of the spectral coefficients that are located within the subband i and that is of the current audio frame is less than or equal to the threshold T70, and the peak-to-average ratio of the spectral coefficients that are located within the subband z and that is of the current audio frame is greater than the threshold T71;

the quotient of dividing the amplitude average of the spectral coefficients that are located within the subband m and that is of the current audio frame by the amplitude average of the spectral coefficients that are located within the subband n and that is of the current audio frame is less than or equal to the threshold T72, and the peak-to-average ratio of the spectral coefficients that are located within the subband z and that is of the current audio frame is greater than the threshold T73;

the difference of subtracting the amplitude average of the spectral coefficients that are located within the subband n and that is of the current audio frame from the amplitude average of the spectral coefficients that are located within the subband m and that is of the current audio frame is less than or equal to the threshold T74, and the peak-to-average ratio of the spectral coefficients that are located within the subband z and that is of the current audio frame is greater than the threshold T75;

the quotient of dividing the energy average of the spectral coefficients that are located within the subband i and that is of the current audio frame by the energy average of the spectral coefficients that are located within the subband j and that is of the current audio frame is less than or equal to the threshold T76, and the envelope deviation of the spectral coefficients that are located within the subband w and that is of the current audio frame is greater than the threshold T77;

the difference of subtracting the energy average of the spectral coefficients that are located within the subband j and that is of the current audio frame from the energy average of the spectral coefficients that are located within the subband i and that is of the current audio frame is less than or equal to the threshold T78, and the envelope deviation of the spectral coefficients that are located within the subband w and that is of the current audio frame is greater than the threshold T79;

the quotient of dividing the amplitude average of the spectral coefficients that are located within the subband m and that is of the current audio frame by the amplitude average of the spectral coefficients that are located within the subband n and that is of the current audio frame is less than or equal to the threshold T80, and the envelope deviation of the spectral coefficients that are located within the subband w and that is of the current audio frame is greater than the threshold T81; or the difference of subtracting the amplitude average of the spectral coefficients that are located within the subband n and that is of the current audio frame from the amplitude average of the spectral coefficients that are located within the subband m and that is of the current audio frame is less than or equal to the threshold T82, and the envelope deviation of the spectral coefficients that are located within the subband w and that is of the current audio frame is greater than the threshold T83.

With reference to the third possible implementation manner of the first aspect, the fourth possible implementation manner of the first aspect, the fifth possible implementation manner of the first aspect, or the sixth possible implementation manner of the first aspect, in a seventh possible implementation manner of the first aspect, at least one of the following conditions is satisfied:

the threshold T2 is greater than or equal to 2;

the threshold T4 is less than or equal to 1/1.2;

the interval R1 is [1/2.25, 2.25];

the threshold T44 is less than or equal to 1/2.56;

the threshold T45 is greater than or equal to 1.5;

the threshold T46 is greater than or equal to 1/2.56;

the threshold T47 is less than or equal to 1.5;

the threshold T68 is less than or equal to 1.25; or the threshold T69 is greater than or equal to 2.

A second aspect of the embodiments of the present disclosure provides an audio coder, including:

a time-frequency transformation unit, configured to perform time-frequency transformation processing on a time-domain signal of a current audio frame, to obtain spectral coefficients of the current audio frame;

an acquiring unit, configured to acquire a reference coding parameter of the current audio frame; and a coding unit, configured to: if the reference coding parameter that is acquired by the acquiring unit and that is of the current audio frame satisfies a first parameter condition, code the spectral coefficients of the current audio frame based on a transform coded excitation algorithm, or if the reference coding parameter that is acquired by the acquiring unit and that is of the current audio frame satisfies a second parameter condition, code the spectral coefficients of the current audio frame based on a high quality transform coding algorithm.

With reference to the second aspect, in a first possible implementation manner of the second aspect, the reference coding parameter includes at least one of the following parameters: a coding rate of the current audio frame; a peak-to-average ratio of spectral coefficients that is located within a subband z and that is of the current audio frame; an envelope deviation of spectral coefficients that is located within a subband w and that is of the current audio frame; an energy average of spectral coefficients that is located within a subband i and that is of the current audio frame and an energy average of spectral coefficients that is located within a subband j and that is of the current audio frame; an amplitude average of spectral coefficients that is located within a subband m and that is of the current audio frame and an amplitude average of spectral coefficients that is located within a subband n and that is of the current audio frame; a peak-to-average ratio of spectral coefficients that is located within a subband x and that is of the current audio frame and a peak-to-average ratio of spectral coefficients that is located within a subband y and that is of the current audio frame; an envelope deviation of spectral coefficients that is located within a subband r and that is of the current audio frame and an envelope deviation of spectral coefficients that is located within a subband s and that is of the current audio frame; an envelope of spectral coefficients that is located within a subband e and that is of the current audio frame and an envelope of spectral coefficients that is located within a subband f and that is of the current audio frame; or a parameter value of spectral correlation between spectral coefficients that is located within a subband p and that is of the current audio frame and spectral coefficients that is located within a subband q and that is of the current audio frame, where a highest frequency bin of the subband z is greater than a critical frequency bin F1; a highest frequency bin of the subband w is greater than the critical frequency bin F1; a highest frequency bin of the subband j is greater than a critical frequency bin F2; and a highest frequency bin of the subband n is greater than the critical frequency bin F2; a value range of the critical frequency bin F1 is 6.4 kHz to 12 kHz; and a value range of the critical frequency bin F2 is 4.8 kHz to 8 kHz; and a highest frequency bin of the subband i is less than the highest frequency bin of the subband j; a highest frequency bin of the subband m is less than the highest frequency bin of the subband n; a highest frequency bin of the subband x is less than or equal to a lowest frequency bin of the subband y; a highest frequency bin of the subband p is less than or equal to a lowest frequency bin of the subband q; a highest frequency bin of the subband r is less than or equal to a lowest frequency bin of the subband s; and a highest frequency bin of the subband e is less than or equal to a lowest frequency bin of the subband f.

With reference to the first possible implementation manner of the second aspect, in a second possible implementation manner of the second aspect, at least one of the following conditions is satisfied: a lowest frequency bin of the subband w is greater than or equal to the critical frequency bin F1, a lowest frequency bin of the subband z is greater than or equal to the critical frequency bin F1, the highest frequency bin of the subband i is less than or equal to a lowest frequency bin of the subband j, the highest frequency bin of the subband m is less than or equal to a lowest frequency bin of the subband n, a lowest frequency bin of the subband j is greater than the critical frequency bin F2, or a lowest frequency bin of the subband n is greater than the critical frequency bin F2.

With reference to the first possible implementation manner of the second aspect or the second possible implementation manner of the second aspect, in a third possible implementation manner of the second aspect, the first parameter condition includes at least one of the following conditions:

the coding rate of the current audio frame is less than a threshold T1;

the peak-to-average ratio of the spectral coefficients that are located within the subband z and that is of the current audio frame is less than or equal to a threshold T2;

the envelope deviation of the spectral coefficients that are located within the subband w and that is of the current audio frame is less than or equal to a threshold T3;

a quotient of dividing the energy average of the spectral coefficients that are located within the subband i and that is of the current audio frame by the energy average of the spectral coefficients that are located within the subband j and that is of the current audio frame is greater than or equal to a threshold T4;

a difference of subtracting the energy average of the spectral coefficients that are located within the subband j and that is of the current audio frame from the energy average of the spectral coefficients that are located within the subband i and that is of the current audio frame is greater than or equal to a threshold T5;

a quotient of dividing the amplitude average of the spectral coefficients that are located within the subband m and that is of the current audio frame by the amplitude average of the spectral coefficients that are located within the subband n and that is of the current audio frame is greater than or equal to a threshold T6;

a difference of subtracting the amplitude average of the spectral coefficients that are located within the subband n and that is of the current audio frame from the amplitude average of the spectral coefficients that are located within the subband m and that is of the current audio frame is greater than or equal to a threshold T7;

a ratio of the peak-to-average ratio of the spectral coefficients that are located within the subband x and that is of the current audio frame to the peak-to-average ratio of the spectral coefficients that are located within the subband y and that is of the current audio frame falls within an interval R1;

an absolute value of a difference between the peak-to-average ratio of the spectral coefficients that are located within the subband x and that is of the current audio frame and the peak-to-average ratio of the spectral coefficients that are located within the subband y and that is of the current audio frame is less than or equal to a threshold T8;

a ratio of the envelope deviation of the spectral coefficients that are located within the subband r and that is of the current audio frame to the envelope deviation of the spectral coefficients that are located within the subband s and that is of the current audio frame falls within an interval R2;

an absolute value of a difference between the envelope deviation of the spectral coefficients that are located within the subband r and that is of the current audio frame and the envelope deviation of the spectral coefficients that are located within the subband s and that is of the current audio frame is less than or equal to a threshold T9;

a ratio of the envelope of the spectral coefficients that are located within the subband e and that is of the current audio frame to the envelope of the spectral coefficients that are located within the subband f and that is of the current audio frame falls within an interval R3;

an absolute value of a difference between the envelope of the spectral coefficients that are located within the subband e and that is of the current audio frame and the envelope of the spectral coefficients that are located within the subband f and that is of the current audio frame is less than or equal to a threshold T10; or the parameter value of spectral correlation between the spectral coefficients that are located within the subband p and that is of the current audio frame and the spectral coefficients that are located within the subband q and that is of the current audio frame is greater than or equal to a threshold T11.

With reference to the first possible implementation manner of the second aspect, the second possible implementation manner of the second aspect, or the third possible implementation manner of the second aspect, in a fourth possible implementation manner of the second aspect, the first parameter condition includes one of the following conditions:

a quotient of dividing the peak-to-average ratio of the spectral coefficients that are located within the subband x and that is of the current audio frame by the peak-to-average ratio of the spectral coefficients that are located within the subband y and that is of the current audio frame is less than a threshold T44, and the peak-to-average ratio of the spectral coefficients that are located within the subband y and that is of the current audio frame is less than a threshold T45;

a quotient of dividing the peak-to-average ratio of the spectral coefficients that are located within the subband x and that is of the current audio frame by the peak-to-average ratio of the spectral coefficients that are located within the subband y and that is of the current audio frame is greater than a threshold T46, and the peak-to-average ratio of the spectral coefficients that are located within the subband y and that is of the current audio frame is greater than a threshold T47;

a difference of subtracting the peak-to-average ratio of the spectral coefficients that are located within the subband y and that is of the current audio frame from the peak-to-average ratio of the spectral coefficients that are located within the subband x and that is of the current audio frame is less than a threshold T48, and the peak-to-average ratio of the spectral coefficients that are located within the subband y and that is of the current audio frame is less than a threshold T49;

a difference of subtracting the peak-to-average ratio of the spectral coefficients that are located within the subband y and that is of the current audio frame from the peak-to-average ratio of the spectral coefficients that are located within the subband x and that is of the current audio frame is greater than a threshold T50, and the peak-to-average ratio of the spectral coefficients that are located within the subband y and that is of the current audio frame is greater than a threshold T51;

a quotient of dividing the envelope deviation of the spectral coefficients that are located within the subband r and that is of the current audio frame by the envelope deviation of the spectral coefficients that are located within the subband s and that is of the current audio frame is less than a threshold T52, and the envelope deviation of the spectral coefficients that are located within the subband s and that is of the current audio frame is less than a threshold T53;

a quotient of dividing the envelope deviation of the spectral coefficients that are located within the subband r and that is of the current audio frame by the envelope deviation of the spectral coefficients that are located within the subband s and that is of the current audio frame is greater than a threshold T54, and the envelope deviation of the spectral coefficients that are located within the subband s and that is of the current audio frame is greater than a threshold T55;

a difference of subtracting the envelope deviation of the spectral coefficients that are located within the subband s and that is of the current audio frame from the envelope deviation of the spectral coefficients that are located within the subband r and that is of the current audio frame is less than a threshold T56, and the envelope deviation of the spectral coefficients that are located within the subband s and that is of the current audio frame is less than a threshold T57;

a difference of subtracting the envelope deviation of the spectral coefficients that are located within the subband s and that is of the current audio frame from the envelope deviation of the spectral coefficients that are located within the subband r and that is of the current audio frame is greater than a threshold T58, and the envelope deviation of the spectral coefficients that are located within the subband s and that is of the current audio frame is greater than a threshold T59;

a quotient of dividing the envelope of the spectral coefficients that are located within the subband e and that is of the current audio frame by the envelope of the spectral coefficients that are located within the subband f and that is of the current audio frame is less than a threshold T60, and the envelope of the spectral coefficients that are located within the subband f and that is of the current audio frame is less than a threshold T61;

a quotient of dividing the envelope of the spectral coefficients that are located within the subband e and that is of the current audio frame by the envelope of the spectral coefficients that are located within the subband f and that is of the current audio frame is greater than a threshold T62, and the envelope of the spectral coefficients that are located within the subband f and that is of the current audio frame is greater than a threshold T63;

a difference of subtracting the envelope of the spectral coefficients that are located within the subband f and that is of the current audio frame from the envelope of the spectral coefficients that are located within the subband e and that is of the current audio frame is less than a threshold T64, and the envelope of the spectral coefficients that are located within the subband f and that is of the current audio frame is less than a threshold T65;

a difference of subtracting the envelope of the spectral coefficients that are located within the subband f and that is of the current audio frame from the envelope of the spectral coefficients that are located within the subband e and that is of the current audio frame is greater than a threshold T66, and the envelope of the spectral coefficients that are located within the subband f and that is of the current audio frame is greater than a threshold T67;

the quotient of dividing the energy average of the spectral coefficients that are located within the subband i and that is of the current audio frame by the energy average of the spectral coefficients that are located within the subband j and that is of the current audio frame is less than or equal to a threshold T68, and the peak-to-average ratio of the spectral coefficients that are located within the subband z and that is of the current audio frame is less than or equal to a threshold T69;

the difference of subtracting the energy average of the spectral coefficients that are located within the subband j and that is of the current audio frame from the energy average of the spectral coefficients that are located within the subband i and that is of the current audio frame is less than or equal to a threshold T70, and the peak-to-average ratio of the spectral coefficients that are located within the subband z and that is of the current audio frame is less than or equal to a threshold T71;

the quotient of dividing the amplitude average of the spectral coefficients that are located within the subband m and that is of the current audio frame by the amplitude average of the spectral coefficients that are located within the subband n and that is of the current audio frame is less than or equal to a threshold T72, and the peak-to-average ratio of the spectral coefficients that are located within the subband z and that is of the current audio frame is less than or equal to a threshold T73;

the difference of subtracting the amplitude average of the spectral coefficients that are located within the subband n and that is of the current audio frame from the amplitude average of the spectral coefficients that are located within the subband m and that is of the current audio frame is less than or equal to a threshold T74, and the peak-to-average ratio of the spectral coefficients that are located within the subband z and that is of the current audio frame is less than or equal to a threshold T75;

the quotient of dividing the energy average of the spectral coefficients that are located within the subband i and that is of the current audio frame by the energy average of the spectral coefficients that are located within the subband j and that is of the current audio frame is less than or equal to a threshold T76, and the envelope deviation of the spectral coefficients that are located within the subband w and that is of the current audio frame is less than or equal to a threshold T77;

the difference of subtracting the energy average of the spectral coefficients that are located within the subband j and that is of the current audio frame from the energy average of the spectral coefficients that are located within the subband i and that is of the current audio frame is less than or equal to a threshold T78, and the envelope deviation of the spectral coefficients that are located within the subband w and that is of the current audio frame is less than or equal to a threshold T79;

the quotient of dividing the amplitude average of the spectral coefficients that are located within the subband m and that is of the current audio frame by the amplitude average of the spectral coefficients that are located within the subband n and that is of the current audio frame is less than or equal to a threshold T80, and the envelope deviation of the spectral coefficients that are located within the subband w and that is of the current audio frame is less than or equal to a threshold T81; or the difference of subtracting the amplitude average of the spectral coefficients that are located within the subband n and that is of the current audio frame from the amplitude average of the spectral coefficients that are located within the subband m and that is of the current audio frame is less than or equal to a threshold T82, and the envelope deviation of the spectral coefficients that are located within the subband w and that is of the current audio frame is less than or equal to a threshold T83.

With reference to the first possible implementation manner of the second aspect, the second possible implementation manner of the second aspect, the third possible implementation manner of the second aspect, or the fourth possible implementation manner of the second aspect, in a fifth possible implementation manner of the second aspect, the second parameter condition includes at least one of the following conditions:

the coding rate of the current audio frame is greater than or equal to the threshold T1;

the peak-to-average ratio of the spectral coefficients that are located within the subband z and that is of the current audio frame is greater than the threshold T2;

the envelope deviation of the spectral coefficients that are located within the subband w and that is of the current audio frame is greater than the threshold T3;

the quotient of dividing the energy average of the spectral coefficients that are located within the subband i and that is of the current audio frame by the energy average of the spectral coefficients that are located within the subband j and that is of the current audio frame is less than the threshold T4;

the difference of subtracting the energy average of the spectral coefficients that are located within the subband j and that is of the current audio frame from the energy average of the spectral coefficients that are located within the subband i and that is of the current audio frame is less than the threshold T5;

the quotient of dividing the amplitude average of the spectral coefficients that are located within the subband m and that is of the current audio frame by the amplitude average of the spectral coefficients that are located within the subband n and that is of the current audio frame is less than the threshold T6;

the difference of subtracting the amplitude average of the spectral coefficients that are located within the subband n and that is of the current audio frame from the amplitude average of the spectral coefficients that are located within the subband m and that is of the current audio frame is less than the threshold T7;

the ratio of the peak-to-average ratio of the spectral coefficients that are located within the subband x and that is of the current audio frame to the peak-to-average ratio of the spectral coefficients that are located within the subband y and that is of the current audio frame does not fall within the interval R1;

the absolute value of the difference between the peak-to-average ratio of the spectral coefficients that are located within the subband x and that is of the current audio frame and the peak-to-average ratio of the spectral coefficients that are located within the subband y and that is of the current audio frame is greater than the threshold T8;

the ratio of the envelope deviation of the spectral coefficients that are located within the subband r and that is of the current audio frame to the envelope deviation of the spectral coefficients that are located within the subband s and that is of the current audio frame does not fall within the interval R2;

the absolute value of the difference between the envelope deviation of the spectral coefficients that are located within the subband r and that is of the current audio frame and the envelope deviation of the spectral coefficients that are located within the subband s and that is of the current audio frame is greater than the threshold T9;

the ratio of the envelope of the spectral coefficients that are located within the subband e and that is of the current audio frame to the envelope of the spectral coefficients that are located within the subband f and that is of the current audio frame does not fall within the interval R3;

the absolute value of the difference between the envelope of the spectral coefficients that are located within the subband e and that is of the current audio frame and the envelope of the spectral coefficients that are located within the subband f and that is of the current audio frame is greater than the threshold T10; or the parameter value of spectral correlation between the spectral coefficients that are located within the subband p and that is of the current audio frame and the spectral coefficients that are located within the subband q and that is of the current audio frame is less than the threshold T11.

With reference to the first possible implementation manner of the second aspect, the second possible implementation manner of the second aspect, the third possible implementation manner of the second aspect, the fourth possible implementation manner of the second aspect, or the fifth possible implementation manner of the second aspect, in a sixth possible implementation manner of the second aspect, the second parameter condition includes one of the following conditions:

the quotient of dividing the peak-to-average ratio of the spectral coefficients that are located within the subband x and that is of the current audio frame by the peak-to-average ratio of the spectral coefficients that are located within the subband y and that is of the current audio frame is less than the threshold T44, and the peak-to-average ratio of the spectral coefficients that are located within the subband y and that is of the current audio frame is greater than the threshold T45;

the quotient of dividing the peak-to-average ratio of the spectral coefficients that are located within the subband x and that is of the current audio frame by the peak-to-average ratio of the spectral coefficients that are located within the subband y and that is of the current audio frame is greater than the threshold T46, and the peak-to-average ratio of the spectral coefficients that are located within the subband y and that is of the current audio frame is less than the threshold T47;

the difference of subtracting the peak-to-average ratio of the spectral coefficients that are located within the subband y and that is of the current audio frame from the peak-to-average ratio of the spectral coefficients that are located within the subband x and that is of the current audio frame is less than the threshold T48, and the peak-to-average ratio of the spectral coefficients that are located within the subband y and that is of the current audio frame is greater than the threshold T49;

the difference of subtracting the peak-to-average ratio of the spectral coefficients that are located within the subband y and that is of the current audio frame from the peak-to-average ratio of the spectral coefficients that are located within the subband x and that is of the current audio frame is greater than the threshold T50, and the peak-to-average ratio of the spectral coefficients that are located within the subband y and that is of the current audio frame is less than the threshold T51;

the quotient of dividing the envelope deviation of the spectral coefficients that are located within the subband r and that is of the current audio frame by the envelope deviation of the spectral coefficients that are located within the subband s and that is of the current audio frame is less than the threshold T52, and the envelope deviation of the spectral coefficients that are located within the subband s and that is of the current audio frame is greater than the threshold T53;

the quotient of dividing the envelope deviation of the spectral coefficients that are located within the subband r and that is of the current audio frame by the envelope deviation of the spectral coefficients that are located within the subband s and that is of the current audio frame is greater than the threshold T54, and the envelope deviation of the spectral coefficients that are located within the subband s and that is of the current audio frame is less than the threshold T55;

the difference of subtracting the envelope deviation of the spectral coefficients that are located within the subband s and that is of the current audio frame from the envelope deviation of the spectral coefficients that are located within the subband r and that is of the current audio frame is less than the threshold T56, and the envelope deviation of the spectral coefficients that are located within the subband s and that is of the current audio frame is greater than the threshold T57;

the difference of subtracting the envelope deviation of the spectral coefficients that are located within the subband s and that is of the current audio frame from the envelope deviation of the spectral coefficients that are located within the subband r and that is of the current audio frame is greater than the threshold T58, and the envelope deviation of the spectral coefficients that are located within the subband s and that is of the current audio frame is less than the threshold T59;

the quotient of dividing the envelope of the spectral coefficients that are located within the subband e and that is of the current audio frame by the envelope of the spectral coefficients that are located within the subband f and that is of the current audio frame is less than the threshold T60, and the envelope of the spectral coefficients that are located within the subband f and that is of the current audio frame is greater than the threshold T61;

the quotient of dividing the envelope of the spectral coefficients that are located within the subband e and that is of the current audio frame by the envelope of the spectral coefficients that are located within the subband f and that is of the current audio frame is greater than the threshold T62, and the envelope of the spectral coefficients that are located within the subband f and that is of the current audio frame is less than the threshold T63;

the difference of subtracting the envelope of the spectral coefficients that are located within the subband f and that is of the current audio frame from the envelope of the spectral coefficients that are located within the subband e and that is of the current audio frame is less than the threshold T64, and the envelope of the spectral coefficients that are located within the subband f and that is of the current audio frame is greater than the threshold T65;

the difference of subtracting the envelope of the spectral coefficients that are located within the subband f and that is of the current audio frame from the envelope of the spectral coefficients that are located within the subband e and that is of the current audio frame is greater than the threshold T66, and the envelope of the spectral coefficients that are located within the subband f and that is of the current audio frame is less than the threshold T67;

the quotient of dividing the energy average of the spectral coefficients that are located within the subband i and that is of the current audio frame by the energy average of the spectral coefficients that are located within the subband j and that is of the current audio frame is less than or equal to the threshold T68, and the peak-to-average ratio of the spectral coefficients that are located within the subband z and that is of the current audio frame is greater than the threshold T69;

the difference of subtracting the energy average of the spectral coefficients that are located within the subband j and that is of the current audio frame from the energy average of the spectral coefficients that are located within the subband i and that is of the current audio frame is less than or equal to the threshold T70, and the peak-to-average ratio of the spectral coefficients that are located within the subband z and that is of the current audio frame is greater than the threshold T71;

the quotient of dividing the amplitude average of the spectral coefficients that are located within the subband m and that is of the current audio frame by the amplitude average of the spectral coefficients that are located within the subband n and that is of the current audio frame is less than or equal to the threshold T72, and the peak-to-average ratio of the spectral coefficients that are located within the subband z and that is of the current audio frame is greater than the threshold T73;

the difference of subtracting the amplitude average of the spectral coefficients that are located within the subband n and that is of the current audio frame from the amplitude average of the spectral coefficients that are located within the subband m and that is of the current audio frame is less than or equal to the threshold T74, and the peak-to-average ratio of the spectral coefficients that are located within the subband z and that is of the current audio frame is greater than the threshold T75;

the quotient of dividing the energy average of the spectral coefficients that are located within the subband i and that is of the current audio frame by the energy average of the spectral coefficients that are located within the subband j and that is of the current audio frame is less than or equal to the threshold T76, and the envelope deviation of the spectral coefficients that are located within the subband w and that is of the current audio frame is greater than the threshold T77;

the difference of subtracting the energy average of the spectral coefficients that are located within the subband j and that is of the current audio frame from the energy average of the spectral coefficients that are located within the subband i and that is of the current audio frame is less than or equal to the threshold T78, and the envelope deviation of the spectral coefficients that are located within the subband w and that is of the current audio frame is greater than the threshold T79;

the quotient of dividing the amplitude average of the spectral coefficients that are located within the subband m and that is of the current audio frame by the amplitude average of the spectral coefficients that are located within the subband n and that is of the current audio frame is less than or equal to the threshold T80, and the envelope deviation of the spectral coefficients that are located within the subband w and that is of the current audio frame is greater than the threshold T81; or the difference of subtracting the amplitude average of the spectral coefficients that are located within the subband n and that is of the current audio frame from the amplitude average of the spectral coefficients that are located within the subband m and that is of the current audio frame is less than or equal to the threshold T82, and the envelope deviation of the spectral coefficients that are located within the subband w and that is of the current audio frame is greater than the threshold T83.

With reference to the third possible implementation manner of the second aspect, the fourth possible implementation manner of the second aspect, the fifth possible implementation manner of the second aspect, or the sixth possible implementation manner of the second aspect, in a seventh possible implementation manner of the second aspect, at least one of the following conditions is satisfied:

the threshold T2 is greater than or equal to 2;

the threshold T4 is less than or equal to 1/1.2;

the interval R1 is [1/2.25, 2.25];

the threshold T44 is less than or equal to 1/2.56;

the threshold T45 is greater than or equal to 1.5;

the threshold T46 is greater than or equal to 1/2.56;

the threshold T47 is less than or equal to 1.5;

the threshold T68 is less than or equal to 1.25; or the threshold T69 is greater than or equal to 2.

As can be seen, in technical solutions in some embodiments of the present disclosure, after a reference coding parameter of a current audio frame is acquired, a TCX algorithm or an HQ algorithm is selected based on the acquired reference coding parameter of the current audio frame, to code spectral coefficients of the current audio frame. The reference coding parameter of the current audio frame is associated with a coding algorithm used to code the spectral coefficients of the current audio frame, which helps improve adaptability and matchability between the coding algorithm and the reference coding parameter of the current audio frame, and further helps improve coding quality or coding efficiency of the current audio frame.

BRIEF DESCRIPTION OF DRAWINGS

To describe the technical solutions in the embodiments of the present disclosure more clearly, the following briefly introduces the accompanying drawings used in describing the embodiments.

DESCRIPTION OF EMBODIMENTS

Embodiments of the present disclosure provide an audio coding method and a related apparatus, aimed to improve coding quality or coding efficiency of audio frame coding.

In the specification, claims, and accompanying drawings of the present disclosure, the terms "first", "second", "third", "fourth", and so on are intended to distinguish between different objects but are not intended to describe a specific order. In addition, terms "include" and "have" and any variation thereof are intended to cover non-exclusive including. For example, a process, a method, a system, a product, or a device that includes a series of steps or units is not limited to the listed steps or units, but optionally further includes an unlisted step or unit, or optionally further includes another inherent step or unit of the process, the method, the product, or the device.

The following first introduces the audio coding method provided in the embodiments of the present disclosure. The audio coding method provided in the embodiments of the present disclosure may be executed by an audio coder. The audio coder may be any apparatus that needs to collect, store, or transmit an audio signal, for example, a mobile phone, a tablet computer, a personal computer, or a notebook computer.

In one embodiment of the audio coding method in the present disclosure, the audio coding method includes: performing time-frequency transformation on a time-domain signal of a current audio frame, to obtain spectral coefficients of the current audio frame; acquiring a reference coding parameter of the current audio frame; and if the acquired reference coding parameter of the current audio frame satisfies a first parameter condition, coding the spectral coefficients of the current audio frame based on a transform coded excitation (TCX) algorithm, or if the acquired reference coding parameter of the current audio frame satisfies a second parameter condition, coding the spectral coefficients of the current audio frame based on a high quality transform coding (HQ) algorithm.

Figure 1:
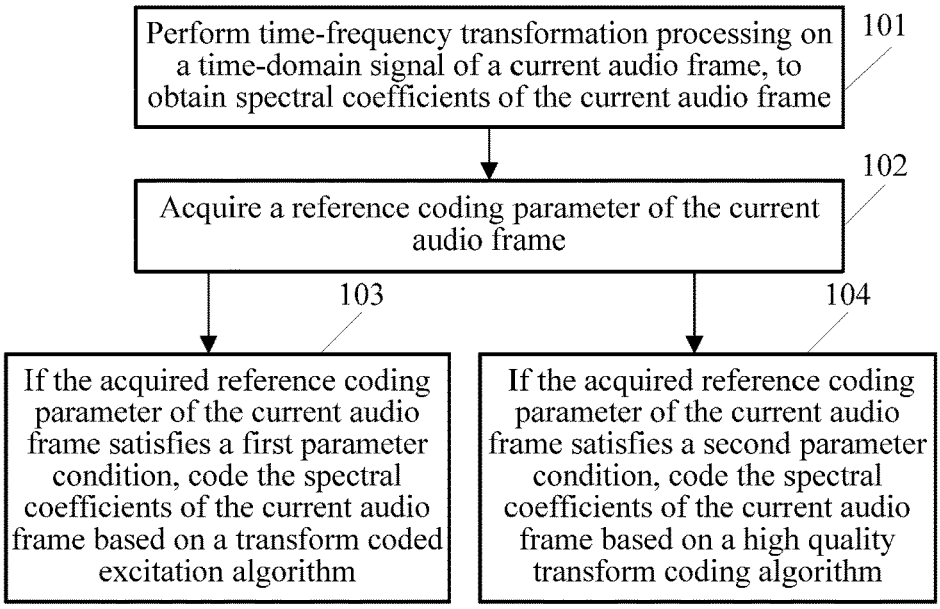
FIG. 1 to FIG. 8 are flowcharts of several audio encoding methods according to embodiments of the present disclosure.

FIG. 1 is a flowchart of an audio coding method according to an embodiment of the present disclosure. As shown in FIG. 1, the audio coding method provided in this embodiment of the present disclosure may include the following contents:

101: Perform time-frequency transformation on a time-domain signal of a current audio frame, to obtain spectral coefficients of the current audio frame.

The audio frame mentioned in the embodiments of the present disclosure may be a speech frame or a music frame.

102: Acquire a reference coding parameter of the current audio frame.

103: If the acquired reference coding parameter of the current audio frame satisfies a first parameter condition, code the spectral coefficients of the current audio frame based on a transform coded excitation (TCX) coding algorithm.

104: If the acquired reference coding parameter of the current audio frame satisfies a second parameter condition, code the spectral coefficients of the current audio frame based on a high quality transform coding (HQ) algorithm.

As can be seen, in solutions of this embodiment, after a reference coding parameter of a current audio frame is acquired, a TCX algorithm or an HQ algorithm is selected based on the acquired reference coding parameter of the current audio frame, to code spectral coefficients of the current audio frame. The reference coding parameter of the current audio frame is associated with a coding algorithm used to code the spectral coefficients of the current audio frame, which helps improve adaptability and matchability between the coding algorithm and the reference coding parameter of the current audio frame, and further helps improve coding quality or coding efficiency of the current audio frame.

In the TCX algorithm, stripping processing is usually performed on a time-domain signal of the current audio frame. For example, a quadrature mirror filter is used to perform stripping processing on the time-domain signal of the current audio frame. In the HQ algorithm, stripping processing is not performed on the time-domain signal of the current audio frame.

Depending on application scenarios, the reference coding parameter of the current audio frame, acquired in step 102, may be varied.

For example, the reference coding parameter of the current audio frame may include at least one of the following parameters:

coding rate of the current audio frame;

peak-to-average ratio of spectral coefficients that are located within a subband z;

envelope deviation of spectral coefficients that are located within a subband w;

energy average of spectral coefficients that are located within a subband i and energy average of spectral coefficients that are located within a subband j;

amplitude average of spectral coefficients that are located within a subband m and amplitude average of spectral coefficients that are located within a subband n;

peak-to-average ratio of spectral coefficients that are located within a subband x and peak-to-average ratio of spectral coefficients that are located within a subband y;

envelope deviation of spectral coefficients that are located within a subband r and envelope deviation of spectral coefficients that are located within a subband s;

envelope of spectral coefficients that are located within a subband e and envelope of spectral coefficients that are located within a subband f; or parameter value of spectral correlation between spectral coefficients that are located within a subband p and spectral coefficients that are located within a subband q.

For the current audio frame, a larger parameter value of spectral correlation between the spectral coefficients that are located within the subband p and the spectral coefficients that are located within the subband q indicates a stronger spectral correlation between the spectral coefficients located within the subband p and the spectral coefficients located within the subband q. The parameter value of the spectral correlation may be, for example, a normalized cross correlation parameter value.

Ranges of frequency bins of the above subbands may be determined according to actual needs.

Optionally, in some possible implementation manners of the present disclosure, a highest frequency bin of the subband z may be greater than a critical frequency bin F1, and a highest frequency bin of the subband w may be greater than the critical frequency bin F1. A value range of the critical frequency bin F1 may be, for example, 6.4 kHz to 12 kHz. For example, a value of the critical frequency bin F1 may be 6.4 kHz, 8 kHz, 9 kHz, 10 kHz, or 12 kHz. Certainly, the critical frequency bin F1 may be another value.

Optionally, in some possible implementation manners of the present disclosure, a highest frequency bin of the subband j may be greater than a critical frequency bin F2, and a highest frequency bin of the subband n is greater than the critical frequency bin F2. For example, a value range of the critical frequency bin F2 may be 4.8 kHz to 8 kHz. Specifically, for example, a value of the critical frequency bin F2 may be 6.4 kHz, 4.8 kHz, 6 kHz, 8 kHz, 5 kHz, or 7 kHz. Certainly, the critical frequency bin F2 may be another value.

Optionally, in some possible implementation manners of the present disclosure, a highest frequency bin of the subband i may be less than the highest frequency bin of the subband j. A highest frequency bin of the subband m may be less than the highest frequency bin of the subband n. A highest frequency bin of the subband x may be less than or equal to a lowest frequency bin of the subband y. A highest frequency bin of the subband p may be less than or equal to a lowest frequency bin of the subband q. A highest frequency bin of the subband r may be less than or equal to a lowest frequency bin of the subband s. A highest frequency bin of the subband e may be less than or equal to a lowest frequency bin of the subband f.

Optionally, in some possible implementation manners of the present disclosure, at least one of the following conditions may be satisfied:

a lowest frequency bin of the subband w is greater than or equal to the critical frequency bin F1;

a lowest frequency bin of the subband z is greater than or equal to the critical frequency bin F1;

a highest frequency bin of the subband i is less than or equal to a lowest frequency bin of the subband j;

a highest frequency bin of the subband m is less than or equal to a lowest frequency bin of the subband n;

a lowest frequency bin of the subband j is greater than or equal to the critical frequency bin F2;

a lowest frequency bin of the subband n is greater than or equal to the critical frequency bin F2;

the highest frequency bin of the subband i is less than or equal to the critical frequency bin F2;

the highest frequency bin of the subband m is less than or equal to the critical frequency bin F2;

a lowest frequency bin of the subband j is greater than or equal to the critical frequency bin F2; or a lowest frequency bin of the subband n is greater than or equal to the critical frequency bin F2.

Optionally, in some possible implementation manners of the present disclosure, at least one of the following conditions may be satisfied:

the highest frequency bin of the subband e is less than or equal to the critical frequency bin F2;

the highest frequency bin of the subband x is less than or equal to the critical frequency bin F2;

the highest frequency bin of the subband p is less than or equal to the critical frequency bin F2; or the highest frequency bin of the subband r is less than or equal to the critical frequency bin F2.

Optionally, in some possible implementation manners of the present disclosure, the highest frequency bin of the subband f may be less than or equal to the critical frequency bin F2, and certainly, the lowest frequency bin of the subband f may be greater than or equal to the critical frequency bin F2. The highest frequency bin of the subband q may be less than or equal to the critical frequency bin F2, and certainly, the lowest frequency bin of the subband q may be greater than or equal to the critical frequency bin F2. The highest frequency bin of the subband s may be less than or equal to the critical frequency bin F2, and certainly, the lowest frequency bin of the subband s may be greater than or equal to the critical frequency bin F2.

For example, a value range of the highest frequency bin of the subband z may be 12 kHz to 16 kHz. A value range of the lowest frequency bin of the subband z may be 8 kHz to 14 kHz. A value range of a bandwidth of the subband z may be 1.6 kHz to 8 kHz. Specifically, for example, a range of frequency bins of the subband z may be 8 kHz to 12 kHz, 9 kHz to 11 kHz, 8 kHz to 9.6 kHz, or 12 kHz to 14 kHz. Certainly, the range of frequency bins of the subband z is not limited to the foregoing examples.

For example, a range of frequency bins of the subband w may be determined according to actual needs. For example, a value range of the highest frequency bin of the subband w may be 12 kHz to 16 kHz, and a value range of the lowest frequency bin of the subband w may be 8 kHz to 14 kHz. Specifically, for example, the range of frequency bins of the subband w is 8 kHz to 12 kHz, 9 kHz to 11 kHz, 8 kHz to 9.6 kHz, 12 kHz to 14 kHz, or 12.2 kHz to 14.5 kHz. Certainly, the range of frequency bins of the subband w is not limited to the foregoing examples. In some possible implementation manners, the range of frequency bins of the subband w may be the same as or similar to the range of frequency bins of the subband z.

For example, a range of frequency bins of the subband i may be 3.2 kHz to 6.4 kHz, 3.2 kHz to 4.8 kHz, 4.8 kHz to 6.4 kHz, 0.4 kHz to 6.4 kHz, or 0.4 kHz to 3.6 kHz. Certainly, the range of frequency bins of the subband i is not limited to the foregoing examples.

For example, a range of frequency bins of the subband j may be 6.4 kHz to 9.6 kHz, 6.4 kHz to 8 kHz, 8 kHz to 9.6 kHz, 4.8 kHz to 9.6 kHz, or 4.8 kHz to 8 kHz. Certainly, the range of frequency bins of the subband j is not limited to the foregoing examples.

For example, a range of frequency bins of the subband m may be 3.2 kHz to 6.4 kHz, 3.2 kHz to 4.8 kHz, 4.8 kHz to 6.4 kHz, 0.4 kHz to 6.4 kHz, or 0.4 kHz to 3.6 kHz. Certainly, the range of frequency bins of the subband m is not limited to the foregoing examples. In some possible implementation manners, the range of frequency bins of the subband m may be the same as or similar to the range of frequency bins of the subband i.

For example, a range of frequency bins of the subband n may be 6.4 kHz to 9.6 kHz, 6.4 kHz to 8 kHz, 8 kHz to 9.6 kHz, 4.8 kHz to 9.6 kHz, or 4.8 kHz to 8 kHz. Certainly, the range of frequency bins of the subband n is not limited to the foregoing examples. In some possible implementation manners, the range of frequency bins of the subband n may be the same as or similar to the range of frequency bins of the subband j.

For example, a range of frequency bins of the subband x may be 0 kHz to 1.6 kHz, 1 kHz to 2.6 kHz, 1.6 kHz to 3.2 kHz, 2 kHz to 3.2 kHz, or 2.5 kHz to 3.4 kHz. Certainly, the range of frequency bins of the subband x is not limited to the foregoing examples.

For example, a range of frequency bins of the subband y may be 6.4 kHz to 8 kHz, 7.4 kHz to 9 kHz, 4.8 kHz to 6.4 kHz, 4.4 kHz to 6.4 kHz, or 4.5 kHz to 6.2 kHz. Certainly, the range of frequency bins of the subband y is not limited to the foregoing examples.

For example, a range of frequency bins of the subband p may be 0 kHz to 1.6 kHz, 1 kHz to 2.6 kHz, 1.6 kHz to 3.2 kHz, 2.1 kHz to 3.2 kHz, or 2.5 kHz to 3.5 kHz. Certainly, the range of frequency bins of the subband p is not limited to the foregoing examples. In some possible implementation manners, the range of frequency bins of the subband p may be the same as or similar to the range of frequency bins of the subband x.

For example, a range of frequency bins of the subband q may be 6.4 kHz to 8 kHz, 7.4 kHz to 9 kHz, 4.8 kHz to 6.4 kHz, 4.2 kHz to 6.4 kHz, or 4.7 kHz to 6.2 kHz. Certainly, the range of frequency bins of the subband q is not limited to the foregoing examples. In some possible implementation manners, the range of frequency bins of the subband q may be the same as or similar to the range of frequency bins of the subband y.

For example, a range of frequency bins of the subband r may be 0 kHz to 1.6 kHz, 1 kHz to 2.6 kHz, 1.6 kHz to 3.2 kHz, 2.05 kHz to 3.27 kHz, or 2.59 kHz to 3.51 kHz. Certainly, the range of frequency bins of the subband r is not limited to the foregoing examples. In some possible implementation manners, the range of frequency bins of the subband r may be the same as or similar to the range of frequency bins of the subband x.

For example, a range of frequency bins of the subband s may be 6.4 kHz to 8 kHz, 7.4 kHz to 9 kHz, 4.8 kHz to 6.4 kHz, 5.4 kHz to 7.1 kHz, or 4.55 kHz to 6.29 kHz. Certainly, the range of frequency bins of the subband s is not limited to the foregoing examples. In some possible implementation manners, the range of frequency bins of the subband s may be the same as or similar to the range of frequency bins of the subband y.

For example, a range of frequency bins of the subband e may be 0 kHz to 1.6 kHz, 1 kHz to 2.6 kHz, 1.6 kHz to 3.2 kHz, 0.8 kHz to 3 kHz, or 1.9 kHz to 3.8 kHz. Certainly, the range of frequency bins of the subband e is not limited to the foregoing examples. In some possible implementation manners, the range of frequency bins of the subband e may be the same as or similar to the range of frequency bins of the subband x.

For example, a range of frequency bins of the subband f may be 6.4 kHz to 8 kHz, 7.4 kHz to 9 kHz, 4.8 kHz to 6.4 kHz, 5.3 kHz to 7.15 kHz, or 4.58 kHz to 6.52 kHz. Certainly, the range of frequency bins of the subband f is not limited to the foregoing examples. In some possible implementation manners, the range of frequency bins of the subband f may be the same as or similar to the range of frequency bins of the subband y.

The first parameter condition may be varied.

For example, in some possible implementation manners of the present disclosure, the first parameter condition, for example, may include at least one of the following conditions:

the coding rate of the current audio frame is less than a threshold T1 (the threshold T1 may be, for example, greater than or equal to 24.4 kbps, 32 kbps, 64 kbps, or another rate);

the peak-to-average ratio of the spectral coefficients of the current audio frame that are located within the subband z is less than or equal to a threshold T2 (the threshold T2 may be, for example, greater than or equal to 1, 2, 3, 5, or another value);

the envelope deviation of the spectral coefficients of the current audio frame that are located within the subband w is less than or equal to a threshold T3 (the threshold T3 may be, for example, greater than or equal to 10, 20, 35, or another value);

a quotient of dividing the energy average of the spectral coefficients of the current audio frame that are located within the subband i by the energy average of the spectral coefficients of the current audio frame that are located within the subband j is greater than or equal to a threshold T4 (the threshold T4 may be, for example, greater than or equal to 0.5, 1, 2, 3, or another value);

a difference of subtracting the energy average of the spectral coefficients of the current audio frame that are located within the subband j from the energy average of the spectral coefficients of the current audio frame that are located within the subband i is greater than or equal to a threshold T5 (the threshold T5 may be, for example, greater than or equal to 10, 20, 51, 100, or another value);

a quotient of dividing the amplitude average of the spectral coefficients of the current audio frame that are located within the subband m by the amplitude average of the spectral coefficients of the current audio frame that are located within the subband n is greater than or equal to a threshold T6 (the threshold T6 may be, for example, greater than or equal to 0.5, 1.1, 2, 3, or another value);

a difference of subtracting the amplitude average of the spectral coefficients of the current audio frame that are located within the subband n from the amplitude average of the spectral coefficients of the current audio frame that are located within the subband m is greater than or equal to a threshold T7 (the threshold T7 may be, for example, greater than or equal to 11, 20, 50, 101, or another value);

a ratio of the peak-to-average ratio of the spectral coefficients of the current audio frame that are located within the subband x to the peak-to-average ratio of the spectral coefficients of the current audio frame that are located within the subband y falls within an interval R1 (the interval R1 may be, for example, [0.5, 2], [0.4, 2.5], or another value);

an absolute value of a difference between the peak-to-average ratio of the spectral coefficients of the current audio frame that are located within the subband x and the peak-to-average ratio of the spectral coefficients of the current audio frame that are located within the subband y is less than or equal to a threshold T8 (the threshold T8 may be, for example, greater than or equal to 1, 2, 3, or another value);

a ratio of the envelope deviation of the spectral coefficients of the current audio frame that are located within the subband r to the envelope deviation of the spectral coefficients of the current audio frame that are located within the subband s falls within an interval R2 (the interval R2 may be, for example, [0.5, 2], [0.4, 2.5], or another value);

an absolute value of a difference between the envelope deviation of the spectral coefficients of the current audio frame that are located within the subband r and the envelope deviation of the spectral coefficients of the current audio frame that are located within the subband s is less than or equal to a threshold T9 (the threshold T9 may be, for example, greater than or equal to 10, 20, 35, or another value);

a ratio of the envelope of the spectral coefficients of the current audio frame that are located within the subband e to the envelope of the spectral coefficients of the current audio frame that are located within the subband f falls within an interval R3 (the interval R3 may be, for example, [0.5, 2], [0.4, 2.5], or another value);

an absolute value of a difference between the envelope of the spectral coefficients of the current audio frame that are located within the subband e and the envelope of the spectral coefficients of the current audio frame that are located within the subband f is less than or equal to a threshold T10 (the threshold T10 may be, for example, greater than or equal to 11, 20, 50, 101, or another value); or the parameter value of spectral correlation between the spectral coefficients of the current audio frame that are located within the subband p and the spectral coefficients of the current audio frame that are located within the subband q is greater than or equal to a threshold T11 (the threshold T11 may be, for example, 0.5, 0.8, 0.9, 1, or another value).

For another example, in some possible implementation manners of the present disclosure, the first parameter condition, for example, may include one of the following conditions:

the coding rate of the current audio frame is greater than or equal to the threshold T1, and the quotient of dividing the energy average of the spectral coefficients that are located within the subband i and that is of the current audio frame by the energy average of the spectral coefficients that are located within the subband j and that is of the current audio frame is greater than or equal to a threshold T12 (the threshold T12 may be, for example, greater than or equal to the threshold T4, and the threshold T12 may be, for example, greater than or equal to 2, 3, 5, 8, or another value);

the coding rate of the current audio frame is greater than or equal to the threshold T1, and the quotient of dividing the amplitude average of the spectral coefficients that are located within the subband m and that is of the current audio frame by the amplitude average of the spectral coefficients that are located within the subband n and that is of the current audio frame is greater than or equal to a threshold T13 (the threshold T13 may be, for example, greater than or equal to the threshold T6, and the threshold T13 may be, for example, greater than or equal to 2, 3, 9, 7, or another value);

the coding rate of the current audio frame is greater than or equal to the threshold T1, and the peak-to-average ratio of the spectral coefficients that are located within the subband z and that is of the current audio frame is less than or equal to a threshold T14 (the threshold T14 may be, for example, less than or equal to the threshold T2, and the threshold T14 may be, for example, less than or equal to 0.5, 2, 3, 1.5, 4, or another value);

the coding rate of the current audio frame is greater than or equal to the threshold T1, and the envelope deviation of the spectral coefficients that are located within the subband w and that is of the current audio frame is less than or equal to a threshold T15 (the threshold T15 may be, for example, less than or equal to the threshold T3, and the threshold T15 may be, for example, less than or equal to 5, 8, 10, 20, or another value);

the ratio of the peak-to-average ratio of the spectral coefficients that are located within the subband x and that is of the current audio frame to the peak-to-average ratio of the spectral coefficients that are located within the subband y and that is of the current audio frame does not fall within the interval R1, and the quotient of dividing the energy average of the spectral coefficients that are located within the subband i and that is of the current audio frame by the energy average of the spectral coefficients that are located within the subband j and that is of the current audio frame is greater than or equal to a threshold T16 (the threshold T16 may be, for example, greater than or equal to the threshold T4, and the threshold T16 may be, for example, greater than or equal to 2, 3, 5, 8, or another value);

the ratio of the peak-to-average ratio of the spectral coefficients that are located within the subband x and that is of the current audio frame to the peak-to-average ratio of the spectral coefficients that are located within the subband y and that is of the current audio frame does not fall within the interval R1, and the quotient of dividing the amplitude average of the spectral coefficients that are located within the subband m and that is of the current audio frame by the amplitude average of the spectral coefficients that are located within the subband n and that is of the current audio frame is greater than or equal to a threshold T17 (the threshold T17 may be, for example, greater than or equal to the threshold T6, and the threshold T17 may be, for example, greater than or equal to 2, 3, 9, 7, or another value);

the ratio of the peak-to-average ratio of the spectral coefficients that are located within the subband x and that is of the current audio frame to the peak-to-average ratio of the spectral coefficients that are located within the subband y and that is of the current audio frame does not fall within the interval R1, and the peak-to-average ratio of the spectral coefficients that are located within the subband z and that is of the current audio frame is less than or equal to a threshold T18 (the threshold T18 may be, for example, less than or equal to the threshold T2, and the threshold T18 may be, for example, less than or equal to 0.5, 2, 3, 1.5, 4, 5, or another value);

the ratio of the peak-to-average ratio of the spectral coefficients that are located within the subband x and that is of the current audio frame to the peak-to-average ratio of the spectral coefficients that are located within the subband y and that is of the current audio frame does not fall within the interval R1, and the envelope deviation of the spectral coefficients that are located within the subband w and that is of the current audio frame is less than or equal to a threshold T19 (the threshold T19 may be, for example, less than or equal to the threshold T3, and the threshold T19 may be, for example, less than or equal to 5, 8, 10, 20, or another value);

the absolute value of the difference between the peak-to-average ratio of the spectral coefficients that are located within the subband x and that is of the current audio frame and the peak-to-average ratio of the spectral coefficients that are located within the subband y and that is of the current audio frame is greater than the threshold T8, and the quotient of dividing the energy average of the spectral coefficients that are located within the subband i and that is of the current audio frame by the energy average of the spectral coefficients that are located within the subband j and that is of the current audio frame is greater than or equal to a threshold T20 (the threshold T20 may be, for example, greater than or equal to the threshold T4, and the threshold T20 may be, for example, greater than or equal to 2, 3, 5, 8, or another value);

the absolute value of the difference between the peak-to-average ratio of the spectral coefficients that are located within the subband x and that is of the current audio frame and the peak-to-average ratio of the spectral coefficients that are located within the subband y and that is of the current audio frame is greater than the threshold T8, and the quotient of dividing the amplitude average of the spectral coefficients that are located within the subband m and that is of the current audio frame by the amplitude average of the spectral coefficients that are located within the subband n and that is of the current audio frame is greater than or equal to a threshold T21 (the threshold T21 may be, for example, greater than or equal to the threshold T6, and the threshold T21 may be, for example, greater than or equal to 2, 3, 9, 7, or another value);

the absolute value of the difference between the peak-to-average ratio of the spectral coefficients that are located within the subband x and that is of the current audio frame and the peak-to-average ratio of the spectral coefficients that are located within the subband y and that is of the current audio frame is greater than the threshold T8, and the peak-to-average ratio of the spectral coefficients that are located within the subband z and that is of the current audio frame is less than or equal to a threshold T22 (the threshold T22 may be, for example, less than or equal to the threshold T2, and the threshold T22 may be, for example, less than or equal to 0.5, 2, 3, 1.5, 4, 5, or another value);

the absolute value of the difference between the peak-to-average ratio of the spectral coefficients that are located within the subband x and that is of the current audio frame and the peak-to-average ratio of the spectral coefficients that are located within the subband y and that is of the current audio frame is greater than the threshold T8, and the envelope deviation of the spectral coefficients that are located within the subband w and that is of the current audio frame is less than or equal to a threshold T23 (the threshold T23 may be, for example, less than or equal to the threshold T3, and the threshold T23 may be, for example, less than or equal to 5, 8, 10, 20, or another value);

the ratio of the envelope deviation of the spectral coefficients that are located within the subband r and that is of the current audio frame to the envelope deviation of the spectral coefficients that are located within the subband s and that is of the current audio frame does not fall within the interval R2, and the quotient of dividing the energy average of the spectral coefficients that are located within the subband i and that is of the current audio frame by the energy average of the spectral coefficients that are located within the subband j and that is of the current audio frame is greater than or equal to a threshold T24 (the threshold T24 may be, for example, greater than or equal to the threshold T4, and the threshold T24 may be, for example, greater than or equal to 2, 3, 5, 8, or another value);

the ratio of the envelope deviation of the spectral coefficients that are located within the subband r and that is of the current audio frame to the envelope deviation of the spectral coefficients that are located within the subband s and that is of the current audio frame does not fall within the interval R2, and the quotient of dividing the amplitude average of the spectral coefficients that are located within the subband m and that is of the current audio frame by the amplitude average of the spectral coefficients that are located within the subband n and that is of the current audio frame is greater than or equal to a threshold T25 (the threshold T25 may be, for example, greater than or equal to the threshold T6, and the threshold T25 may be, for example, greater than or equal to 2, 3, 9, 7, or another value);

the ratio of the envelope deviation of the spectral coefficients that are located within the subband r and that is of the current audio frame to the envelope deviation of the spectral coefficients that are located within the subband s and that is of the current audio frame does not fall within the interval R2, and the peak-to-average ratio of the spectral coefficients that are located within the subband z and that is of the current audio frame is less than or equal to a threshold T26 (the threshold T26 may be, for example, less than or equal to the threshold T2, and the threshold T26 may be, for example, less than or equal to 0.5, 2, 3, 1.5, 4, 5, or another value);

the ratio of the envelope deviation of the spectral coefficients that are located within the subband r and that is of the current audio frame to the envelope deviation of the spectral coefficients that are located within the subband s and that is of the current audio frame does not fall within the interval R2, and the envelope deviation of the spectral coefficients that are located within the subband w and that is of the current audio frame is less than or equal to a threshold T27 (the threshold T27 may be, for example, less than or equal to the threshold T3, and the threshold T27 may be, for example, less than or equal to 5, 8, 10, 20, or another value);

the absolute value of the difference between the envelope deviation of the spectral coefficients that are located within the subband r and that is of the current audio frame and the envelope deviation of the spectral coefficients that are located within the subband s and that is of the current audio frame is greater than the threshold T9, and the quotient of dividing the energy average of the spectral coefficients that are located within the subband i and that is of the current audio frame by the energy average of the spectral coefficients that are located within the subband j and that is of the current audio frame is greater than or equal to a threshold T28 (the threshold T28 may be, for example, greater than or equal to the threshold T4, and the threshold T28 may be, for example, greater than or equal to 2, 3, 5, 8, or another value);

the absolute value of the difference between the envelope deviation of the spectral coefficients that are located within the subband r and that is of the current audio frame and the envelope deviation of the spectral coefficients that are located within the subband s and that is of the current audio frame is greater than the threshold T9, and the quotient of dividing the amplitude average of the spectral coefficients that are located within the subband m and that is of the current audio frame by the amplitude average of the spectral coefficients that are located within the subband n and that is of the current audio frame is greater than or equal to a threshold T29 (the threshold T29 may be, for example, greater than or equal to the threshold T6, and the threshold T29 may be, for example, greater than or equal to 2, 3, 9, 7, or another value);

the absolute value of the difference between the envelope deviation of the spectral coefficients that are located within the subband r and that is of the current audio frame and the envelope deviation of the spectral coefficients that are located within the subband s and that is of the current audio frame is greater than the threshold T9, and the peak-to-average ratio of the spectral coefficients that are located within the subband z and that is of the current audio frame is less than or equal to a threshold T30 (the threshold T30 may be, for example, less than or equal to the threshold T2, and the threshold T30 may be, for example, less than or equal to 0.5, 2, 3, 1.5, 4, 5, or another value);

the absolute value of the difference between the envelope deviation of the spectral coefficients that are located within the subband r and that is of the current audio frame and the envelope deviation of the spectral coefficients that are located within the subband s and that is of the current audio frame is greater than the threshold T9, and the envelope deviation of the spectral coefficients that are located within the subband w and that is of the current audio frame is less than or equal to a threshold T31 (the threshold T31 may be, for example, less than or equal to the threshold T3, and the threshold T31 may be, for example, less than or equal to 5, 8, 10, 20, or another value);

the ratio of the envelope of the spectral coefficients that are located within the subband e and that is of the current audio frame to the envelope of the spectral coefficients that are located within the subband f and that is of the current audio frame falls within the interval R3, and the quotient of dividing the energy average of the spectral coefficients that are located within the subband i and that is of the current audio frame by the energy average of the spectral coefficients that are located within the subband j and that is of the current audio frame is greater than or equal to a threshold T32 (the threshold T32 may be, for example, greater than or equal to the threshold T4, and the threshold T32 may be, for example, greater than or equal to 2, 3, 5, 8, or another value);

the ratio of the envelope of the spectral coefficients that are located within the subband e and that is of the current audio frame to the envelope of the spectral coefficients that are located within the subband f and that is of the current audio frame falls within the interval R3, and the quotient of dividing the amplitude average of the spectral coefficients that are located within the subband m and that is of the current audio frame by the amplitude average of the spectral coefficients that are located within the subband n and that is of the current audio frame is greater than or equal to a threshold T33 (the threshold T33 may be, for example, greater than or equal to the threshold T6, and the threshold T33 may be, for example, greater than or equal to 2, 3, 9, 7, or another value);

the ratio of the envelope of the spectral coefficients that are located within the subband e and that is of the current audio frame to the envelope of the spectral coefficients that are located within the subband f and that is of the current audio frame falls within the interval R3, and the peak-to-average ratio of the spectral coefficients that are located within the subband z and that is of the current audio frame is less than or equal to a threshold T34 (the threshold T34 may be, for example, less than or equal to the threshold T2, and the threshold T34 may be, for example, less than or equal to 0.5, 2, 3, 1.5, 4, 5, or another value);

the ratio of the envelope of the spectral coefficients that are located within the subband e and that is of the current audio frame to the envelope of the spectral coefficients that are located within the subband f and that is of the current audio frame falls within the interval R3, and the envelope deviation of the spectral coefficients that are located within the subband w and that is of the current audio frame is less than or equal to a threshold T35 (the threshold T35 may be, for example, less than or equal to the threshold T3, and the threshold T35 may be, for example, less than or equal to 5, 8, 9.5, 10, 15, 20, or another value);

the absolute value of the difference between of the envelope of the spectral coefficients that are located within the subband e and that is of the current audio frame and the envelope of the spectral coefficients that are located within the subband f and that is of the current audio frame is greater than the threshold T10, and the quotient of dividing the energy average of the spectral coefficients that are located within the subband i and that is of the current audio frame by the energy average of the spectral coefficients that are located within the subband j and that is of the current audio frame is greater than or equal to a threshold T36 (the threshold T36 may be, for example, greater than or equal to the threshold T4, and the threshold T36 may be, for example, greater than or equal to 2, 3, 5, 8, or another value);

the absolute value of the difference between of the envelope of the spectral coefficients that are located within the subband e and that is of the current audio frame and the envelope of the spectral coefficients that are located within the subband f and that is of the current audio frame is greater than the threshold T10, and the quotient of dividing the amplitude average of the spectral coefficients that are located within the subband m and that is of the current audio frame by the amplitude average of the spectral coefficients that are located within the subband n and that is of the current audio frame is greater than or equal to a threshold T37 (the threshold T37 may be, for example, greater than or equal to the threshold T6, and the threshold T37 may be, for example, greater than or equal to 2, 3, 9, 7, or another value);

the absolute value of the difference between of the envelope of the spectral coefficients that are located within the subband e and that is of the current audio frame and the envelope of the spectral coefficients that are located within the subband f and that is of the current audio frame is greater than the threshold T10, and the peak-to-average ratio of the spectral coefficients that are located within the subband z and that is of the current audio frame is less than or equal to a threshold T38 (the threshold T38 may be, for example, less than or equal to the threshold T2, and the threshold T38 may be, for example, less than or equal to 0.5, 2, 3, 1.5, 4, 5, or another value);

the absolute value of the difference between of the envelope of the spectral coefficients that are located within the subband e and that is of the current audio frame and the envelope of the spectral coefficients that are located within the subband f and that is of the current audio frame is greater than the threshold T10, and the envelope deviation of the spectral coefficients that are located within the subband w and that is of the current audio frame is less than or equal to a threshold T39 (the threshold T39 may be, for example, less than or equal to the threshold T3, and the threshold T39 may be, for example, less than or equal to 5, 8, 9.5, 10, 15, 20, or another value);

the parameter value of spectral correlation between the spectral coefficients that are located within the subband p and that is of the current audio frame and the spectral coefficients that are located within the subband q and that is of the current audio frame is less than or equal to the threshold T11, and the quotient of dividing the energy average of the spectral coefficients that are located within the subband i and that is of the current audio frame by the energy average of the spectral coefficients that are located within the subband j and that is of the current audio frame is greater than or equal to a threshold T40 (the threshold T40 may be, for example, greater than or equal to the threshold T4, and the threshold T40 may be, for example, greater than or equal to 2, 3, 5, 8, or another value);

the parameter value of spectral correlation between the spectral coefficients that are located within the subband p and that is of the current audio frame and the spectral coefficients that are located within the subband q and that is of the current audio frame is less than or equal to the threshold T11, and the quotient of dividing the amplitude average of the spectral coefficients that are located within the subband m and that is of the current audio frame by the amplitude average of the spectral coefficients that are located within the subband n and that is of the current audio frame is greater than or equal to a threshold T41 (the threshold T41 may be, for example, greater than or equal to the threshold T6, and the threshold T41 may be, for example, greater than or equal to 2, 3, 9, 7, or another value);

the parameter value of spectral correlation between the spectral coefficients that are located within the subband p and that is of the current audio frame and the spectral coefficients that are located within the subband q and that is of the current audio frame is less than or equal to the threshold T11, and the peak-to-average ratio of the spectral coefficients that are located within the subband z and that is of the current audio frame is less than or equal to a threshold T42 (the threshold T42 may be, for example, less than or equal to the threshold T2, and the threshold T42 may be, for example, less than or equal to 0.5, 2, 3, 1.5, 4, 5, or another value);

the parameter value of spectral correlation between the spectral coefficients that are located within the subband p and that is of the current audio frame and the spectral coefficients that are located within the subband q and that is of the current audio frame is less than or equal to the threshold T11, and the envelope deviation of the spectral coefficients that are located within the subband w and that is of the current audio frame is less than or equal to a threshold T43 (the threshold T43 may be, for example, less than or equal to the threshold T3, and the threshold T43 may be, for example, less than or equal to 5, 8, 9.5, 10, 15, 20, or another value);

a quotient of dividing the peak-to-average ratio of the spectral coefficients that are located within the subband x and that is of the current audio frame by the peak-to-average ratio of the spectral coefficients that are located within the subband y and that is of the current audio frame is less than a threshold T44 (a value range of the threshold T44 may be, for example, 1.5 to 3), and the peak-to-average ratio of the spectral coefficients that are located within the subband y and that is of the current audio frame is less than a threshold T45 (a value range of the threshold T45 may be, for example, 1 to 3);

a quotient of dividing the peak-to-average ratio of the spectral coefficients that are located within the subband x and that is of the current audio frame by the peak-to-average ratio of the spectral coefficients that are located within the subband y and that is of the current audio frame is greater than a threshold T46 (a value range of the threshold T46 may be, for example, 1.5 to 3), and the peak-to-average ratio of the spectral coefficients that are located within the subband y and that is of the current audio frame is greater than a threshold T47 (a value range of the threshold T47 may be, for example, 1 to 3);

a difference of subtracting the peak-to-average ratio of the spectral coefficients that are located within the subband y and that is of the current audio frame from the peak-to-average ratio of the spectral coefficients that are located within the subband x and that is of the current audio frame is less than a threshold T48 (a value range of the threshold T48 may be, for example, −1 to 3), and the peak-to-average ratio of the spectral coefficients that are located within the subband y and that is of the current audio frame is less than a threshold T49 (a value range of the threshold T49 may be, for example, 1 to 3);

a difference of subtracting the peak-to-average ratio of the spectral coefficients that are located within the subband y and that is of the current audio frame from the peak-to-average ratio of the spectral coefficients that are located within the subband x and that is of the current audio frame is greater than a threshold T50 (a value range of the threshold T50 may be, for example, −1 to 3), and the peak-to-average ratio of the spectral coefficients that are located within the subband y and that is of the current audio frame is greater than a threshold T51 (a value range of the threshold T51 may be, for example, 1 to 3);

a quotient of dividing the envelope deviation of the spectral coefficients that are located within the subband r and that is of the current audio frame by the envelope deviation of the spectral coefficients that are located within the subband s and that is of the current audio frame is less than a threshold T52 (a value range of the threshold T52 may be, for example, 1 to 3), and the envelope deviation of the spectral coefficients that are located within the subband s and that is of the current audio frame is less than a threshold T53 (the threshold T53 may be, for example, 10, 20, 30, or another value);

a quotient of dividing the envelope deviation of the spectral coefficients that are located within the subband r and that is of the current audio frame by the envelope deviation of the spectral coefficients that are located within the subband s and that is of the current audio frame is greater than a threshold T54 (a value range of the threshold T54 may be, for example, 1 to 3), and the envelope deviation of the spectral coefficients that are located within the subband s and that is of the current audio frame is greater than a threshold T55 (the threshold T55 may be, for example, 10, 20, 30, or another value);

a difference of subtracting the envelope deviation of the spectral coefficients that are located within the subband s and that is of the current audio frame from the envelope deviation of the spectral coefficients that are located within the subband r and that is of the current audio frame is less than a threshold T56 (a value range of the threshold T56 may be, for example, −40 to 40), and the envelope deviation of the spectral coefficients that are located within the subband s and that is of the current audio frame is less than a threshold T57 (the threshold T57 may be, for example, 10, 20, 30, or another value);

a difference of subtracting the envelope deviation of the spectral coefficients that are located within the subband s and that is of the current audio frame from the envelope deviation of the spectral coefficients that are located within the subband r and that is of the current audio frame is greater than a threshold T58 (a value range of the threshold T58 may be, for example, −40 to 40), and the envelope deviation of the spectral coefficients that are located within the subband s and that is of the current audio frame is greater than a threshold T59 (the threshold T59 may be, for example, 10, 20, 30, or another value);

a quotient of dividing the envelope of the spectral coefficients that are located within the subband e and that is of the current audio frame by the envelope of the spectral coefficients that are located within the subband f and that is of the current audio frame is less than a threshold T60 (a value range of the threshold T60 may be, for example, 1 to 3), and the envelope of the spectral coefficients that are located within the subband f and that is of the current audio frame is less than a threshold T61 (the threshold T61 may be, for example, 10, 20, 30, or another value);

a quotient of dividing the envelope of the spectral coefficients that are located within the subband e and that is of the current audio frame by the envelope of the spectral coefficients that are located within the subband f and that is of the current audio frame is greater than a threshold T62 (a value range of the threshold T62 may be, for example, 1 to 3), and the envelope of the spectral coefficients that are located within the subband f and that is of the current audio frame is greater than a threshold T63 (the threshold T63 may be, for example, 10, 20, 30, or another value);

a difference of subtracting the envelope of the spectral coefficients that are located within the subband f and that is of the current audio frame from the envelope of the spectral coefficients that are located within the subband e and that is of the current audio frame is less than a threshold T64 (a value range of the threshold T64 may be, for example, −40 to 40), and the envelope of the spectral coefficients that are located within the subband f and that is of the current audio frame is less than a threshold T65 (the threshold T65 may be, for example, 10, 20, 30, or another value);

a difference of subtracting the envelope of the spectral coefficients that are located within the subband f and that is of the current audio frame from the envelope of the spectral coefficients that are located within the subband e and that is of the current audio frame is greater than a threshold T66 (a value range of the threshold T66 may be, for example, −40 to 40), and the envelope of the spectral coefficients that are located within the subband f and that is of the current audio frame is greater than a threshold T67 (the threshold T67 may be, for example, 10, 20, 30, or another value);

the quotient of dividing the energy average of the spectral coefficients that are located within the subband i and that is of the current audio frame by the energy average of the spectral coefficients that are located within the subband j and that is of the current audio frame is less than or equal to a threshold T68 (the threshold T68 may be, for example, less than or equal to 0.5, 1, 2, 3, or another value), and the peak-to-average ratio of the spectral coefficients that are located within the subband z and that is of the current audio frame is less than or equal to a threshold T69 (the threshold T69 may be, for example, less than or equal to 1, 2, 3, 5, or another value);

the difference of subtracting the energy average of the spectral coefficients that are located within the subband j and that is of the current audio frame from the energy average of the spectral coefficients that are located within the subband i and that is of the current audio frame is less than or equal to a threshold T70 (the threshold T70 may be, for example, less than or equal to 10, 20, 51, 100, or another value), and the peak-to-average ratio of the spectral coefficients that are located within the subband z and that is of the current audio frame is less than or equal to a threshold T71 (the threshold T71 may be, for example, less than or equal to 1, 2, 3, 5, or another value);

the quotient of dividing the amplitude average of the spectral coefficients that are located within the subband m and that is of the current audio frame by the amplitude average of the spectral coefficients that are located within the subband n and that is of the current audio frame is less than or equal to a threshold T72 (the threshold T72 may be, for example, greater than or equal to 0.5, 1.1, 2, 3, or another value), and the peak-to-average ratio of the spectral coefficients that are located within the subband z and that is of the current audio frame is less than or equal to a threshold T73 (the threshold T73 may be, for example, less than or equal to 1, 2, 3, 5, or another value);

the difference of subtracting the amplitude average of the spectral coefficients that are located within the subband n and that is of the current audio frame from the amplitude average of the spectral coefficients that are located within the subband m and that is of the current audio frame is less than or equal to a threshold T74 (the threshold T74 may be, for example, greater than or equal to 11, 20, 50, 101, or another value), and the peak-to-average ratio of the spectral coefficients that are located within the subband z and that is of the current audio frame is less than or equal to a threshold T75 (the threshold T75 may be, for example, less than or equal to 1, 2, 3, 5, or another value);

the quotient of dividing the energy average of the spectral coefficients that are located within the subband i and that is of the current audio frame by the energy average of the spectral coefficients that are located within the subband j and that is of the current audio frame is less than or equal to a threshold T76 (the threshold T76 may be, for example, less than or equal to 0.5, 1, 2, 3, or another value), and the envelope deviation of the spectral coefficients that are located within the subband w and that is of the current audio frame is less than or equal to a threshold T77 (the threshold T77 may be, for example, greater than or equal to 10, 20, 35, or another value);

the difference of subtracting the energy average of the spectral coefficients that are located within the subband j and that is of the current audio frame from the energy average of the spectral coefficients that are located within the subband i and that is of the current audio frame is less than or equal to a threshold T78 (the threshold T78 may be, for example, less than or equal to 10, 20, 51, 100, or another value), and the envelope deviation of the spectral coefficients that are located within the subband w and that is of the current audio frame is less than or equal to a threshold T79 (the threshold T79 may be, for example, greater than or equal to 10, 20, 35, or another value);

the quotient of dividing the amplitude average of the spectral coefficients that are located within the subband m and that is of the current audio frame by the amplitude average of the spectral coefficients that are located within the subband n and that is of the current audio frame is less than or equal to a threshold T80 (the threshold T80 may be, for example, greater than or equal to 0.5, 1.1, 2, 3, or another value), and the envelope deviation of the spectral coefficients that are located within the subband w and that is of the current audio frame is less than or equal to a threshold T81 (the threshold T81 may be, for example, greater than or equal to 10, 20, 35, or another value); or the difference of subtracting the amplitude average of the spectral coefficients that are located within the subband n and that is of the current audio frame from the amplitude average of the spectral coefficients that are located within the subband m and that is of the current audio frame is less than or equal to a threshold T82 (the threshold T82 may be, for example, greater than or equal to 11, 20, 50, 101, or another value), and the envelope deviation of the spectral coefficients that are located within the subband w and that is of the current audio frame is less than or equal to a threshold T83 (the threshold T83 may be, for example, greater than or equal to 10, 20, 35, or another value).

It may be understood that the first parameter condition is not limited to the foregoing examples, and multiple other possible implementation manners may be extended based on the foregoing examples.

For example, in some possible implementation manners of the present disclosure, the second parameter condition includes at least one of the following conditions:

the coding rate of the current audio frame is greater than or equal to the threshold T1;

the peak-to-average ratio of the spectral coefficients that are located within the subband z and that is of the current audio frame is greater than the threshold T2;

the envelope deviation of the spectral coefficients that are located within the subband w and that is of the current audio frame is greater than the threshold T3;

the quotient of dividing the energy average of the spectral coefficients that are located within the subband i and that is of the current audio frame by the energy average of the spectral coefficients that are located within the subband j and that is of the current audio frame is less than the threshold T4;

the difference of subtracting the energy average of the spectral coefficients that are located within the subband j and that is of the current audio frame from the energy average of the spectral coefficients that are located within the subband i and that is of the current audio frame is less than the threshold T5;

the quotient of dividing the amplitude average of the spectral coefficients that are located within the subband m and that is of the current audio frame by the amplitude average of the spectral coefficients that are located within the subband n and that is of the current audio frame is less than the threshold T6;

the difference of subtracting the amplitude average of the spectral coefficients that are located within the subband n and that is of the current audio frame from the amplitude average of the spectral coefficients that are located within the subband m and that is of the current audio frame is less than the threshold T7;

the ratio of the peak-to-average ratio of the spectral coefficients that are located within the subband x and that is of the current audio frame to the peak-to-average ratio of the spectral coefficients that are located within the subband y and that is of the current audio frame does not fall within the interval R1;

the absolute value of the difference between the peak-to-average ratio of the spectral coefficients that are located within the subband x and that is of the current audio frame and the peak-to-average ratio of the spectral coefficients that are located within the subband y and that is of the current audio frame is greater than the threshold T8;

the ratio of the envelope deviation of the spectral coefficients that are located within the subband r and that is of the current audio frame to the envelope deviation of the spectral coefficients that are located within the subband s and that is of the current audio frame does not fall within the interval R2;

the absolute value of the difference between the envelope deviation of the spectral coefficients that are located within the subband r and that is of the current audio frame and the envelope deviation of the spectral coefficients that are located within the subband s and that is of the current audio frame is greater than the threshold T9;

the ratio of the envelope of the spectral coefficients that are located within the subband e and that is of the current audio frame to the envelope of the spectral coefficients that are located within the subband f and that is of the current audio frame does not fall within the interval R3;

the absolute value of the difference between the envelope of the spectral coefficients that are located within the subband e and that is of the current audio frame and the envelope of the spectral coefficients that are located within the subband f and that is of the current audio frame is greater than the threshold T10; or the parameter value of spectral correlation between the spectral coefficients that are located within the subband p and that is of the current audio frame and the spectral coefficients that are located within the subband q and that is of the current audio frame is less than the threshold T11.

For another example, in some possible implementation manners of the present disclosure, the second parameter condition includes one of the following conditions:

the coding rate of the current audio frame is greater than or equal to the threshold T1, and the quotient of dividing the energy average of the spectral coefficients that are located within the subband i and that is of the current audio frame by the energy average of the spectral coefficients that are located within the subband j and that is of the current audio frame is less than the threshold T12;

the coding rate of the current audio frame is greater than or equal to the threshold T1, and the quotient of dividing the amplitude average of the spectral coefficients that are located within the subband m and that is of the current audio frame by the amplitude average of the spectral coefficients that are located within the subband n and that is of the current audio frame is less than the threshold T13;

the coding rate of the current audio frame is greater than or equal to the threshold T1, and the peak-to-average ratio of the spectral coefficients that are located within the subband z and that is of the current audio frame is greater than the threshold T14;

the coding rate of the current audio frame is greater than or equal to the threshold T1, and the envelope deviation of the spectral coefficients that are located within the subband w and that is of the current audio frame is greater than the threshold T15;

the ratio of the peak-to-average ratio of the spectral coefficients that are located within the subband x and that is of the current audio frame to the peak-to-average ratio of the spectral coefficients that are located within the subband y and that is of the current audio frame does not fall within the interval R1, and the quotient of dividing the energy average of the spectral coefficients that are located within the subband i and that is of the current audio frame by the energy average of the spectral coefficients that are located within the subband j and that is of the current audio frame is less than the threshold T16;

the ratio of the peak-to-average ratio of the spectral coefficients that are located within the subband x and that is of the current audio frame to the peak-to-average ratio of the spectral coefficients that are located within the subband y and that is of the current audio frame does not fall within the interval R1, and the quotient of dividing the amplitude average of the spectral coefficients that are located within the subband m and that is of the current audio frame by the amplitude average of the spectral coefficients that are located within the subband n and that is of the current audio frame is less than the threshold T17;

the ratio of the peak-to-average ratio of the spectral coefficients that are located within the subband x and that is of the current audio frame to the peak-to-average ratio of the spectral coefficients that are located within the subband y and that is of the current audio frame does not fall within the interval R1, and the peak-to-average ratio of the spectral coefficients that are located within the subband z and that is of the current audio frame is greater than the threshold T18;

the ratio of the peak-to-average ratio of the spectral coefficients that are located within the subband x and that is of the current audio frame to the peak-to-average ratio of the spectral coefficients that are located within the subband y and that is of the current audio frame does not fall within the interval R1, and the envelope deviation of the spectral coefficients that are located within the subband w and that is of the current audio frame is greater than the threshold T19;

the absolute value of the difference between the peak-to-average ratio of the spectral coefficients that are located within the subband x and that is of the current audio frame and the peak-to-average ratio of the spectral coefficients that are located within the subband y and that is of the current audio frame is greater than the threshold T8, and the quotient of dividing the energy average of the spectral coefficients that are located within the subband i and that is of the current audio frame by the energy average of the spectral coefficients that are located within the subband j and that is of the current audio frame is less than the threshold T20;

the absolute value of the difference between the peak-to-average ratio of the spectral coefficients that are located within the subband x and that is of the current audio frame and the peak-to-average ratio of the spectral coefficients that are located within the subband y and that is of the current audio frame is greater than the threshold T8, and the quotient of dividing the amplitude average of the spectral coefficients that are located within the subband m and that is of the current audio frame by the amplitude average of the spectral coefficients that are located within the subband n and that is of the current audio frame is less than the threshold T21;

the absolute value of the difference between the peak-to-average ratio of the spectral coefficients that are located within the subband x and that is of the current audio frame and the peak-to-average ratio of the spectral coefficients that are located within the subband y and that is of the current audio frame is greater than the threshold T8, and the peak-to-average ratio of the spectral coefficients that are located within the subband z and that is of the current audio frame is greater than the threshold T22;

the absolute value of the difference between the peak-to-average ratio of the spectral coefficients that are located within the subband x and that is of the current audio frame and the peak-to-average ratio of the spectral coefficients that are located within the subband y and that is of the current audio frame is greater than the threshold T8, and the envelope deviation of the spectral coefficients that are located within the subband w and that is of the current audio frame is greater than the threshold T23;

the ratio of the envelope deviation of the spectral coefficients that are located within the subband r and that is of the current audio frame to the envelope deviation of the spectral coefficients that are located within the subband s and that is of the current audio frame does not fall within the interval R2, and the quotient of dividing the energy average of the spectral coefficients that are located within the subband i and that is of the current audio frame by the energy average of the spectral coefficients that are located within the subband j and that is of the current audio frame is less than the threshold T24;

the ratio of the envelope deviation of the spectral coefficients that are located within the subband r and that is of the current audio frame to the envelope deviation of the spectral coefficients that are located within the subband s and that is of the current audio frame does not fall within the interval R2, and the quotient of dividing the amplitude average of the spectral coefficients that are located within the subband m and that is of the current audio frame by the amplitude average of the spectral coefficients that are located within the subband n and that is of the current audio frame is less than the threshold T25;

the ratio of the envelope deviation of the spectral coefficients that are located within the subband r and that is of the current audio frame to the envelope deviation of the spectral coefficients that are located within the subband s and that is of the current audio frame does not fall within the interval R2, and the peak-to-average ratio of the spectral coefficients that are located within the subband z and that is of the current audio frame is greater than the threshold T26;

the ratio of the envelope deviation of the spectral coefficients that are located within the subband r and that is of the current audio frame to the envelope deviation of the spectral coefficients that are located within the subband s and that is of the current audio frame does not fall within the interval R2, and the envelope deviation of the spectral coefficients that are located within the subband w and that is of the current audio frame is greater than the threshold T27;

the absolute value of the difference between the envelope deviation of the spectral coefficients that are located within the subband r and that is of the current audio frame and the envelope deviation of the spectral coefficients that are located within the subband s and that is of the current audio frame is greater than the threshold T9, and the quotient of dividing the energy average of the spectral coefficients that are located within the subband i and that is of the current audio frame by the energy average of the spectral coefficients that are located within the subband j and that is of the current audio frame is less than the threshold T28;

the absolute value of the difference between the envelope deviation of the spectral coefficients that are located within the subband r and that is of the current audio frame and the envelope deviation of the spectral coefficients that are located within the subband s and that is of the current audio frame is greater than the threshold T9, and the quotient of dividing the amplitude average of the spectral coefficients that are located within the subband m and that is of the current audio frame by the amplitude average of the spectral coefficients that are located within the subband n and that is of the current audio frame is less than the threshold T29;

the absolute value of the difference between the envelope deviation of the spectral coefficients that are located within the subband r and that is of the current audio frame and the envelope deviation of the spectral coefficients that are located within the subband s and that is of the current audio frame is greater than the threshold T9, and the peak-to-average ratio of the spectral coefficients that are located within the subband z and that is of the current audio frame is greater than the threshold T30;

the absolute value of the difference between the envelope deviation of the spectral coefficients that are located within the subband r and that is of the current audio frame and the envelope deviation of the spectral coefficients that are located within the subband s and that is of the current audio frame is greater than the threshold T9, and the envelope deviation of the spectral coefficients that are located within the subband w and that is of the current audio frame is greater than the threshold T31;

the ratio of the envelope of the spectral coefficients that are located within the subband e and that is of the current audio frame to the envelope of the spectral coefficients that are located within the subband f and that is of the current audio frame falls within the interval R3, and the quotient of dividing the energy average of the spectral coefficients that are located within the subband i and that is of the current audio frame by the energy average of the spectral coefficients that are located within the subband j and that is of the current audio frame is less than the threshold T32;

the ratio of the envelope of the spectral coefficients that are located within the subband e and that is of the current audio frame to the envelope of the spectral coefficients that are located within the subband f and that is of the current audio frame falls within the interval R3, and the quotient of dividing the amplitude average of the spectral coefficients that are located within the subband m and that is of the current audio frame by the amplitude average of the spectral coefficients that are located within the subband n and that is of the current audio frame is less than the threshold T33;

the ratio of the envelope of the spectral coefficients that are located within the subband e and that is of the current audio frame to the envelope of the spectral coefficients that are located within the subband f and that is of the current audio frame falls within the interval R3, and the peak-to-average ratio of the spectral coefficients that are located within the subband z and that is of the current audio frame is greater than the threshold T34;

the ratio of the envelope of the spectral coefficients that are located within the subband e and that is of the current audio frame to the envelope of the spectral coefficients that are located within the subband f and that is of the current audio frame falls within the interval R3, and the envelope deviation of the spectral coefficients that are located within the subband w and that is of the current audio frame is greater than the threshold T35;

the absolute value of the difference between the envelope of the spectral coefficients that are located within the subband e and that is of the current audio frame and the envelope of the spectral coefficients that are located within the subband f and that is of the current audio frame is greater than the threshold T10, and the quotient of dividing the energy average of the spectral coefficients that are located within the subband i and that is of the current audio frame by the energy average of the spectral coefficients that are located within the subband j and that is of the current audio frame is less than the threshold T36;

the absolute value of the difference between the envelope of the spectral coefficients that are located within the subband e and that is of the current audio frame and the envelope of the spectral coefficients that are located within the subband f and that is of the current audio frame is greater than the threshold T10, and the quotient of dividing the amplitude average of the spectral coefficients that are located within the subband m and that is of the current audio frame by the energy average of the spectral coefficients that are located within the subband n and that is of the current audio frame is less than the threshold T37;

the absolute value of the difference between the envelope of the spectral coefficients that are located within the subband e and that is of the current audio frame and the envelope of the spectral coefficients that are located within the subband f and that is of the current audio frame is greater than the threshold T10, and the peak-to-average ratio of the spectral coefficients that are located within the subband z and that is of the current audio frame is greater than the threshold T38;

the absolute value of the difference between the envelope of the spectral coefficients that are located within the subband e and that is of the current audio frame and the envelope of the spectral coefficients that are located within the subband f and that is of the current audio frame is greater than the threshold T10, and the envelope deviation of the spectral coefficients that are located within the subband w and that is of the current audio frame is greater than the threshold T39;

the parameter value of spectral correlation between the spectral coefficients that are located within the subband p and that is of the current audio frame and the spectral coefficients that are located within the subband q and that is of the current audio frame is less than or equal to the threshold T11, and the quotient of dividing the energy average of the spectral coefficients that are located within the subband i and that is of the current audio frame by the energy average of the spectral coefficients that are located within the subband j and that is of the current audio frame is less than the threshold T40;

the parameter value of spectral correlation between the spectral coefficients that are located within the subband p and that is of the current audio frame and the spectral coefficients that are located within the subband q and that is of the current audio frame is less than or equal to the threshold T11, and the quotient of dividing the amplitude average of the spectral coefficients that are located within the subband m and that is of the current audio frame by the amplitude average of the spectral coefficients that are located within the subband n and that is of the current audio frame is less than the threshold T41;

the parameter value of spectral correlation between the spectral coefficients that are located within the subband p and that is of the current audio frame and the spectral coefficients that are located within the subband q and that is of the current audio frame is less than or equal to the threshold T11, and the peak-to-average ratio of the spectral coefficients that are located within the subband z and that is of the current audio frame is greater than the threshold T42;

the parameter value of spectral correlation between the spectral coefficients that are located within the subband p and that is of the current audio frame and the spectral coefficients that are located within the subband q and that is of the current audio frame is less than or equal to the threshold T11, and the envelope deviation of the spectral coefficients that are located within the subband w and that is of the current audio frame is greater than the threshold T43;

the quotient of dividing the peak-to-average ratio of the spectral coefficients that are located within the subband x and that is of the current audio frame by the peak-to-average ratio of the spectral coefficients that are located within the subband y and that is of the current audio frame is less than the threshold T44, and the peak-to-average ratio of the spectral coefficients that are located within the subband y and that is of the current audio frame is greater than the threshold T45;

the quotient of dividing the peak-to-average ratio of the spectral coefficients that are located within the subband x and that is of the current audio frame by the peak-to-average ratio of the spectral coefficients that are located within the subband y and that is of the current audio frame is greater than the threshold T46, and the peak-to-average ratio of the spectral coefficients that are located within the subband y and that is of the current audio frame is less than the threshold T47;

the difference of subtracting the peak-to-average ratio of the spectral coefficients that are located within the subband y and that is of the current audio frame from the peak-to-average ratio of the spectral coefficients that are located within the subband x and that is of the current audio frame is less than the threshold T48, and the peak-to-average ratio of the spectral coefficients that are located within the subband y and that is of the current audio frame is greater than the threshold T49;

the difference of subtracting the peak-to-average ratio of the spectral coefficients that are located within the subband y and that is of the current audio frame from the peak-to-average ratio of the spectral coefficients that are located within the subband x and that is of the current audio frame is greater than the threshold T50, and the peak-to-average ratio of the spectral coefficients that are located within the subband y and that is of the current audio frame is less than the threshold T51;

the quotient of dividing the envelope deviation of the spectral coefficients that are located within the subband r and that is of the current audio frame by the envelope deviation of the spectral coefficients that are located within the subband s and that is of the current audio frame is less than the threshold T52, and the envelope deviation of the spectral coefficients that are located within the subband s and that is of the current audio frame is greater than the threshold T53;

the quotient of dividing the envelope deviation of the spectral coefficients that are located within the subband r and that is of the current audio frame by the envelope deviation of the spectral coefficients that are located within the subband s and that is of the current audio frame is greater than the threshold T54, and the envelope deviation of the spectral coefficients that are located within the subband s and that is of the current audio frame is less than the threshold T55;

the difference of subtracting the envelope deviation of the spectral coefficients that are located within the subband s and that is of the current audio frame from the envelope deviation of the spectral coefficients that are located within the subband r and that is of the current audio frame is less than the threshold T56, and the envelope deviation of the spectral coefficients that are located within the subband s and that is of the current audio frame is greater than the threshold T57;

the difference of subtracting the envelope deviation of the spectral coefficients that are located within the subband s and that is of the current audio frame from the envelope deviation of the spectral coefficients that are located within the subband r and that is of the current audio frame is greater than the threshold T58, and the envelope deviation of the spectral coefficients that are located within the subband s and that is of the current audio frame is less than the threshold T59;

the quotient of dividing the envelope of the spectral coefficients that are located within the subband e and that is of the current audio frame by the envelope of the spectral coefficients that are located within the subband f and that is of the current audio frame is less than the threshold T60, and the envelope of the spectral coefficients that are located within the subband f and that is of the current audio frame is greater than the threshold T61;

the quotient of dividing the envelope of the spectral coefficients that are located within the subband e and that is of the current audio frame by the envelope of the spectral coefficients that are located within the subband f and that is of the current audio frame is greater than the threshold T62, and the envelope of the spectral coefficients that are located within the subband f and that is of the current audio frame is less than the threshold T63;

the difference of subtracting the envelope of the spectral coefficients that are located within the subband f and that is of the current audio frame from the envelope of the spectral coefficients that are located within the subband e and that is of the current audio frame is less than the threshold T64, and the envelope of the spectral coefficients that are located within the subband f and that is of the current audio frame is greater than the threshold T65;

the difference of subtracting the envelope of the spectral coefficients that are located within the subband f and that is of the current audio frame from the envelope of the spectral coefficients that are located within the subband e and that is of the current audio frame is greater than the threshold T66, and the envelope of the spectral coefficients that are located within the subband f and that is of the current audio frame is less than the threshold T67;

the quotient of dividing the energy average of the spectral coefficients that are located within the subband i and that is of the current audio frame by the energy average of the spectral coefficients that are located within the subband j and that is of the current audio frame is less than or equal to the threshold T68, and the peak-to-average ratio of the spectral coefficients that are located within the subband z and that is of the current audio frame is greater than the threshold T69;

the difference of subtracting the energy average of the spectral coefficients that are located within the subband j and that is of the current audio frame from the energy average of the spectral coefficients that are located within the subband i and that is of the current audio frame is less than or equal to the threshold T70, and the peak-to-average ratio of the spectral coefficients that are located within the subband z and that is of the current audio frame is greater than the threshold T71;

the quotient of dividing the amplitude average of the spectral coefficients that are located within the subband m and that is of the current audio frame by the amplitude average of the spectral coefficients that are located within the subband n and that is of the current audio frame is less than or equal to the threshold T72, and the peak-to-average ratio of the spectral coefficients that are located within the subband z and that is of the current audio frame is greater than the threshold T73;

the difference of subtracting the amplitude average of the spectral coefficients that are located within the subband n and that is of the current audio frame from the amplitude average of the spectral coefficients that are located within the subband m and that is of the current audio frame is less than or equal to the threshold T74, and the peak-to-average ratio of the spectral coefficients that are located within the subband z and that is of the current audio frame is greater than the threshold T75;

the quotient of dividing the energy average of the spectral coefficients that are located within the subband i and that is of the current audio frame by the energy average of the spectral coefficients that are located within the subband j and that is of the current audio frame is less than or equal to the threshold T76, and the envelope deviation of the spectral coefficients that are located within the subband w and that is of the current audio frame is greater than the threshold T77;

the difference of subtracting the energy average of the spectral coefficients that are located within the subband j and that is of the current audio frame from the energy average of the spectral coefficients that are located within the subband i and that is of the current audio frame is less than or equal to the threshold T78, and the envelope deviation of the spectral coefficients that are located within the subband w and that is of the current audio frame is greater than the threshold T79;

the quotient of dividing the amplitude average of the spectral coefficients that are located within the subband m and that is of the current audio frame by the amplitude average of the spectral coefficients that are located within the subband n and that is of the current audio frame is less than or equal to the threshold T80, and the envelope deviation of the spectral coefficients that are located within the subband w and that is of the current audio frame is greater than the threshold T81; or the difference of subtracting the amplitude average of the spectral coefficients that are located within the subband n and that is of the current audio frame from the amplitude average of the spectral coefficients that are located within the subband m and that is of the current audio frame is less than or equal to the threshold T82, and the envelope deviation of the spectral coefficients that are located within the subband w and that is of the current audio frame is greater than the threshold T83.

It may be understood that the second parameter condition is not limited to the foregoing examples, and multiple other possible implementation manners may be extended based on the foregoing examples.

It may be understood that the examples of the first parameter condition and the second parameter condition are not all possible implementation manners. In an actual application, the foregoing examples may be extended, to enrich the possible implementation manners of the first parameter condition and the second parameter condition.

For better understanding of the embodiments of the present disclosure, the following gives an exemplary description with reference to some specific application scenarios.

Figure 2:
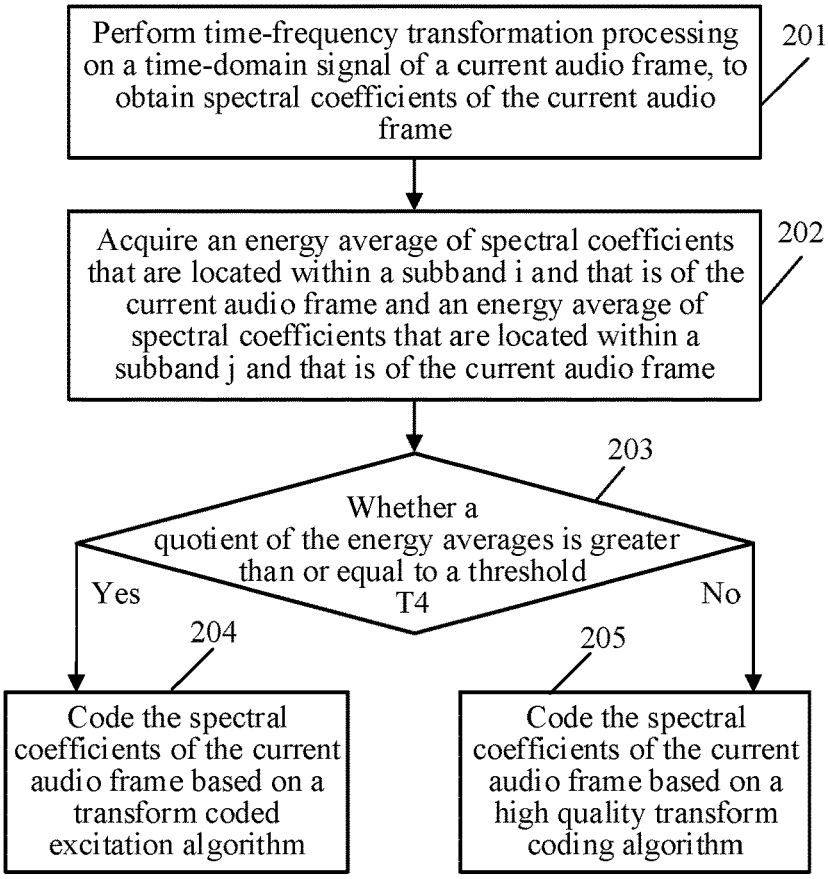

FIG. 2 is a flowchart of another audio coding method according to another embodiment of the present disclosure. In an example shown in FIG. 2, a coding algorithm used to code spectral coefficients of a current audio frame is determined mainly based on an energy average of spectral coefficients that are located within a subband i and an energy average of spectral coefficients that are located within a subband j.

As shown in FIG. 2, the another audio coding method provided in the another embodiment of the present disclosure may include the following contents:

201: Perform time-frequency transformation processing on a time-domain signal of a current audio frame, to obtain spectral coefficients of the current audio frame.

The audio frame mentioned in the embodiments of the present disclosure may be a speech frame or a music frame.

It is assumed that a bandwidth of the time-domain signal of the current audio frame is 16 kHz.

Time-frequency transformation processing is performed on the time-domain signal of the current audio frame by using a fast Fourier transform (FFT) algorithm, a modified discrete cosine transform (MDCT) algorithm, or another time-frequency transformation algorithm, to obtain the spectral coefficients of the current audio frame.

202: Acquire an energy average of spectral coefficients that is located within a subband i and that is of the current audio frame and an energy average of spectral coefficients that is located within a subband j and that is of the current audio frame.

203: Determine whether a quotient of dividing the energy average of the spectral coefficients that are located within the subband i and that is of the current audio frame by the energy average of the spectral coefficients that are located within the subband j and that is of the current audio frame is greater than or equal to a threshold T4.

If yes, step 204 is performed; if not, step 205 is performed.

The threshold T4 may be greater than or equal to 0.5, and the threshold T4, for example, is 0.5, 1, 1.5, 2, 3, or another value.

For example, a range of frequency bins of the subband i may be 3.2 kHz to 6.4 kHz, 3.2 kHz to 4.8 kHz, 4.8 kHz to 6.4 kHz, or 0.4 kHz to 6.4 kHz.

For example, a range of frequency bins of the subband j may be 6.4 kHz to 9.6 kHz, 6.4 kHz to 8 kHz, 8 kHz to 9.6 kHz, or 4.8 kHz to 9.6 kHz.

204: Code the spectral coefficients of the current audio frame based on a TCX algorithm.

205: Code the spectral coefficients of the current audio frame based on an HQ algorithm.

As can be seen, in this embodiment, after an energy average of spectral coefficients of a current audio frame that are located within a subband i and an energy average of spectral coefficients of the current audio frame that are located within a subband j are acquired, a TCX algorithm or an HQ algorithm is selected based on the acquired energy averages. The spectral coefficients of the current audio frame are coded using the selected algorithm. A relationship between the energy average of the spectral coefficients that are located within the subband i and that is of the current audio frame and the energy average of the spectral coefficients that are located within the subband j and that is of the current audio frame is associated with a coding algorithm used to code the spectral coefficients of the current audio frame, which helps improve adaptability and matchability between the coding algorithm and a reference coding parameter of the current audio frame, and further helps improve coding quality or coding efficiency of the current audio frame.

Figure 3:
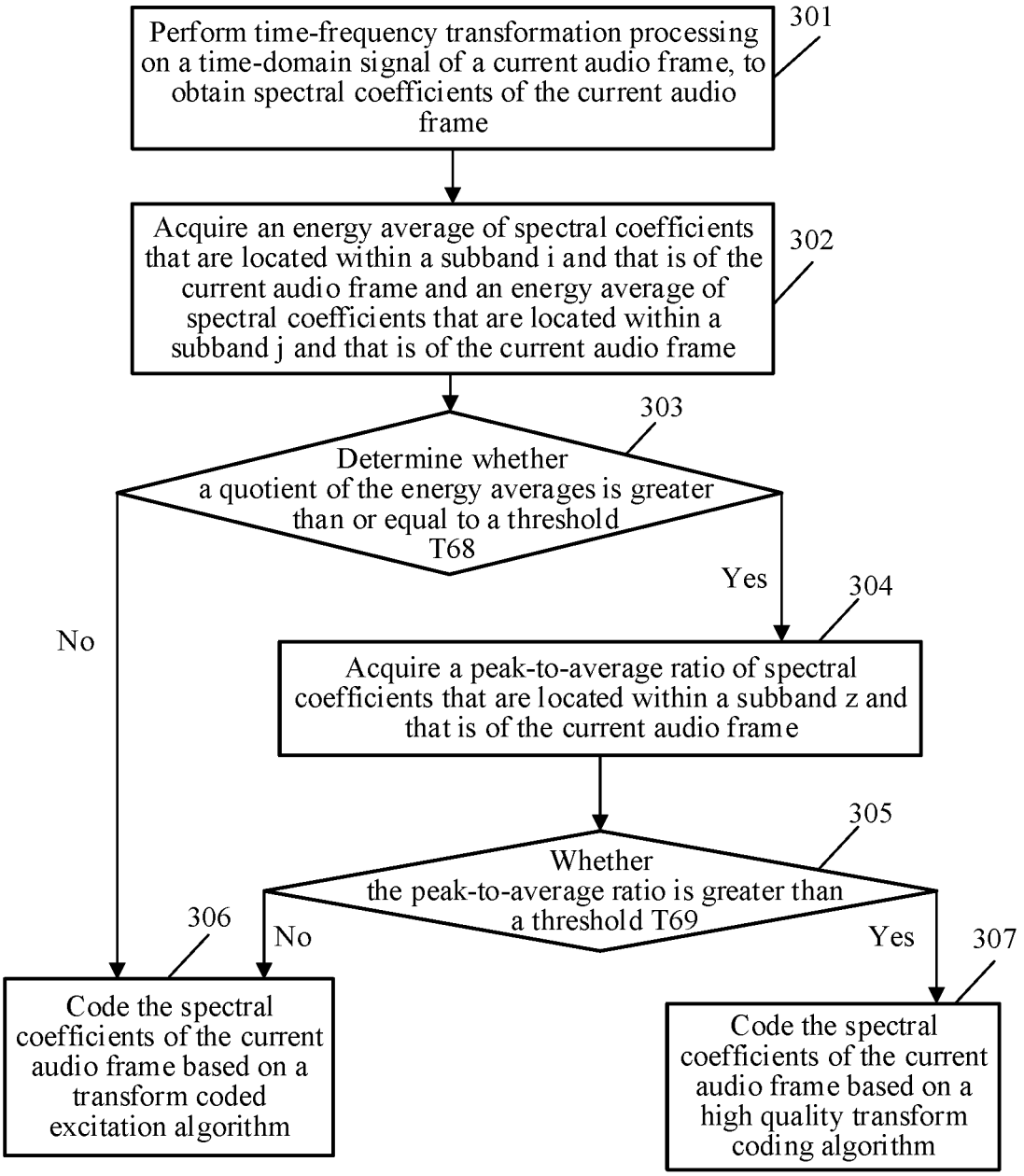

FIG. 3 is a flowchart of another audio coding method according to another embodiment of the present disclosure. In FIG. 3, a coding algorithm to code spectral coefficients of a current audio frame is determined mainly based on an energy average of spectral coefficients that are located within a subband i, an energy average of spectral coefficients that are located within a subband j, and a peak-to-average ratio of spectral coefficients that are located within a subband z.

As shown in FIG. 3, the another audio coding method provided in the another embodiment of the present disclosure may include the following contents:

301: Perform time-frequency transformation processing on a time-domain signal of a current audio frame, to obtain spectral coefficients of the current audio frame.

The audio frame mentioned in the embodiments of the present disclosure may be a speech frame or a music frame.

It is assumed that a bandwidth of the time-domain signal of the current audio frame is 16 kHz.

302: Acquire an energy average of spectral coefficients that are located within a subband i and that are of the current audio frame and an energy average of spectral coefficients that are located within a subband j and that are of the current audio frame.

303: Determine whether a quotient of dividing the energy average of the spectral coefficients that are located within the subband i by the energy average of the spectral coefficients that are located within the subband j is greater than or equal to a threshold T68.

If not, step 304 is performed; if yes, step 306 is performed.

The threshold T68 is greater than or equal to a threshold T4. For example, the threshold T68 may be greater than or equal to 0.6, and the threshold T68, for example, is 0.8, 0.6, 1, 1.5, 2, 3, 5, or another value.

For example, a range of frequency bins of the subband i may be 3.2 kHz to 6.4 kHz, 3.2 kHz to 4.8 kHz, 4.8 kHz to 6.4 kHz, or 0.4 kHz to 6.4 kHz.

For example, a range of frequency bins of the subband j may be 6.4 kHz to 9.6 kHz, 6.4 kHz to 8 kHz, 8 kHz to 9.6 kHz, or 4.8 kHz to 9.6 kHz.

304: Acquire a peak-to-average ratio of spectral coefficients that are located within a subband z.

305: Determine whether the peak-to-average ratio of the spectral coefficients that are located within the subband z is greater than a threshold T69.

If yes, step 307 is performed; if not, step 306 is performed.

The threshold T69 may be greater than or equal to 1, and the threshold T69, for example, is 1, 1.1, 1.5, 2, 3.5, 6, 4.6, or another value.

For example, a value range of a highest frequency bin of the subband z may be 12 kHz to 16 kHz, and a value range of a lowest frequency bin of the subband z may be 8 kHz to 14 kHz. Specifically, for example, a range of frequency bins of the subband z may be 8 kHz to 12 kHz, 9 kHz to 11 kHz, or 8 kHz to 9.6 kHz.

306: Code the spectral coefficients of the current audio frame based on a TCX algorithm.

307: Code the spectral coefficients of the current audio frame based on an HQ algorithm.

As can been seen, in solutions of this embodiment, a TCX algorithm or an HQ algorithm is selected mainly based on an energy average of spectral coefficients that is located within a subband i and that is of a current audio frame, an energy average of spectral coefficients that is located within a subband j and that is of the current audio frame, and a peak-to-average ratio of spectral coefficients that is located within a subband z and that is of the current audio frame, to code spectral coefficients of the current audio frame. A relationship between the energy average of the spectral coefficients that are located within the subband i and that is of the current audio frame and the energy average of the spectral coefficients that are located within the subband j and that is of the current audio frame, and the peak-to-average ratio of the spectral coefficients that are located within the subband z and that is of the current audio frame are associated with a coding algorithm used to code the spectral coefficients of the current audio frame, which helps improve adaptability and matchability between the coding algorithm and a reference coding parameter of the current audio frame, and further helps improve coding quality or coding efficiency of the current audio frame.

Figure 4:
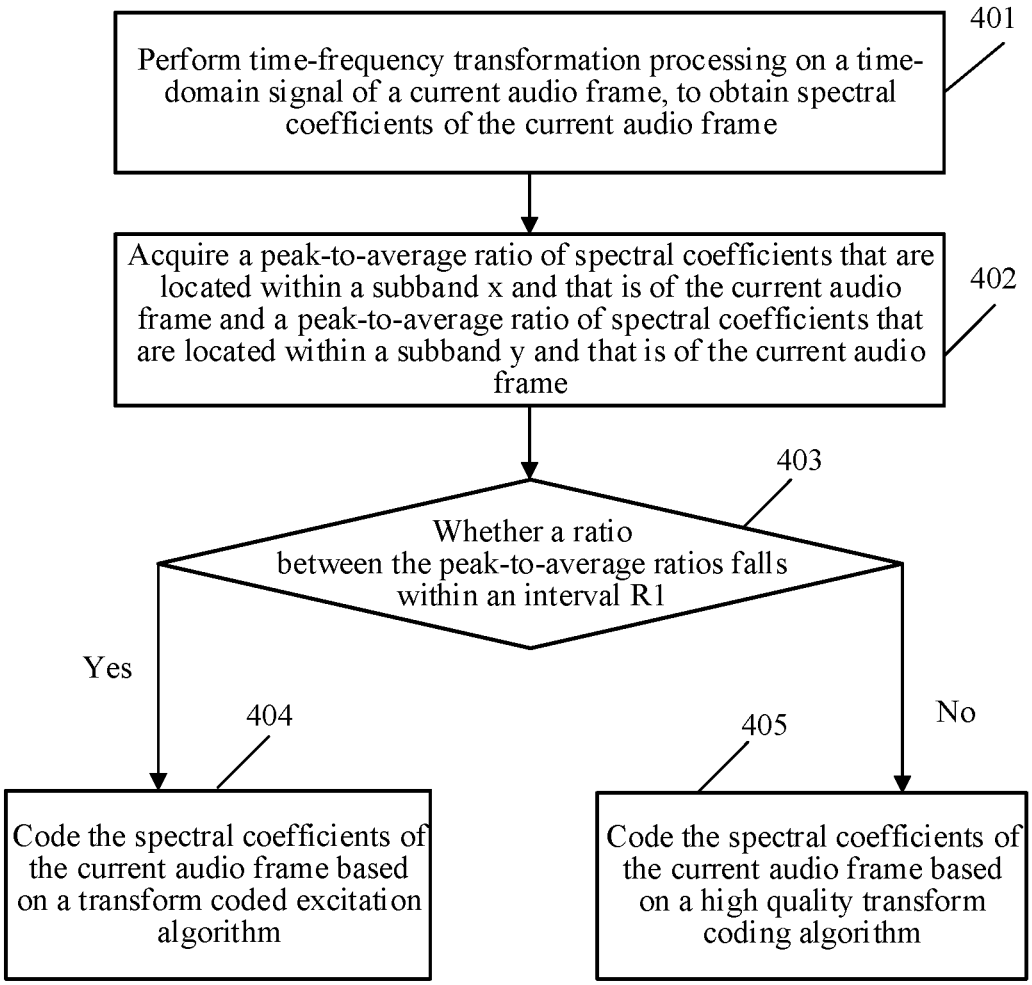

FIG. 4 is a flowchart of another audio coding method according to another embodiment of the present disclosure. In an example shown in FIG. 4, a coding algorithm used to code spectral coefficients of a current audio frame is determined mainly based on a peak-to-average ratio of spectral coefficients that is located within a subband x and that is of the current audio frame and a peak-to-average ratio of spectral coefficients that is located within a subband y and that is of the current audio frame.

As shown in FIG. 4, the another audio coding method provided in the another embodiment of the present disclosure may include the following content:

401: Perform time-frequency transformation processing on a time-domain signal of a current audio frame, to obtain spectral coefficients of the current audio frame.

The audio frame mentioned in the embodiments of the present disclosure may be a speech frame or a music frame.

It is assumed that a bandwidth of the time-domain signal of the current audio frame is 16 kHz.

402: Acquire a peak-to-average ratio of spectral coefficients that is located within a subband x and that is of the current audio frame and a peak-to-average ratio of spectral coefficients that is located within a subband y and that is of the current audio frame.

403: Determine whether a ratio of the peak-to-average ratio of the spectral coefficients that are located within the subband x and that is of the current audio frame to the peak-to-average ratio of the spectral coefficients that are located within the subband y and that is of the current audio frame falls within an interval R1.

If yes, step 404 is performed; if not, step 405 is performed.

The interval R1 may be, for example, [0.5, 2], [0.8, 1.25], [0.4, 2.5], or another range.

For example, a range of frequency bins of the subband x may be 0 kHz to 1.6 kHz, 1 kHz to 2.6 kHz, or 1.6 kHz to 3.2 kHz, and a range of frequency bins of the subband y may be 6.4 kHz to 8 kHz, 7.4 kHz to 9 kHz, or 4.8 kHz to 6.4 kHz.

404: Code the spectral coefficients of the current audio frame based on a TCX algorithm.

405: Code the spectral coefficients of the current audio frame based on an HQ algorithm.

As can be seen, in solutions of this embodiment, a TCX algorithm or an HQ algorithm is selected mainly based on a peak-to-average ratio of spectral coefficients that is located within a subband x and that is of a current audio frame and a peak-to-average ratio of spectral coefficients that is located within a subband y and that is of the current audio frame, to code spectral coefficients of the current audio frame. The peak-to-average ratio of the spectral coefficients that are located within the subband x and that is of the current audio frame and the peak-to-average ratio of the spectral coefficients that are located within the subband y and that is of the current audio frame are associated with a coding algorithm used to code the spectral coefficients of the current audio frame, which helps improve adaptability and matchability between the coding algorithm and a reference coding parameter of the current audio frame, and further helps improve coding quality or coding efficiency of the current audio frame.

Figure 5:
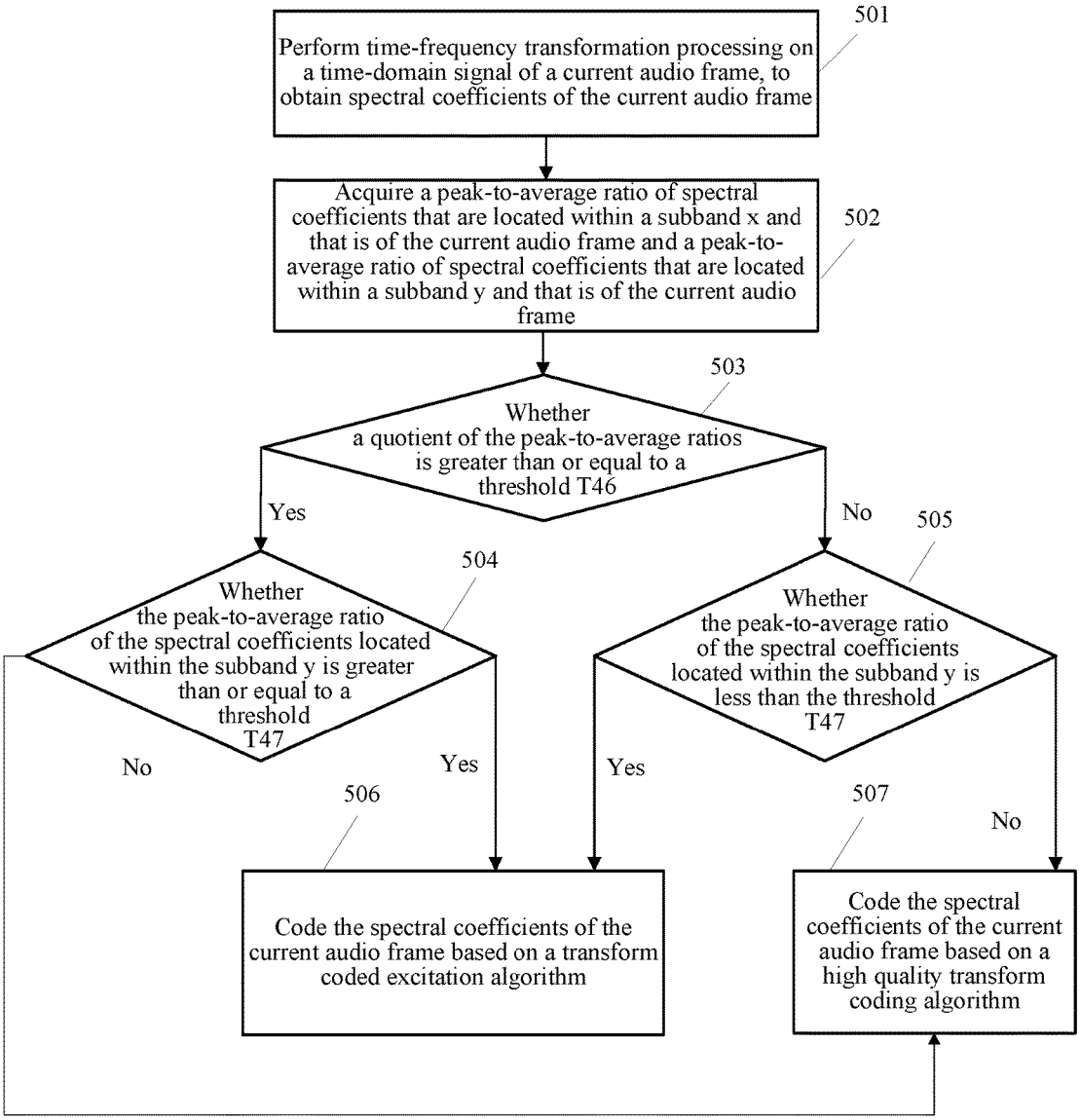

FIG. 5 is a schematic flowchart of another audio coding method according to another embodiment of the present disclosure. In an example shown in FIG. 5, a coding algorithm used to code spectral coefficients of a current audio frame is determined mainly based on a peak-to-average ratio of spectral coefficients that is located within a subband x and that is of the current audio frame and a peak-to-average ratio of spectral coefficients that is located within a subband y and that is of the current audio frame.

As shown in FIG. 5, the another audio coding method provided in the another embodiment of the present disclosure may include the following content:

501: Perform time-frequency transformation processing on a time-domain signal of a current audio frame, to obtain spectral coefficients of the current audio frame.

The audio frame mentioned in the embodiments of the present disclosure may be a speech frame or a music frame.

It is assumed that a bandwidth of the time-domain signal of the current audio frame is 16 kHz.

502: Acquire a peak-to-average ratio of spectral coefficients that is located within a subband x and that is of the current audio frame and a peak-to-average ratio of spectral coefficients that is located within a subband y and that is of the current audio frame.

503: Determine whether a quotient of dividing the peak-to-average ratio of the spectral coefficients that are located within the subband x and that is of the current audio frame by the peak-to-average ratio of the spectral coefficients that are located within the subband y and that is of the current audio frame is greater than or equal to a threshold T46.

If yes, step 504 is performed; if not, step 505 is performed.

The threshold T46 may be greater than or equal to 0.5, and the threshold T46, for example, is 0.5, 1, 1.5, 2, 3, or another value.

For example, a range of frequency bins of the subband x may be 0 kHz to 1.6 kHz, 1 kHz to 2.6 kHz, or 1.6 kHz to 3.2 kHz, and a range of frequency bins of the subband y may be 6.4 kHz to 8 kHz, 7.4 kHz to 9 kHz, or 4.8 kHz to 6.4 kHz.

504: Determine whether the peak-to-average ratio of the spectral coefficients that are located within the subband y and that is of the current audio frame is greater than or equal to a threshold T47.

If yes, step 506 is performed; if not, step 507 is performed.

505: Determine whether the peak-to-average ratio of the spectral coefficients that are located within the subband y and that is of the current audio frame is less than the threshold T47.

If yes, step 506 is performed; if not, step 507 is performed.

506: Code the spectral coefficients of the current audio frame based on a TCX algorithm.

507: Code the spectral coefficients of the current audio frame based on an HQ algorithm.

As can be seen, in solutions of this embodiment, a TCX algorithm or an HQ algorithm is selected mainly based on a peak-to-average ratio of spectral coefficients that is located within a subband x and that is of a current audio frame and a peak-to-average ratio of spectral coefficients that is located within a subband y and that is of the current audio frame, to code spectral coefficients of the current audio frame. The peak-to-average ratio of the spectral coefficients that are located within the subband x and that is of the current audio frame and the peak-to-average ratio of the spectral coefficients that are located within the subband y and that is of the current audio frame are associated with a coding algorithm used to code the spectral coefficients of the current audio frame, which helps improve adaptability and matchability between the coding algorithm and a reference coding parameter of the current audio frame, and further helps improve coding quality or coding efficiency of the current audio frame.

Figure 6:
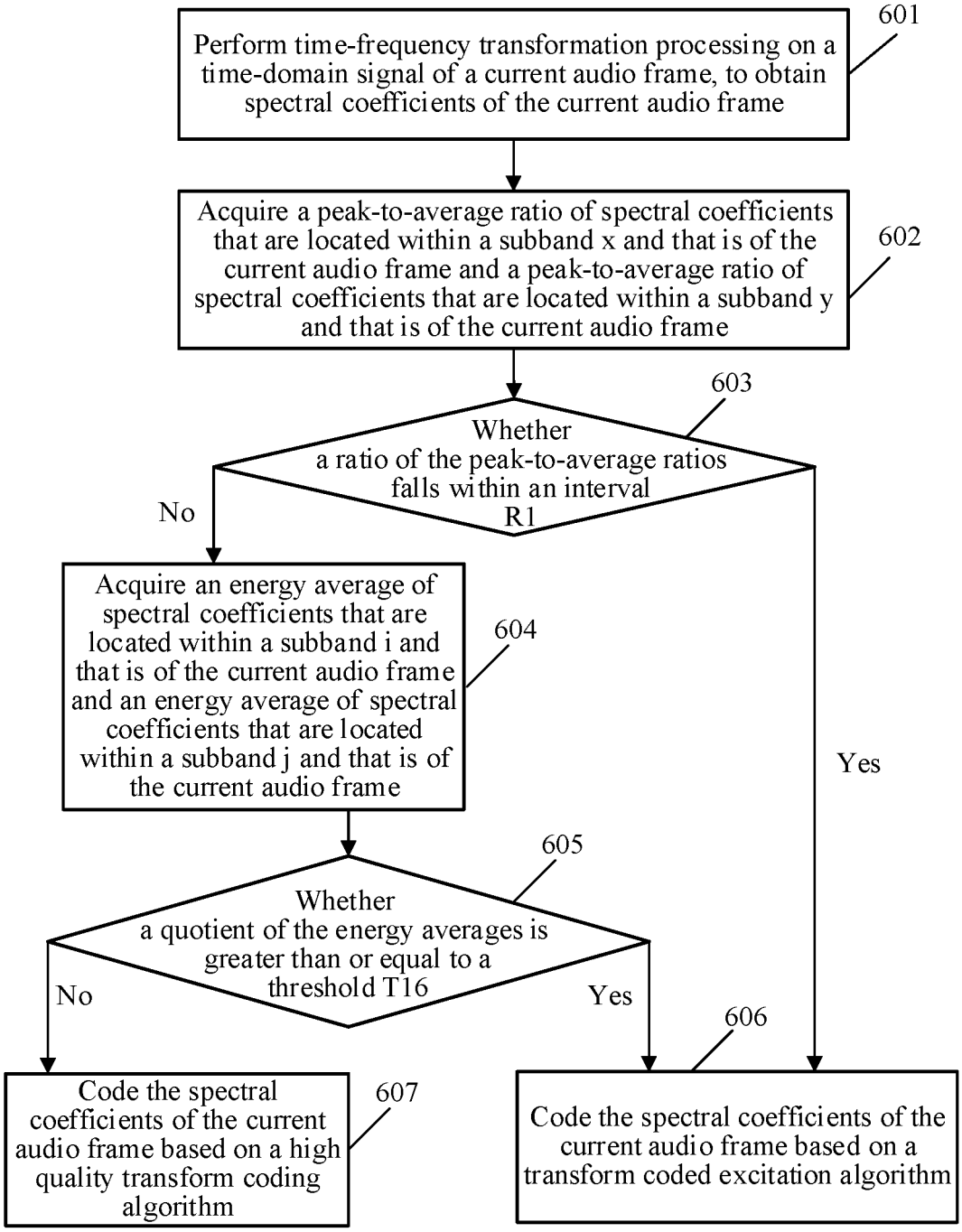

FIG. 6 is a schematic flowchart of another audio coding method according to another embodiment of the present disclosure. In an example shown in FIG. 6, a coding algorithm used to code spectral coefficients of a current audio frame is determined mainly based on a peak-to-average ratio of spectral coefficients that is located within a subband x and that is of the current audio frame, a peak-to-average ratio of spectral coefficients that is located within a subband y and that is of the current audio frame, an energy average of spectral coefficients that is located within a subband i and that is of the current audio frame, and an energy average of spectral coefficients that is located within a subband j and that is of the current audio frame.

As shown in FIG. 6, the another audio coding method provided in the another embodiment of the present disclosure may include the following content:

601: Perform time-frequency transformation processing on a time-domain signal of a current audio frame, to obtain spectral coefficients of the current audio frame.

The audio frame mentioned in the embodiments of the present disclosure may be a speech frame or a music frame.

It is assumed that a bandwidth of the time-domain signal of the current audio frame is 16 kHz.

602: Acquire a peak-to-average ratio of spectral coefficients that is located within a subband x and that is of the current audio frame and a peak-to-average ratio of spectral coefficients that is located within a subband y and that is of the current audio frame.

603: Determine whether a ratio of the peak-to-average ratio of the spectral coefficients that are located within the subband x and that is of the current audio frame to the peak-to-average ratio of the spectral coefficients that are located within the subband y and that is of the current audio frame falls within an interval R1.

If not, step 604 is performed; if yes, step 606 is performed.

The interval R1 may be, for example, [0.5, 2], [0.8, 1.25], [0.4, 2.5], or another range.

For example, a range of frequency bins of the subband x may be 0 kHz to 1.6 kHz, 1 kHz to 2.6 kHz, or 1.6 kHz to 3.2 kHz, and a range of frequency bins of the subband y may be 6.4 kHz to 8 kHz, 7.4 kHz to 9 kHz, or 4.8 kHz to 6.4 kHz.

604: Acquire an energy average of spectral coefficients that is located within a subband i and that is of the current audio frame and an energy average of spectral coefficients that is located within a subband j and that is of the current audio frame.

605: Determine whether a quotient of dividing the energy average of the spectral coefficients that are located within the subband i and that is of the current audio frame by the energy average of the spectral coefficients that are located within the subband j and that is of the current audio frame is greater than or equal to a threshold T16.

If yes, step 606 is performed; if not, step 607 is performed.

A range of frequency bins of the subband i may be, for example, 0 kHz to 1.6 kHz or 1 kHz to 2.6 kHz, and a range of frequency bins of the subband j may be, for example, 6.4 kHz to 8 kHz, 4.8 kHz to 6.4 kHz, or 7.4 kHz to 9 kHz.

The threshold T16 is greater than a threshold T4. For example, the threshold T16 may be greater than or equal to 2, and the threshold T16, for example, is 2, 2.5, 3, 3.5, 5, 5.1, or another value.

606: Code the spectral coefficients of the current audio frame based on a TCX algorithm.

607: Code the spectral coefficients of the current audio frame based on an HQ algorithm.

As can be seen, in solutions of this embodiment, a TCX algorithm or an HQ algorithm is selected mainly based on a peak-to-average ratio of spectral coefficients that is located within a subband x and that is of a current audio frame, a peak-to-average ratio of spectral coefficients that is located within a subband y and that is of the current audio frame, an energy average of spectral coefficients that is located within a subband i and that is of the current audio frame, and an energy average of spectral coefficients that is located within a subband j and that is of the current audio frame, to code spectral coefficients of the current audio frame. The peak-to-average ratio of the spectral coefficients that are located within the subband x and that is of the current audio frame, the peak-to-average ratio of the spectral coefficients that are located within the subband y and that is of the current audio frame, the energy average of the spectral coefficients that are located within the subband i and that is of the current audio frame, and the energy average of the spectral coefficients that are located within the subband j and that is of the current audio frame are associated with a coding algorithm used to code the spectral coefficients of the current audio frame, which helps improve adaptability and matchability between the coding algorithm and a reference coding parameter of the current audio frame, and further helps improve coding quality or coding efficiency of the current audio frame.

Figure 7:
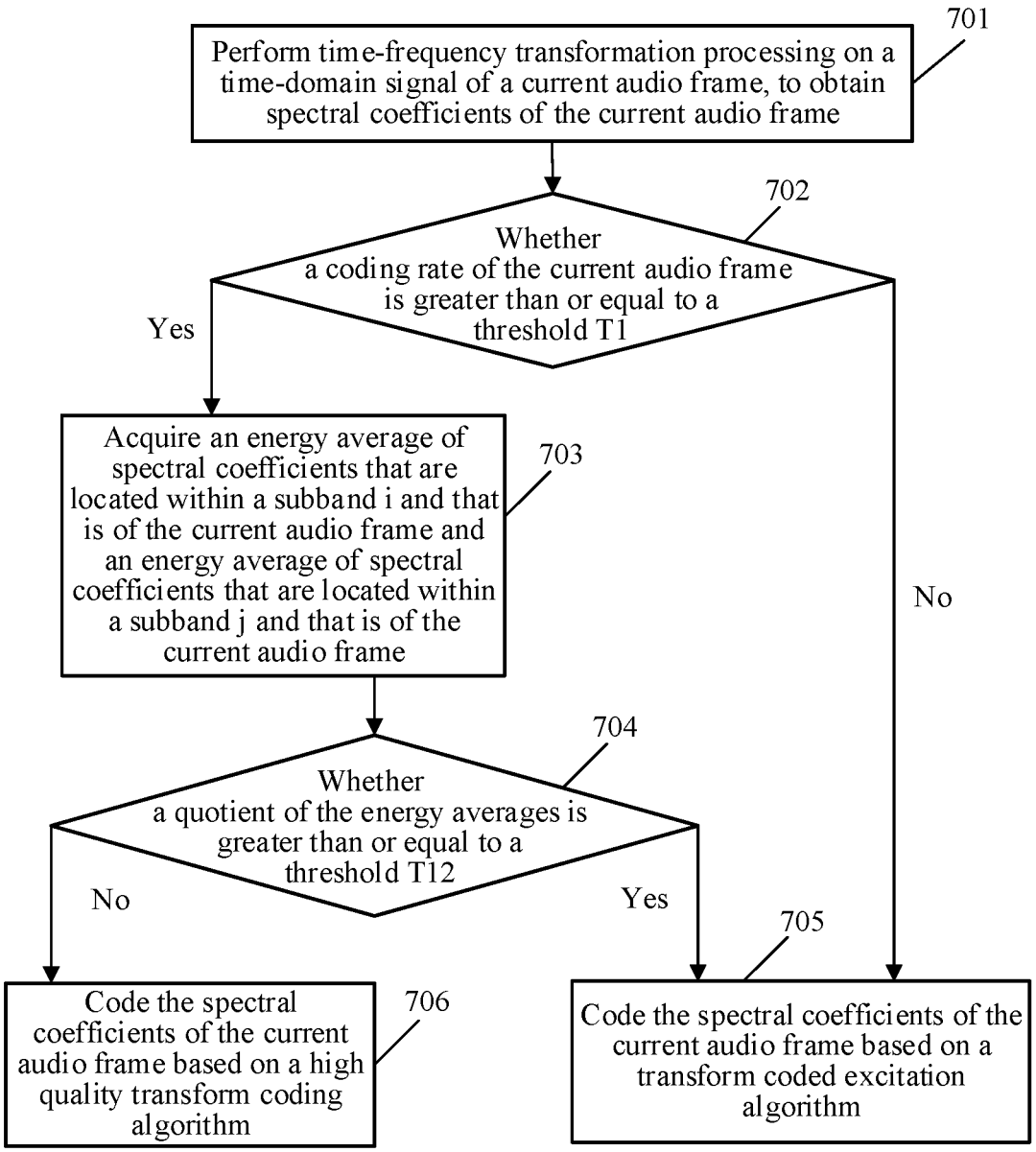

FIG. 7 is a schematic flowchart of another audio coding method according to another embodiment of the present disclosure. In an example shown in FIG. 7, a coding algorithm used to code spectral coefficients of a current audio frame is determined mainly by using a coding rate of the current audio frame, an energy average of spectral coefficients that is located within a subband i and that is of the current audio frame, and an energy average of spectral coefficients that is located within a subband j and that is of the current audio frame.

As shown in FIG. 7, the another audio coding method provided in the another embodiment of the present disclosure may include the following content:

701: Perform time-frequency transformation processing on a time-domain signal of a current audio frame, to obtain spectral coefficients of the current audio frame.

The audio frame mentioned in the embodiments of the present disclosure may be a speech frame or a music frame.

It is assumed that a bandwidth of the time-domain signal of the current audio frame is 16 kHz.

702: Determine whether a coding rate of the current audio frame is greater than or equal to a threshold T1.

If yes, step 703 is performed; if not, step 705 is performed.

The threshold T1, for example, is greater than or equal to 24.4 kbps. For example, the threshold T1 is equal to 24.4 kbps, 32 kbps, 64 kbps, or another rate.

703: Acquire an energy average of spectral coefficients that is located within a subband i and that is of the current audio frame and an energy average of spectral coefficients that is located within a subband j and that is of the current audio frame.

704: Determine whether a quotient of dividing the energy average of the spectral coefficients that are located within the subband i and that is of the current audio frame by the energy average of the spectral coefficients that are located within the subband j and that is of the current audio frame is greater than or equal to a threshold T12.

If yes, step 705 is performed; if not, step 706 is performed.

A range of frequency bins of the subband i may be, for example, 0 kHz to 1.6 kHz or 1 kHz to 2.6 kHz, and a range of frequency bins of the subband j may be, for example, 6.4 kHz to 8 kHz, 4.8 kHz to 6.4 kHz, or 7.4 kHz to 9 kHz.

The threshold T12 may be greater than a threshold T4. For example, the threshold T12 may be greater than or equal to 2, and the threshold T12, for example, is 2, 2.5, 3, 3.5, 5, 5.2, or another value.

705: Code the spectral coefficients of the current audio frame based on a TCX algorithm.

706: Code the spectral coefficients of the current audio frame based on an HQ algorithm.

As can be seen, in solutions of this embodiment, a TCX algorithm or an HQ algorithm is selected mainly based on a coding rate of a current audio frame, an energy average of spectral coefficients that is located within a subband i and that is of the current audio frame, and an energy average of spectral coefficients that is located within a subband j and that is of the current audio frame, to code spectral coefficients of the current audio frame. The coding rate of the current audio frame, the energy average of the spectral coefficients that are located within the subband i and that is of the current audio frame, and the energy average of the spectral coefficients that are located within the subband j and that is of the current audio frame are associated with a coding algorithm used to code the spectral coefficients of the current audio frame, which helps improve adaptability and matchability between the coding algorithm and a reference coding parameter of the current audio frame, and further helps improve coding quality or coding efficiency of the current audio frame.

Figure 8:
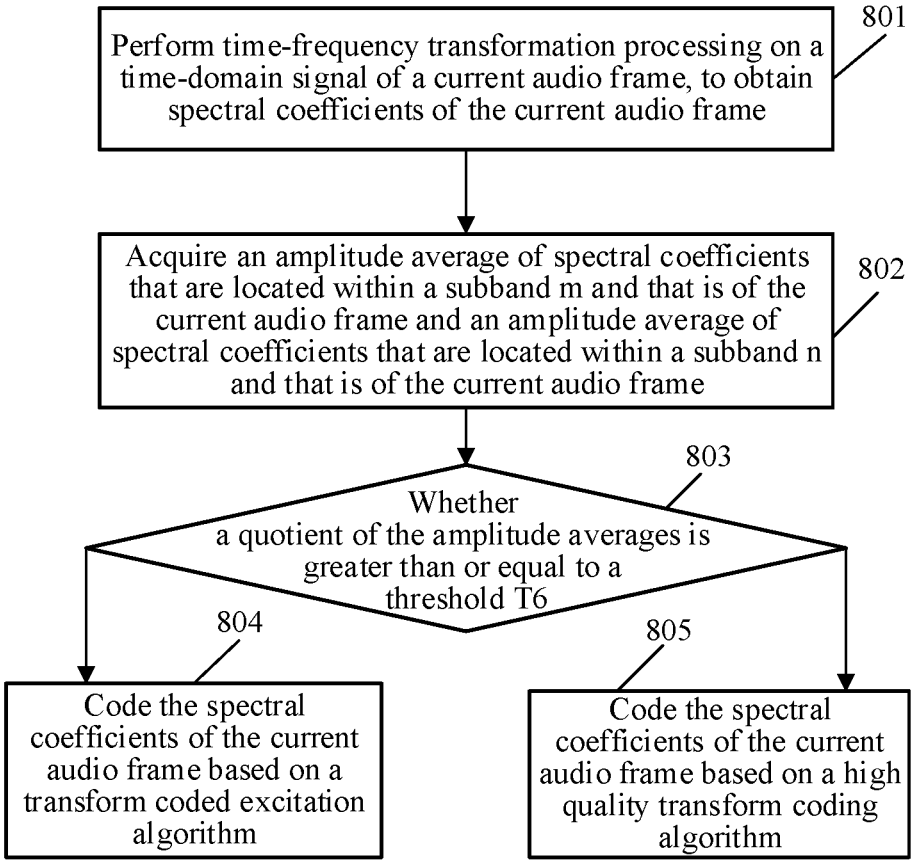

FIG. 8 is a schematic flowchart of another audio coding method according to another embodiment of the present disclosure. In an example shown in FIG. 8, a coding algorithm used to code spectral coefficients of a current audio frame is determined mainly based on an amplitude average of spectral coefficients that is located within a subband m and that is of the current audio frame and an amplitude average of spectral coefficients that is located within a subband n and that is of the current audio frame.

As shown in FIG. 8, the another audio coding method provided in the another embodiment of the present disclosure may include the following content:

801: Perform time-frequency transformation processing on a time-domain signal of a current audio frame, to obtain spectral coefficients of the current audio frame.

The audio frame mentioned in the embodiments of the present disclosure may be a speech frame or a music frame.

It is assumed that a bandwidth of the time-domain signal of the current audio frame is 16 kHz.

802: Acquire an amplitude average of spectral coefficients that is located within a subband m and that is of the current audio frame and an amplitude average of spectral coefficients that is located within a subband n and that is of the current audio frame.

803: Determine whether a quotient of dividing the amplitude average of the spectral coefficients that are located within the subband m and that is of the current audio frame by the amplitude average of the spectral coefficients that are located within the subband n and that is of the current audio frame is greater than or equal to a threshold T6.

If yes, step 804 is performed; if not, step 805 is performed.

The threshold T6 may be greater than or equal to 0.3, and the threshold T6, for example, is 0.5, 1, 1.5, 2, 3.2, or another value.

For example, a range of frequency bins of the subband m may be 3.2 kHz to 6.4 kHz, 3.2 kHz to 4.8 kHz, 4.8 kHz to 6.4 kHz, or 0.4 kHz to 6.4 kHz.

For example, a range of frequency bins of the subband n may be 6.4 kHz to 9.6 kHz, 6.4 kHz to 8 kHz, 8 kHz to 9.6 kHz, or 4.8 kHz to 9.6 kHz.

804: Code the spectral coefficients of the current audio frame based on a TCX algorithm.

805: Code the spectral coefficients of the current audio frame based on an HQ algorithm.

As can be seen, in solutions of this embodiment, a TCX algorithm or an HQ algorithm is selected mainly based on an amplitude average of spectral coefficients that is located within a subband m and that is of a current audio frame and an amplitude average of spectral coefficients that is located within a subband n and that is of the current audio frame, to code spectral coefficients of the current audio frame. A relationship between the amplitude average of the spectral coefficients that are located within the subband m and that is of the current audio frame and the amplitude average of the spectral coefficients that are located within the subband n and that is of the current audio frame, and a peak-to-average ratio of spectral coefficients that is located within a subband z and that is of the current audio frame are associated with a coding algorithm used to code the spectral coefficients of the current audio frame, which helps improve adaptability and matchability between the coding algorithm and a reference coding parameter of the current audio frame, and further helps improve coding quality or coding efficiency of the current audio frame.

It may be understood that, exemplary implementation manners in FIG. 2 to FIG. 8 are merely some implementation manners of the present disclosure. In an actual application, multiple other possible implementation manners may be extended based on related exemplary descriptions in the embodiment corresponding to FIG. 1.

In some scenarios, the following may be considered during selection of a subband.

When a similarity between property parameters of spectral coefficients located within two subbands is calculated, two matched subbands may be selected, for example, the two subbands are 0 kHz to 1.6 kHz and 6.4 kHz to 8 kHz. In some scenarios, because a property of spectral coefficients in 0 to 1 kHz differs greatly from a property of spectral coefficients in 1 to 1.6 kHz, the spectrum of 0 kHz to 1.6 kHz may not be selected when the similarity between the property parameters of the spectral coefficients is calculated. For example, spectral coefficients within 1 kHz to 2.6 kHz may be selected to replace spectral coefficients within 0 to 1.6 kHz, to calculate a property parameter of low-frequency spectral coefficients. In this case, if low frequency spectral coefficients within 1 kHz to 2.6 kHz are copied to high frequency, corresponding spectral coefficients are high-frequency spectral coefficients within 7.4 kHz to 9 kHz. When a property parameter of high-frequency spectral coefficients is calculated, the spectral coefficients within 7.4 kHz to 9 kHz is more suitable for calculation of a spectral property. However, in some scenarios, resolution of spectral coefficients within 0 kHz to 6.4 kHz may be very high, and the spectral coefficients within 0 kHz to 6.4 kHz are suitable for calculation of a property parameter. If resolution of spectral coefficients within 6.4 kHz to 16 kHz is relatively low, the spectral coefficients within 6.4 kHz to 16 kHz may be unsuitable for calculation of a property parameter of spectral coefficients. Therefore, when the property parameter of the high-frequency spectral coefficients is calculated, the spectral coefficients within 4.8 kHz to 6.4 kHz may be selected to calculate a property parameter, and the property parameter is used as a high-frequency property parameter.

The coding the spectral coefficients of the current audio frame based on the transform coded excitation algorithm may specifically include: dividing the spectral coefficients into N subbands; calculating and quantizing an envelope of each subband; performing bit allocation for each subband according to a quantized envelope value and a quantity of available bits; quantizing spectral coefficients of each subband according to a quantity of bits allocated to the subband; and writing the quantized spectral coefficients and an index value of a spectral envelope into a bitstream.

The following further provides a related apparatus configured to implement the foregoing solution.

Figure 9:
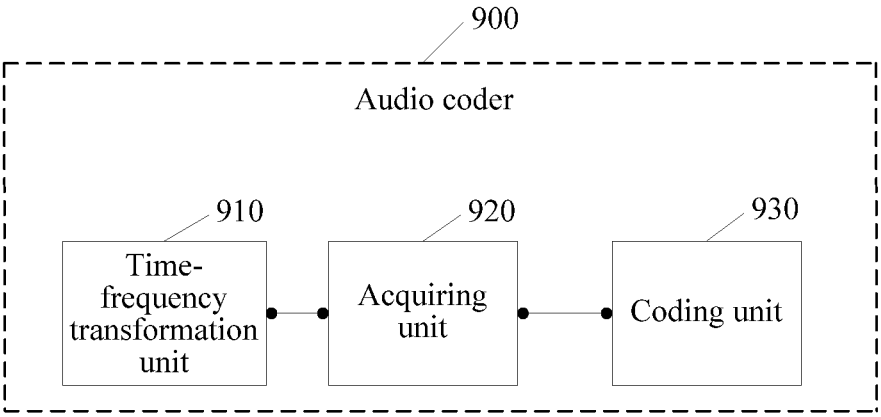
FIG. 9 is a functional block diagram of an audio signal encoder according to embodiments of the present disclosure.

Referring to FIG. 9, an embodiment of the present disclosure further provides an audio coder 900. The audio coder 900 may include a time-frequency transformation unit 910, an acquiring unit 920, and a coding unit 930.

The time-frequency transformation unit 910 is configured to perform time-frequency transformation processing on a time-domain signal of a current audio frame, to obtain spectral coefficients of the current audio frame.

The acquiring unit 920 is configured to acquire a reference coding parameter of the current audio frame.

The coding unit 930 is configured to: if the reference coding parameter that is acquired by the acquiring unit 920 and that is of the current audio frame satisfies a first parameter condition, code the spectral coefficients of the current audio frame based on a transform coded excitation algorithm, or if the reference coding parameter that is acquired by the acquiring unit and that is of the current audio frame satisfies a second parameter condition, code the spectral coefficients of the current audio frame based on a high quality transform coding algorithm.

According to a requirement of an application scenario, the reference coding parameter that is acquired by the acquiring unit 920 and that is of the current audio frame may be varied.

For example, the reference coding parameter may include at least one of the following parameters: a coding rate of the current audio frame; a peak-to-average ratio of spectral coefficients that is located within a subband z and that is of the current audio frame; an envelope deviation of spectral coefficients that is located within a subband w and that is of the current audio frame; an energy average of spectral coefficients that is located within a subband i and that is of the current audio frame and an energy average of spectral coefficients that is located within a subband j and that is of the current audio frame; an amplitude average of spectral coefficients that is located within a subband m and that is of the current audio frame and an amplitude average of spectral coefficients that is located within a subband n and that is of the current audio frame; a peak-to-average ratio of spectral coefficients that is located within a subband x and that is of the current audio frame and a peak-to-average ratio of spectral coefficients that is located within a subband y and that is of the current audio frame; an envelope deviation of spectral coefficients that is located within a subband r and that is of the current audio frame and an envelope deviation of spectral coefficients that is located within a subband s and that is of the current audio frame; an envelope of spectral coefficients that is located within a subband e and that is of the current audio frame and an envelope of spectral coefficients that is located within a subband f and that is of the current audio frame; or a parameter value of spectral correlation between spectral coefficients that is located within a subband p and that is of the current audio frame and spectral coefficients that is located within a subband q and that is of the current audio frame.

A larger parameter value of spectral correlation between the spectral coefficients that are located within the subband p and that is of the current audio frame and the spectral coefficients that are located within the subband q and that is of the current audio frame indicates stronger spectral correlation between the spectral coefficients located within the subband p and the spectral coefficients located within the subband q. The parameter value of the spectral correlation may be, for example, a normalized cross correlation parameter value.

Ranges of frequency bins of the subbands may be determined according to actual needs.

Optionally, in some possible implementation manners of the present disclosure, a highest frequency bin of the subband z may be greater than a critical frequency bin F1, and a highest frequency bin of the subband w may be greater than the critical frequency bin F1. A value range of the critical frequency bin F1 may be, for example, 6.4 kHz to 12 kHz. For example, a value of the critical frequency bin F1 may be 6.4 kHz, 8 kHz, 9 kHz, 10 kHz, or 12 kHz. Certainly, the critical frequency bin F1 may be another value.

Optionally, in some possible implementation manners of the present disclosure, a highest frequency bin of the subband j may be greater than a critical frequency bin F2, and a highest frequency bin of the subband n is greater than the critical frequency bin F2. For example, a value range of the critical frequency bin F2 may be 4.8 kHz to 8 kHz. Specifically, for example, a value of the critical frequency bin F2 may be 6.4 kHz, 4.8 kHz, 6 kHz, 8 kHz, 5 kHz, or 7 kHz. Certainly, the critical frequency bin F2 may be another value.

Optionally, in some possible implementation manners of the present disclosure, a highest frequency bin of the subband i may be less than the highest frequency bin of the subband j, a highest frequency bin of the subband m may be less than the highest frequency bin of the subband n, a highest frequency bin of the subband x may be less than or equal to a lowest frequency bin of the subband y, a highest frequency bin of the subband p may be less than or equal to a lowest frequency bin of the subband q, a highest frequency bin of the subband r may be less than or equal to a lowest frequency bin of the subband s, and a highest frequency bin of the subband e may be less than or equal to a lowest frequency bin of the subband f.

Optionally, in some possible implementation manners of the present disclosure, at least one of the following conditions may be satisfied:

a lowest frequency bin of the subband w is greater than or equal to the critical frequency bin F1, a lowest frequency bin of the subband z is greater than or equal to the critical frequency bin F1, the highest frequency bin of the subband i is less than or equal to a lowest frequency bin of the subband j, the highest frequency bin of the subband m is less than or equal to a lowest frequency bin of the subband n, a lowest frequency bin of the subband j is greater than or equal to the critical frequency bin F2, a lowest frequency bin of the subband n is greater than or equal to the critical frequency bin F2, the highest frequency bin of the subband i is less than or equal to the critical frequency bin F2, the highest frequency bin of the subband m is less than or equal to the critical frequency bin F2, a lowest frequency bin of the subband j is greater than or equal to the critical frequency bin F2, or a lowest frequency bin of the subband n is greater than or equal to the critical frequency bin F2.

Optionally, in some possible implementation manners of the present disclosure, at least one of the following conditions may be satisfied: the highest frequency bin of the subband e is less than or equal to the critical frequency bin F2, the highest frequency bin of the subband x is less than or equal to the critical frequency bin F2, the highest frequency bin of the subband p is less than or equal to the critical frequency bin F2, or the highest frequency bin of the subband r is less than or equal to the critical frequency bin F2.

Optionally, in some possible implementation manners of the present disclosure, the highest frequency bin of the subband f may be less than or equal to the critical frequency bin F2, and certainly, the lowest frequency bin of the subband f may be greater than or equal to the critical frequency bin F2. The highest frequency bin of the subband q may be less than or equal to the critical frequency bin F2, and certainly, the lowest frequency bin of the subband q may be greater than or equal to the critical frequency bin F2. The highest frequency bin of the subband s may be less than or equal to the critical frequency bin F2, and certainly, the lowest frequency bin of the subband s may be greater than or equal to the critical frequency bin F2.

For example, a value range of the highest frequency bin of the subband z may be 12 kHz to 16 kHz. A value range of the lowest frequency bin of the subband z may be 8 kHz to 14 kHz. A value range of a bandwidth of the subband z may be 1.6 kHz to 8 kHz. Specifically, for example, a range of frequency bins of the subband z may be 8 kHz to 12 kHz, 9 kHz to 11 kHz, 8 kHz to 9.6 kHz, or 12 kHz to 14 kHz. Certainly, the range of frequency bins of the subband z is not limited to the foregoing examples.

For example, a range of frequency bins of the subband w may be determined according to actual needs. For example, a value range of the highest frequency bin of the subband w may be 12 kHz to 16 kHz, and a value range of the lowest frequency bin of the subband w may be 8 kHz to 14 kHz. Specifically, for example, the range of frequency bins of the subband w is 8 kHz to 12 kHz, 9 kHz to 11 kHz, 8 kHz to 9.6 kHz, 12 kHz to 14 kHz, or 12.2 kHz to 14.5 kHz. Certainly, the range of frequency bins of the subband w is not limited to the foregoing examples. In some possible implementation manners, the range of frequency bins of the subband w may be the same as or similar to the range of frequency bins of the subband z.

For example, a range of frequency bins of the subband i may be 3.2 kHz to 6.4 kHz, 3.2 kHz to 4.8 kHz, 4.8 kHz to 6.4 kHz, 0.4 kHz to 6.4 kHz, or 0.4 kHz to 3.6 kHz. Certainly, the range of frequency bins of the subband i is not limited to the foregoing examples.

For example, a range of frequency bins of the subband j may be 6.4 kHz to 9.6 kHz, 6.4 kHz to 8 kHz, 8 kHz to 9.6 kHz, 4.8 kHz to 9.6 kHz, or 4.8 kHz to 8 kHz. Certainly, the range of frequency bins of the subband j is not limited to the foregoing examples.

For example, a range of frequency bins of the subband m may be 3.2 kHz to 6.4 kHz, 3.2 kHz to 4.8 kHz, 4.8 kHz to 6.4 kHz, 0.4 kHz to 6.4 kHz, or 0.4 kHz to 3.6 kHz. Certainly, the range of frequency bins of the subband m is not limited to the foregoing examples. In some possible implementation manners, the range of frequency bins of the subband m may be the same as or similar to the range of frequency bins of the subband i.

For example, a range of frequency bins of the subband n may be 6.4 kHz to 9.6 kHz, 6.4 kHz to 8 kHz, 8 kHz to 9.6 kHz, 4.8 kHz to 9.6 kHz, or 4.8 kHz to 8 kHz. Certainly, the range of frequency bins of the subband n is not limited to the foregoing examples. In some possible implementation manners, the range of frequency bins of the subband n may be the same as or similar to the range of frequency bins of the subband j.

For example, a range of frequency bins of the subband x may be 0 kHz to 1.6 kHz, 1 kHz to 2.6 kHz, 1.6 kHz to 3.2 kHz, 2 kHz to 3.2 kHz, or 2.5 kHz to 3.4 kHz. Certainly, the range of frequency bins of the subband x is not limited to the foregoing examples.

For example, a range of frequency bins of the subband y may be 6.4 kHz to 8 kHz, 7.4 kHz to 9 kHz, 4.8 kHz to 6.4 kHz, 4.4 kHz to 6.4 kHz, or 4.5 kHz to 6.2 kHz. Certainly, the range of frequency bins of the subband y is not limited to the foregoing examples.

For example, a range of frequency bins of the subband p may be 0 kHz to 1.6 kHz, 1 kHz to 2.6 kHz, 1.6 kHz to 3.2 kHz, 2.1 kHz to 3.2 kHz, or 2.5 kHz to 3.5 kHz. Certainly, the range of frequency bins of the subband p is not limited to the foregoing examples. In some possible implementation manners, the range of frequency bins of the subband p may be the same as or similar to the range of frequency bins of the subband x.

For example, a range of frequency bins of the subband q may be 6.4 kHz to 8 kHz, 7.4 kHz to 9 kHz, 4.8 kHz to 6.4 kHz, 4.2 kHz to 6.4 kHz, or 4.7 kHz to 6.2 kHz. Certainly, the range of frequency bins of the subband q is not limited to the foregoing examples. In some possible implementation manners, the range of frequency bins of the subband q may be the same as or similar to the range of frequency bins of the subband y.

For example, a range of frequency bins of the subband r may be 0 kHz to 1.6 kHz, 1 kHz to 2.6 kHz, 1.6 kHz to 3.2 kHz, 2.05 kHz to 3.27 kHz, or 2.59 kHz to 3.51 kHz. Certainly, the range of frequency bins of the subband r is not limited to the foregoing examples. In some possible implementation manners, the range of frequency bins of the subband r may be the same as or similar to the range of frequency bins of the subband x.

For example, a range of frequency bins of the subband s may be 6.4 kHz to 8 kHz, 7.4 kHz to 9 kHz, 4.8 kHz to 6.4 kHz, 5.4 kHz to 7.1 kHz, or 4.55 kHz to 6.29 kHz. Certainly, the range of frequency bins of the subband s is not limited to the foregoing examples. In some possible implementation manners, the range of frequency bins of the subband s may be the same as or similar to the range of frequency bins of the subband y.

For example, a range of frequency bins of the subband e may be 0 kHz to 1.6 kHz, 1 kHz to 2.6 kHz, 1.6 kHz to 3.2 kHz, 0.8 kHz to 3 kHz, or 1.9 kHz to 3.8 kHz. Certainly, the range of frequency bins of the subband e is not limited to the foregoing examples. In some possible implementation manners, the range of frequency bins of the subband e may be the same as or similar to the range of frequency bins of the subband x.

For example, a range of frequency bins of the subband f may be 6.4 kHz to 8 kHz, 7.4 kHz to 9 kHz, 4.8 kHz to 6.4 kHz, 5.3 kHz to 7.15 kHz, or 4.58 kHz to 6.52 kHz. Certainly, the range of frequency bins of the subband f is not limited to the foregoing examples. In some possible implementation manners, the range of frequency bins of the subband f may be the same as or similar to the range of frequency bins of the subband y.

The first parameter condition and the second parameter condition may be varied.

For example, in some possible implementation manners of the present disclosure, the first parameter condition in this embodiment may be, for example, the first parameter condition in the method embodiment, and the second parameter condition in this embodiment may be, for example, the second parameter condition in the method embodiment. For related descriptions, refer to the records in the method embodiment.

It may be understood that, functions of each functional module of the audio coder 900 in this embodiment may be specifically implemented according to the methods of the foregoing method embodiments. For a specific implementation process, refer to related description of the foregoing method embodiments, and details are not described herein.

The audio coder 900 may be any apparatus that needs to collect, store, or transmit an audio signal, for example, a mobile phone, a tablet computer, a personal computer, or a notebook computer.

As can be seen, in solutions of this embodiment, after acquiring a reference coding parameter of a current audio frame, the audio coder 900 selects a TCX algorithm or an HQ algorithm based on the acquired reference coding parameter of the current audio frame, to code spectral coefficients of the current audio frame. The reference coding parameter of the current audio frame is associated with a coding algorithm used to code the spectral coefficients of the current audio frame, which helps improve adaptability and matchability between the coding algorithm and the reference coding parameter of the current audio frame, and further helps improve coding quality or coding efficiency of the current audio frame.

Figure 10:
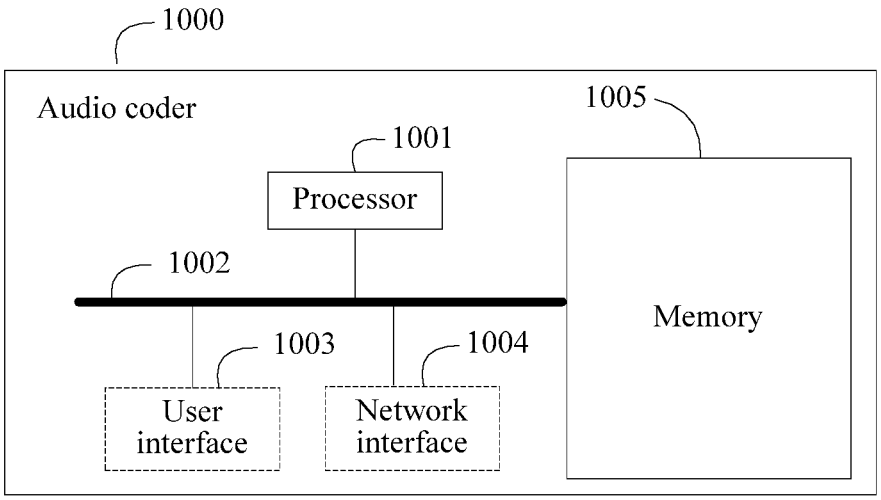
FIG. 10 is a structural block diagrams an audio signal encoder according to embodiments of the present disclosure.

FIG. 10 is a structural block diagram of an audio coder 1000 according to another embodiment of the present disclosure.

The audio coder 1000 may include at least one processor 1001, a memory 1005, and at least one communications bus 1002. The communications bus 1002 is configured to implement connection and communication between the components.

Optionally, the audio coder 1000 may further include at least one network interface 1004, a user interface 1003, and the like. Optionally, the user interface 1003 includes a display (for example, a touch screen, a liquid crystal display, a holographic imaging device, or a projector), a click device (for example, a mouse, a trackball, a touch panel, or a touch screen), a camera, and/or a pickup device.

The memory 1005 may include a read only memory and a random access memory, and provide an instruction and data for the processor 1001. A part of the memory 1005 may further include a non-volatile random access memory.

In some implementation manners, the memory 1005 stores the following elements, executable modules or data structures, or a subset thereof, or an extension set thereof: the time-frequency transformation unit 910, the acquiring unit 920, and the coding unit 930.

In this embodiment of the present disclosure, the processor 1001 executes the code or instruction in the memory 1005, to: perform time-frequency transformation processing on a time-domain signal of a current audio frame, to obtain spectral coefficients of the current audio frame; acquire a reference coding parameter of the current audio frame; and if the acquired reference coding parameter of the current audio frame satisfies a first parameter condition, code the spectral coefficients of the current audio frame based on a transform coded excitation algorithm, or if the acquired reference coding parameter of the current audio frame satisfies a second parameter condition, code the spectral coefficients of the current audio frame based on a high quality transform coding algorithm.

According to a requirement of an application scenario, the reference coding parameter that is acquired by the processor 1001 and that is of the current audio frame may be varied.

For example, the reference coding parameter may include at least one of the following parameters: a coding rate of the current audio frame; a peak-to-average ratio of spectral coefficients that is located within a subband z and that is of the current audio frame; an envelope deviation of spectral coefficients that is located within a subband w and that is of the current audio frame; an energy average of spectral coefficients that is located within a subband i and that is of the current audio frame and an energy average of spectral coefficients that is located within a subband j and that is of the current audio frame; an amplitude average of spectral coefficients that is located within a subband m and that is of the current audio frame and an amplitude average of spectral coefficients that is located within a subband n and that is of the current audio frame; a peak-to-average ratio of spectral coefficients that is located within a subband x and that is of the current audio frame and a peak-to-average ratio of spectral coefficients that is located within a subband y and that is of the current audio frame; an envelope deviation of spectral coefficients that is located within a subband r and that is of the current audio frame and an envelope deviation of spectral coefficients that is located within a subband s and that is of the current audio frame; an envelope of spectral coefficients that is located within a subband e and that is of the current audio frame and an envelope of spectral coefficients that is located within a subband f and that is of the current audio frame; or a parameter value of spectral correlation between spectral coefficients that is located within a subband p and that is of the current audio frame and spectral coefficients that is located within a subband q and that is of the current audio frame.

A larger parameter value of spectral correlation between the spectral coefficients that are located within the subband p and that is of the current audio frame and the spectral coefficients that are located within the subband q and that is of the current audio frame indicates stronger spectral correlation between the spectral coefficients located within the subband p and the spectral coefficients located within the subband q. The parameter value of the spectral correlation may be, for example, a normalized cross correlation parameter value.

Ranges of frequency bins of the subbands may be determined according to actual needs.

Optionally, in some possible implementation manners of the present disclosure, a highest frequency bin of the subband z may be greater than a critical frequency bin F1, and a highest frequency bin of the subband w may be greater than the critical frequency bin F1. A value range of the critical frequency bin F1 may be, for example, 6.4 kHz to 12 kHz. For example, a value of the critical frequency bin F1 may be 6.4 kHz, 8 kHz, 9 kHz, 10 kHz, or 12 kHz. Certainly, the critical frequency bin F1 may be another value.

Optionally, in some possible implementation manners of the present disclosure, a highest frequency bin of the subband j may be greater than a critical frequency bin F2, and a highest frequency bin of the subband n is greater than the critical frequency bin F2. For example, a value range of the critical frequency bin F2 may be 4.8 kHz to 8 kHz. Specifically, for example, the value of the critical frequency bin F2 may be 6.4 kHz, 4.8 kHz, 6 kHz, 8 kHz, 5 kHz, or 7 kHz. Certainly, the critical frequency bin F2 may be another value.

Optionally, in some possible implementation manners of the present disclosure, a highest frequency bin of the subband i may be less than the highest frequency bin of the subband j, a highest frequency bin of the subband m may be less than the highest frequency bin of the subband n, a highest frequency bin of the subband x may be less than or equal to a lowest frequency bin of the subband y, a highest frequency bin of the subband p may be less than or equal to a lowest frequency bin of the subband q, a highest frequency bin of the subband r may be less than or equal to a lowest frequency bin of the subband s, and a highest frequency bin of the subband e may be less than or equal to a lowest frequency bin of the subband f.

Optionally, in some possible implementation manners of the present disclosure, at least one of the following conditions may be satisfied:

a lowest frequency bin of the subband w is greater than or equal to the critical frequency bin F1, a lowest frequency bin of the subband z is greater than or equal to the critical frequency bin F1, the highest frequency bin of the subband i is less than or equal to a lowest frequency bin of the subband j, the highest frequency bin of the subband m is less than or equal to a lowest frequency bin of the subband n, a lowest frequency bin of the subband j is greater than or equal to the critical frequency bin F2, a lowest frequency bin of the subband n is greater than or equal to the critical frequency bin F2, the highest frequency bin of the subband i is less than or equal to the critical frequency bin F2, the highest frequency bin of the subband m is less than or equal to the critical frequency bin F2, a lowest frequency bin of the subband j is greater than or equal to the critical frequency bin F2, or a lowest frequency bin of the subband n is greater than or equal to the critical frequency bin F2.

Optionally, in some possible implementation manners of the present disclosure, at least one of the following conditions may be satisfied:

the highest frequency bin of the subband e is less than or equal to the critical frequency bin F2, the highest frequency bin of the subband x is less than or equal to the critical frequency bin F2, the highest frequency bin of the subband p is less than or equal to the critical frequency bin F2, or the highest frequency bin of the subband r is less than or equal to the critical frequency bin F2.

Optionally, in some possible implementation manners of the present disclosure, the highest frequency bin of the subband f may be less than or equal to the critical frequency bin F2, and certainly, the lowest frequency bin of the subband f may be greater than or equal to the critical frequency bin F2. The highest frequency bin of the subband q may be less than or equal to the critical frequency bin F2, and certainly, the lowest frequency bin of the subband q may be greater than or equal to the critical frequency bin F2. The highest frequency bin of the subband s may be less than or equal to the critical frequency bin F2, and certainly, the lowest frequency bin of the subband s may be greater than or equal to the critical frequency bin F2.

For example, a value range of the highest frequency bin of the subband z may be 12 kHz to 16 kHz. A value range of the lowest frequency bin of the subband z may be 8 kHz to 14 kHz. A value range of a bandwidth of the subband z may be 1.6 kHz to 8 kHz. Specifically, for example, a range of frequency bins of the subband z may be 8 kHz to 12 kHz, 9 kHz to 11 kHz, 8 kHz to 9.6 kHz, or 12 kHz to 14 kHz. Certainly, the range of frequency bins of the subband z is not limited to the foregoing examples.

For example, a range of frequency bins of the subband w may be determined according to actual needs. For example, a value range of the highest frequency bin of the subband w may be 12 kHz to 16 kHz, and a value range of the lowest frequency bin of the subband w may be 8 kHz to 14 kHz. Specifically, for example, the range of frequency bins of the subband w is 8 kHz to 12 kHz, 9 kHz to 11 kHz, 8 kHz to 9.6 kHz, 12 kHz to 14 kHz, or 12.2 kHz to 14.5 kHz. Certainly, the range of frequency bins of the subband w is not limited to the foregoing examples. In some possible implementation manners, the range of frequency bins of the subband w may be the same as or similar to the range of frequency bins of the subband z.

For example, a range of frequency bins of the subband i may be 3.2 kHz to 6.4 kHz, 3.2 kHz to 4.8 kHz, 4.8 kHz to 6.4 kHz, 0.4 kHz to 6.4 kHz, or 0.4 kHz to 3.6 kHz. Certainly, the range of frequency bins of the subband i is not limited to the foregoing examples.

For example, a range of frequency bins of the subband j may be 6.4 kHz to 9.6 kHz, 6.4 kHz to 8 kHz, 8 kHz to 9.6 kHz, 4.8 kHz to 9.6 kHz, or 4.8 kHz to 8 kHz. Certainly, the range of frequency bins of the subband j is not limited to the foregoing examples.

For example, a range of frequency bins of the subband m may be 3.2 kHz to 6.4 kHz, 3.2 kHz to 4.8 kHz, 4.8 kHz to 6.4 kHz, 0.4 kHz to 6.4 kHz, or 0.4 kHz to 3.6 kHz. Certainly, the range of frequency bins of the subband m is not limited to the foregoing examples. In some possible implementation manners, the range of frequency bins of the subband m may be the same as or similar to the range of frequency bins of the subband i.

For example, a range of frequency bins of the subband n may be 6.4 kHz to 9.6 kHz, 6.4 kHz to 8 kHz, 8 kHz to 9.6 kHz, 4.8 kHz to 9.6 kHz, or 4.8 kHz to 8 kHz. Certainly, the range of frequency bins of the subband n is not limited to the foregoing examples. In some possible implementation manners, the range of frequency bins of the subband n may be the same as or similar to the range of frequency bins of the subband j.

For example, a range of frequency bins of the subband x may be 0 kHz to 1.6 kHz, 1 kHz to 2.6 kHz, 1.6 kHz to 3.2 kHz, 2 kHz to 3.2 kHz, or 2.5 kHz to 3.4 kHz. Certainly, the range of frequency bins of the subband x is not limited to the foregoing examples.

For example, a range of frequency bins of the subband y may be 6.4 kHz to 8 kHz, 7.4 kHz to 9 kHz, 4.8 kHz to 6.4 kHz, 4.4 kHz to 6.4 kHz, or 4.5 kHz to 6.2 kHz. Certainly, the range of frequency bins of the subband y is not limited to the foregoing examples.

For example, a range of frequency bins of the subband p may be 0 kHz to 1.6 kHz, 1 kHz to 2.6 kHz, 1.6 kHz to 3.2 kHz, 2.1 kHz to 3.2 kHz, or 2.5 kHz to 3.5 kHz. Certainly, the range of frequency bins of the subband p is not limited to the foregoing examples. In some possible implementation manners, the range of frequency bins of the subband p may be the same as or similar to the range of frequency bins of the subband x.

For example, a range of frequency bins of the subband q may be 6.4 kHz to 8 kHz, 7.4 kHz to 9 kHz, 4.8 kHz to 6.4 kHz, 4.2 kHz to 6.4 kHz, or 4.7 kHz to 6.2 kHz. Certainly, the range of frequency bins of the subband q is not limited to the foregoing examples. In some possible implementation manners, the range of frequency bins of the subband q may be the same as or similar to the range of frequency bins of the subband y.

For example, a range of frequency bins of the subband r may be 0 kHz to 1.6 kHz, 1 kHz to 2.6 kHz, 1.6 kHz to 3.2 kHz, 2.05 kHz to 3.27 kHz, or 2.59 kHz to 3.51 kHz. Certainly, the range of frequency bins of the subband r is not limited to the foregoing examples. In some possible implementation manners, the range of frequency bins of the subband r may be the same as or similar to the range of frequency bins of the subband x.

For example, a range of frequency bins of the subband s may be 6.4 kHz to 8 kHz, 7.4 kHz to 9 kHz, 4.8 kHz to 6.4 kHz, 5.4 kHz to 7.1 kHz, or 4.55 kHz to 6.29 kHz. Certainly, the range of frequency bins of the subband s is not limited to the foregoing examples. In some possible implementation manners, the range of frequency bins of the subband s may be the same as or similar to the range of frequency bins of the subband y.

For example, a range of frequency bins of the subband e may be 0 kHz to 1.6 kHz, 1 kHz to 2.6 kHz, 1.6 kHz to 3.2 kHz, 0.8 kHz to 3 kHz, or 1.9 kHz to 3.8 kHz. Certainly, the range of frequency bins of the subband e is not limited to the foregoing examples. In some possible implementation manners, the range of frequency bins of the subband e may be the same as or similar to the range of frequency bins of the subband x.

For example, a range of frequency bins of the subband f may be 6.4 kHz to 8 kHz, 7.4 kHz to 9 kHz, 4.8 kHz to 6.4 kHz, 5.3 kHz to 7.15 kHz, or 4.58 kHz to 6.52 kHz. Certainly, the range of frequency bins of the subband f is not limited to the foregoing examples. In some possible implementation manners, the range of frequency bins of the subband f may be the same as or similar to the range of frequency bins of the subband y.

The first parameter condition and the second parameter condition may be varied.

For example, in some possible implementation manners of the present disclosure, the first parameter condition in this embodiment may be, for example, the first parameter condition in the method embodiment, and the second parameter condition in this embodiment may be, for example, the second parameter condition in the method embodiment. For related descriptions, refer to the records in the method embodiment.

It may be understood that, functions of each functional module of the audio coder 1000 in this embodiment may be specifically implemented according to the methods of the foregoing method embodiments. For a specific implementation process, refer to related description of the foregoing method embodiments, and details are not described herein.

The audio coder 1000 may be any apparatus that needs to collect, store, or transmit an audio signal, for example, a mobile phone, a tablet computer, a personal computer, or a notebook computer.

As can be seen, in solutions of this embodiment, after acquiring a reference coding parameter of a current audio frame, the audio coder 1000 selects a TCX algorithm or an HQ algorithm based on the acquired reference coding parameter of the current audio frame, to code spectral coefficients of the current audio frame. The reference coding parameter of the current audio frame is associated with a coding algorithm used to code the spectral coefficients of the current audio frame, which helps improve adaptability and matchability between the coding algorithm and the reference coding parameter of the current audio frame, and further helps improve coding quality or coding efficiency of the current audio frame.

Further, multiple optional reference coding parameters are used, which helps satisfy algorithm selection requirements in multiple scenarios.

An embodiment of the present disclosure further provides a computer storage medium, where the computer storage medium may store a program, and when the program is executed, a part or all of the steps in the audio coding method recorded in the method embodiment are performed.

It should be noted that, for brief description, the foregoing method embodiments are represented as a series of actions. However, persons skilled in the art should appreciate that the present disclosure is not limited to the described order of the actions, because according to the present disclosure, some steps may be performed in other orders or simultaneously. It should be further appreciated by a person skilled in the art that the embodiments described in this specification all belong to exemplary embodiments, and the involved actions and modules are not necessarily required by the present disclosure.

In the foregoing embodiments, the description of each embodiment has respective focuses. For a part that is not described in detail in an embodiment, reference may be made to related descriptions in other embodiments.

In the several embodiments provided in the present application, it should be understood that the disclosed apparatus may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented through some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. A part or all of the units may be selected according to actual needs to achieve the objectives of the solutions of the embodiments.

In addition, functional units in the embodiments of the present disclosure may be integrated into one processing unit, or each of the units may exist alone physically, or two or more units are integrated into one unit. The integrated unit may be implemented in a form of hardware, or may be implemented in a form of a software functional unit.

When the integrated unit is implemented in the form of a software functional unit and sold or used as an independent product, the integrated unit may be stored in a computer-readable storage medium. Based on such an understanding, the technical solutions of the present disclosure essentially, or the part contributing to the prior art, or all or a part of the technical solutions may be implemented in the form of a software product. The software product is stored in a storage medium and includes several instructions for instructing a computer device (which may be a personal computer, a server, or a network device) to perform all or a part of the steps of the methods described in the embodiments of the present disclosure. The foregoing storage medium includes: any medium that can store program code, such as a USB flash drive, a removable hard disk, a read-only memory (ROM), a random access memory (RAM), a magnetic disk, or an optical disc.

The foregoing embodiments are merely intended for describing the technical solutions of the present disclosure other than limiting the present disclosure. Although the present disclosure is described in detail with reference to the foregoing embodiments, persons of ordinary skill in the art should understand that they may still make modifications to the technical solutions described in the foregoing embodiments or make equivalent replacements to some technical features thereof, without departing from the scope of the technical solutions of the embodiments of the present disclosure.

What is claimed is:

1. An audio signal encoding method, comprising:

obtaining, by an audio signal encoder, an audio signal, wherein the audio signal comprises a plurality of subbands;

obtaining, by the audio signal encoder, spectral coefficients of a current frame of the audio signal;

obtaining, by the audio signal encoder, one or more reference coding parameters of the current frame based on the spectral coefficients;

determining, by the audio signal encoder, whether the reference coding parameters satisfy a preset parameter condition; and based on a determination that the reference coding parameters satisfy the preset parameter condition, encoding, by the audio signal encoder, the spectral coefficients using a transform coded excitation (TCX) algorithm;

wherein the current frame comprises a subband i, a subband j, a subband x and a subband y;

wherein the reference coding parameters comprise:

a subband average energy of spectral coefficients in the subband i, and a subband average energy of spectral coefficients in the subband j; wherein the highest frequency bin of the subband i is lower than the lowest frequency bin of the subband j, and the highest frequency bin of the subband j is higher than 8 kHz; and a spectral peak of spectral coefficients in the subband x, a spectral average of the spectral coefficients in the subband x, a spectral peak of spectral coefficients in the subband y, and a spectral average of the spectral coefficients in the subband y; wherein the highest frequency bin of the subband x is lower than the lowest frequency bin of the subband y;

and wherein the preset parameter condition comprises:

the subband average energy of the spectral coefficients in the subband j is greater than a product of the subband average energy of the spectral coefficients in the subband i multiplied by a constant T4; and a first product of the spectral peak of the spectral coefficients in the subband x multiplied by the spectral average of the spectral coefficients in the subband y is greater than a second product of the spectral peak of the spectral coefficients in the subband y multiplied by the spectral average of the spectral coefficients in the subband x and multiplied by a lowest value of an interval R1, and the first product is less than the second product multiplied by a highest value of the interval R1.

2. The method according to claim 1, wherein the constant T4 is less than 1/1.2 and no less than 0.5.

3. The method according to claim 1, wherein a range of frequency bins of the subband j is 4.8 kHz to 9.6 kHz; a range of frequency bins of the subband x is 1 kHz to 2.6 kHz; and a range of frequency bins of the subband y is 4.8 kHz to 6.4 kHz.

4. An audio signal encoding method, comprising:

obtaining, by an audio signal encoder, an audio signal, wherein the audio signal comprises a plurality of subbands;

obtaining, by the audio signal encoder, spectral coefficients of a current frame of the audio signal;

obtaining, by the audio signal encoder, one or more reference coding parameters of the current frame based on the spectral coefficients;

determining, by the audio signal encoder, whether the reference coding parameters satisfy a preset parameter condition; and based on a determination that the reference coding parameters satisfy the preset parameter condition, encoding, by the audio signal encoder, the spectral coefficients using a transform coded excitation (TCX) algorithm;

wherein the current frame comprises a subband i, a subband j, and a subband y;

wherein the highest frequency bin of the subband i is lower than the lowest frequency bin of the subband j, the highest frequency bin of the subband j is higher than a critical frequency bin F2, and F2 is in a range of 4.8 kHz to 8 kHz;

wherein the reference coding parameters comprise:

a subband average energy of spectral coefficients in the subband i, and a subband average energy of spectral coefficients in the subband j; and a spectral peak of spectral coefficients in the subband y, and a spectral average of the spectral coefficients in the subband y;

wherein the preset parameter condition comprises:

the subband average energy of the spectral coefficients in the subband j is greater than a product of the subband average energy of the spectral coefficients in the subband i multiplied by a constant T4; and the spectral peak of the spectral coefficients in the subband y is less than a product of the spectral average of the spectral coefficients in the subband y multiplied by a constant T45.

5. The method according to claim 4, wherein the constant T45 is 1.5.

6. The method according to claim 4, wherein a range of frequency bins of the subband j is 4.8 kHz to 9.6 kHz, and a range of frequency bins of the subband y is 4.8 kHz to 6.4 kHz.

7. An audio signal encoding method, comprising:

obtaining, by an audio signal encoder, an audio signal, wherein the audio signal comprises a plurality of subbands;

obtaining, by the audio signal encoder, spectral coefficients of a current frame of the audio signal;

obtaining, by the audio signal encoder, one or more reference coding parameters of the current frame based on the spectral coefficients;

determining, by the audio signal encoder, whether the reference coding parameters satisfy a preset parameter condition; and based on a determination that the reference coding parameters satisfy the preset parameter condition, encoding, by the audio signal encoder, the spectral coefficients using a transform coded excitation (TCX) algorithm;

wherein the current frame comprises a subband x and a subband y, wherein the reference coding parameters comprise:

a spectral peak of spectral coefficients in the subband x, a spectral average of the spectral coefficients in the subband x, a spectral peak of spectral coefficients in the subband y, and a spectral average of the spectral coefficients in the subband y;

and wherein the preset parameter condition comprises:

a product of the spectral peak of the spectral coefficients in the subband x multiplied by the spectral average of the spectral coefficients in the subband y is less than a product of the spectral peak of the spectral coefficients in the subband y multiplied by the spectral average of the spectral coefficients in the subband x multiplied by a constant T44; and the spectral peak of the spectral coefficients in the subband y is greater than a product of the spectral average of the spectral coefficients in the subband y multiplied by a constant T47.

8. An audio signal encoding method, comprising:

obtaining, by an audio signal encoder, an audio signal, wherein the audio signal comprises a plurality of subbands;

obtaining, by the audio signal encoder, spectral coefficients of a current frame of the audio signal;

obtaining, by the audio signal encoder, one or more reference coding parameters of the current frame based on the spectral coefficients;

determining, by the audio signal encoder, whether the reference coding parameters satisfy a preset parameter condition; and based on a determination that the reference coding parameters satisfy the preset parameter condition, encoding, by the audio signal encoder, the spectral coefficients using a transform coded excitation (TCX) algorithm;

wherein the current frame comprises a subband x and a subband y;

wherein the reference coding parameters comprise:

a spectral peak of spectral coefficients in the subband x, a spectral average of the spectral coefficients in the subband x, a spectral peak of spectral coefficients in the subband y, and a spectral average of the spectral coefficients in the subband y;

and wherein the preset parameter condition comprises:

a product of the spectral peak of the spectral coefficients in the subband x multiplied by the spectral average of the spectral coefficients in the subband y is greater than a product of the spectral peak of the spectral coefficients in the subband y multiplied by the spectral average of the spectral coefficients in the subband x multiplied by a constant T46; and the spectral peak of the spectral coefficients in the subband y is less than a product of the spectral average of the spectral coefficients in the subband y multiplied by a constant T45.

9. The method according to claim 8, wherein a value range of the constant T46 is 1.5 to 3.

10. An audio signal encoder, comprising:

a processor and a memory storing program instructions for execution by the processor;

wherein the processor is configured to execute the program instructions to:

obtain an audio signal, wherein the audio signal comprises a plurality of subbands;

obtain spectral coefficients of a current frame of the audio signal;

obtain one or more reference coding parameters of the current frame based on the spectral coefficients;

determine whether the reference coding parameters satisfy a preset parameter condition; and based on a determination that the reference coding parameters satisfy the preset parameter condition, encode the spectral coefficients using a transform coded excitation (TCX) algorithm;

wherein the current frame comprises a subband i, a subband j, a subband x and a subband y;

wherein the reference coding parameters comprise:

a subband average energy of spectral coefficients in the subband i, and a subband average energy of spectral coefficients in the subband j; wherein the highest frequency bin of the subband i is lower than the lowest frequency bin of the subband j, and the highest frequency bin of the subband j is higher than 8 kHz; and a spectral peak of spectral coefficients in the subband x, a spectral average of the spectral coefficients in the subband x, a spectral peak of spectral coefficients in the subband y, and a spectral average of the spectral coefficients in the subband y; wherein the highest frequency bin of the subband x is lower than the lowest frequency bin of the subband y;

and wherein the preset parameter condition comprise:

the subband average energy of the spectral coefficients in the subband j is greater than a product of the subband average energy of the spectral coefficients in the subband i multiplied by a constant T4; and a first product of the spectral peak of the spectral coefficients in the subband x multiplied by the spectral average of the spectral coefficients in the subband y is greater than a second product of the spectral peak of the spectral coefficients in the subband y multiplied by the spectral average of the spectral coefficients in the subband x and multiplied by a lowest value of an interval R1, and the first product is less than the second product multiplied by a highest value of the interval R1.

11. The audio signal encoder according to claim 10, wherein the constant T4 is less than 1/1.2 and no less than 0.5.

12. The audio signal encoder according to claim 10, wherein a range of frequency bins of the subband j is 4.8 kHz to 9.6 kHz; a range of frequency bins of the subband x is 1 kHz to 2.6 kHz; and a range of frequency bins of the subband y is 4.8 kHz to 6.4 kHz.

13. An audio signal encoder, comprising:

a processor and a memory storing program instructions for execution by the processor;

wherein the processor is configured to execute the program instructions to:

obtain an audio signal, wherein the audio signal comprises a plurality of subbands;

obtain spectral coefficients of a current frame of the audio signal;

obtain one or more reference coding parameters of the current frame based on the spectral coefficients;

determine whether the reference coding parameters satisfy a preset parameter condition; and based on a determination that the reference coding parameters satisfy the preset parameter condition, encode the spectral coefficients using a transform coded excitation (TCX) algorithm;

wherein the current frame comprises a subband i, a subband j and a subband y;

wherein the highest frequency bin of the subband i is lower than the lowest frequency bin of the subband j, the highest frequency bin of the subband j is higher than a critical frequency bin F2, and F2 is in a range of 4.8 kHz to 8 kHz;

wherein the reference coding parameters comprise:

a subband average energy of spectral coefficients in the subband i, and a subband average energy of spectral coefficients in the subband j; and a spectral peak of spectral coefficients in the subband y, and a spectral average of the spectral coefficients in the subband y;

wherein the preset parameter condition comprises:

the subband average energy of the spectral coefficients in the subband j is greater than a product of the subband average energy of the spectral coefficients in the subband i multiplied by a constant T4; and the spectral peak of the spectral coefficients in the subband y is less than a product of the spectral average of the spectral coefficients in the subband y multiplied by a constant T45.

14. The audio signal encoder according to claim 13, wherein the constant T45 is 1.5.

15. The audio signal encoder according to claim 13, wherein a range of frequency bins of the subband j is 4.8 kHz to 9.6 kHz, and a range of frequency bins of the subband y is 4.8 kHz to 6.4 kHz.

16. An audio signal encoder, comprising:

a processor and a memory storing program instructions for execution by the processor;

wherein the processor is configured to execute the program instructions to:

obtain an audio signal, wherein the audio signal comprises a plurality of subbands;

obtain spectral coefficients of a current frame of the audio signal;

obtain one or more reference coding parameters of the current frame based on the spectral coefficients;

determine whether the reference coding parameters satisfy a preset parameter condition; and based on a determination that the reference coding parameters satisfy the preset parameter condition, encode the spectral coefficients using a transform coded excitation (TCX) algorithm;

wherein the frequency band of the current frame comprises a subband x and a subband y;

wherein the reference coding parameters comprise:

a spectral peak of spectral coefficients in the subband x, a spectral average of the spectral coefficients in the subband x, a spectral peak of spectral coefficients in the subband y, and a spectral average of the spectral coefficients in the subband y;

and wherein the preset parameter condition comprises:

a product of the spectral peak of the spectral coefficients in the subband x multiplied by the spectral average of the spectral coefficients in the subband y is less than a product of the spectral peak of the spectral coefficients in the subband y multiplied by the spectral average of the spectral coefficients in the subband x multiplied by a constant T44; and the spectral peak of the spectral coefficients in the subband y is greater than a product of the spectral average of the spectral coefficients in the subband y multiplied by a constant T47.

17. An audio signal encoder, comprising:

a processor and a memory storing program instructions for execution by the processor;

wherein the processor is configured to execute the program instructions to:

obtain an audio signal, wherein the audio signal comprises a plurality of subbands;

obtain spectral coefficients of a current frame of the audio signal;

obtain one or more reference coding parameters of the current frame based on the spectral coefficients;

determine whether the reference coding parameters satisfy a preset parameter condition; and based on a determination that the reference coding parameters satisfy the preset parameter condition, encode the spectral coefficients using a transform coded excitation (TCX) algorithm;

wherein the frequency band of the current frame comprises a subband x and a subband y;

wherein the reference coding parameters comprise:

a spectral peak of spectral coefficients in the subband x, a spectral average of the spectral coefficients in the subband x, a spectral peak of spectral coefficients in the subband y, and a spectral average of the spectral coefficients in the subband y;

and wherein the preset parameter condition comprises:

a product of the spectral peak of the spectral coefficients in the subband x multiplied by the spectral average of the spectral coefficients in the subband y is greater than a product of the spectral peak of the spectral coefficients in the subband y multiplied by the spectral average of the spectral coefficients in the subband x multiplied by a constant T46; and the spectral peak of the spectral coefficients in the subband y is less than a product of the spectral average of the spectral coefficients in the subband y multiplied by a constant T45.

18. The audio signal encoder according to claim 17, wherein a value range of the constant T46 is 1.5 to 3.

* * * * *